US012654076B2

(12) United States Patent
Taylor et al.

(10) Patent No.: US 12,654,076 B2
(45) **Date of Patent: *Jun. 16, 2026**

(54) IRON-TYPE GOLF CLUB HEAD

(71) Applicant: Taylor Made Golf Company, Inc, Carlsbad, CA (US)

(72) Inventors: Scott Taylor, Bonita, CA (US); Joseph H. Hoffman, Carlsbad, CA (US); Matthew D. Johnson, Carlsbad, CA (US); Todd Beach, Encinitas, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 2 days.

This patent is subject to a terminal disclaimer.

(21) Appl. No.: 18/397,351

(22) Filed: Dec. 27, 2023

(65) Prior Publication Data

US 2024/0207700 A1 Jun. 27, 2024

Related U.S. Application Data

(63) Continuation of application No. 17/856,533, filed on Jul. 1, 2022, now Pat. No. 11,890,516, which is a (Continued)

(51) Int. Cl.
*A63B 53/04* (2015.01)

(52) U.S. Cl.
CPC ..... *A63B 53/0475* (2013.01); *A63B 53/0445* (2020.08); *A63B 2053/0479* (2013.01)

(58) Field of Classification Search
CPC ..... A63B 53/0408; A63B 53/0458; A63B 53/047; A63B 53/0475
See application file for complete search history.

(56) References Cited

U.S. PATENT DOCUMENTS 2,028,291 A * 1/1936 MacPherson ..... A63B 60/02 473/519
3,199,874 A * 8/1965 Blasing ..... A63B 53/0466 473/335

(Continued)

FOREIGN PATENT DOCUMENTS

JP 01043278 A * 2/1989
JP 06238022 A * 8/1994

(Continued)

OTHER PUBLICATIONS

Smooth-On product website, https://www.smooth-on.com, accessed May 6, 2020.

(Continued)

*Primary Examiner* — Alvin A Hunter
(74) *Attorney, Agent, or Firm* — Kunzler Bean & Adamson

(57) ABSTRACT

Disclosed herein is an iron-type golf club head that comprises a strike plate, an enclosed internal cavity, and a rear aperture formed in a rear wall. The iron-type golf club head also comprises a stiffening plug, within the internal cavity and compressed between the back surface of the strike plate and the rear wall. The stiffening plug is insertable, through a rear aperture, into the internal cavity. The iron-type golf club head further comprises a rear fascia covering the rear aperture and at least a portion of the rear wall. A characteristic time (CT) at a geometric center of the strike face is at least 250 microseconds. A maximum thickness of the strike plate, at the strike face, is less than 3.5 millimeters, inclusive. The strike plate, excluding grooves, has a minimum thickness between 1.1 millimeters and 2.2 millimeters.

37 Claims, 25 Drawing Sheets

Related U.S. Application Data continuation of application No. 16/870,714, filed on May 8, 2020, now Pat. No. 11,406,882.

(60) Provisional application No. 62/954,211, filed on Dec. 27, 2019, provisional application No. 62/846,492, filed on May 10, 2019.

(56) References Cited

U.S. PATENT DOCUMENTS 4,076,254 A * 2/1978 Nygren ..... A63B 53/0466 473/348
4,214,754 A * 7/1980 Zebelean ..... A63B 53/0466 473/346
4,313,607 A * 2/1982 Thompson ..... A63B 53/0466 473/328
4,511,145 A * 4/1985 Schmidt ..... A63B 53/0466 473/346
4,535,990 A * 8/1985 Yamada ..... A63B 53/04 473/347
4,602,787 A * 7/1986 Sugioka ..... A63B 53/0466 473/346
4,732,389 A * 3/1988 Kobayashi ..... A63B 53/0466 473/348
4,824,110 A * 4/1989 Kobayashi ..... A63B 60/00 473/347
4,944,515 A * 7/1990 Shearer ..... A63B 53/04 473/337
5,290,036 A 3/1994 Fenton
5,295,689 A * 3/1994 Lundberg ..... A63B 53/0466 473/346
5,328,184 A * 7/1994 Antonious ..... A63B 60/00 473/346
5,377,985 A * 1/1995 Ohnishi ..... A63B 53/047 D21/747
5,425,535 A 6/1995 Gee
5,464,211 A * 11/1995 Atkins, Sr. ..... A63B 60/00 473/346
5,499,819 A 3/1996 Nagamoto
5,518,243 A * 5/1996 Redman ..... A63B 53/04 473/334
5,547,194 A * 8/1996 Aizawa ..... A63B 53/047 473/350
5,547,427 A * 8/1996 Rigal ..... A63B 53/04 473/345
5,570,886 A * 11/1996 Rigal ..... A63B 53/04 473/335
5,649,873 A 7/1997 Fuller
5,688,189 A * 11/1997 Bland ..... A63B 60/02 473/340
5,720,674 A * 2/1998 Galy ..... A63B 53/0466 473/335
5,755,627 A * 5/1998 Yamazaki ..... A63B 53/0466 473/305
5,766,092 A * 6/1998 Mimeur ..... A63B 60/00 473/332
5,769,737 A * 6/1998 Holladay ..... A63B 53/06 473/340
5,873,791 A * 2/1999 Allen ..... A63B 53/04 473/332
5,888,148 A * 3/1999 Allen ..... A63B 60/00 473/290
5,899,821 A * 5/1999 Hsu ..... A63B 53/047 473/332
5,916,042 A * 6/1999 Reimers ..... A63B 53/04 473/345
5,941,782 A * 8/1999 Cook ..... A63B 53/04 473/346
5,971,867 A * 10/1999 Galy ..... A63B 53/0466 473/335
6,015,354 A * 1/2000 Ahn ..... A63B 53/04 473/341
6,030,295 A * 2/2000 Takeda ..... A63B 60/00 473/335
6,059,669 A * 5/2000 Pearce ..... A63B 53/04 473/339
6,162,133 A * 12/2000 Peterson ..... A63B 53/0466 473/345
6,277,032 B1 * 8/2001 Smith ..... A63B 53/047 473/336
6,354,961 B1 * 3/2002 Allen ..... A63B 53/0466 473/282
6,361,451 B1 * 3/2002 Masters ..... A63B 60/42 482/18
6,379,263 B2 4/2002 Erickson
6,394,909 B1 * 5/2002 Laibangyang ..... A63B 53/10 473/238
6,440,009 B1 * 8/2002 Guibaud ..... A63B 53/0466 473/349
6,533,679 B1 3/2003 McCabe
6,575,854 B1 * 6/2003 Yang ..... A63B 59/50 473/333
6,592,469 B2 7/2003 Gilbert
6,638,183 B2 * 10/2003 Takeda ..... A63B 53/047 473/335
6,695,937 B1 2/2004 Stites, III
6,743,117 B2 6/2004 Gilbert
6,780,123 B2 * 8/2004 Hasebe ..... A63B 60/00 473/291
6,811,496 B2 11/2004 Wahl
6,942,580 B2 * 9/2005 Hou ..... A63B 53/047 473/332
6,984,180 B2 * 1/2006 Hasebe ..... A63B 53/04 473/291
6,997,820 B2 * 2/2006 Willett ..... A63B 60/00 473/349
7,108,609 B2 * 9/2006 Stites ..... A63B 53/06 473/335
7,121,958 B2 10/2006 Cheng
7,125,343 B2 * 10/2006 Imamoto ..... A63B 53/04 473/347
7,140,977 B2 * 11/2006 Atkins, Sr. ..... A63B 60/00 473/333
7,147,573 B2 * 12/2006 DiMarco ..... A63B 53/0466 473/335
7,160,204 B2 * 1/2007 Huang ..... A63B 60/00 473/350
7,166,041 B2 * 1/2007 Evans ..... A63B 53/0466 473/335
7,192,362 B2 3/2007 Gilbert
7,207,900 B2 4/2007 Nicolette
7,258,629 B2 * 8/2007 Chen ..... A63B 53/047 473/345
7,267,620 B2 9/2007 Chao et al.
7,281,991 B2 10/2007 Gilbert
7,393,287 B2 * 7/2008 Huang ..... A63B 53/0466 473/332
7,452,286 B2 * 11/2008 Lin ..... A63B 53/0466 473/335
7,476,162 B2 * 1/2009 Stites ..... A63B 60/00 473/332
7,520,820 B2 * 4/2009 Dimarco ..... A63B 60/00 473/335
7,544,136 B2 * 6/2009 Tsai ..... A63B 53/047 473/349
7,611,424 B2 * 11/2009 Nagai ..... A63B 60/02 473/335
7,662,051 B2 * 2/2010 Chen ..... A63B 53/047 473/350
7,713,141 B2 * 5/2010 Yamamoto ..... A63B 60/54 473/332
7,717,807 B2 5/2010 Evans
7,744,486 B2 * 6/2010 Hou ..... A63B 53/047 473/332
7,749,100 B2 * 7/2010 Tavares ..... A63B 60/02 473/332
7,775,905 B2 * 8/2010 Beach ..... A63B 53/0466 473/256

(56) References Cited

U.S. PATENT DOCUMENTS 7,819,759 B2 * 10/2010 Matsunaga ..... A63B 53/0466 473/349
7,824,277 B2 * 11/2010 Bennett ..... A63B 53/06 473/328
7,857,707 B2 * 12/2010 Beppu ..... A63B 69/36 473/297
7,871,334 B2 * 1/2011 Young ..... A63B 53/04 473/256
7,871,335 B2 * 1/2011 Young ..... A63B 53/0466 473/329
7,871,338 B2 * 1/2011 Nakano ..... A63B 53/04 473/332
7,874,936 B2 1/2011 Chao
7,874,937 B2 1/2011 Chao
7,914,403 B2 * 3/2011 Ie ..... A63B 59/70 473/563
7,922,604 B2 * 4/2011 Roach ..... A63B 60/02 473/332
RE42,544 E 7/2011 Chao et al.
7,976,400 B1 * 7/2011 Pottorff ..... A63B 60/02 473/340
7,985,146 B2 7/2011 Lin et al.
8,025,587 B2 9/2011 Beach et al.
8,062,150 B2 * 11/2011 Gilbert ..... A63B 53/0475 473/332
8,088,025 B2 * 1/2012 Wahl ..... A63B 53/047 473/345
8,096,897 B2 1/2012 Beach et al.
8,133,133 B2 3/2012 Gilbert
8,157,673 B2 4/2012 Gilbert
8,202,174 B2 * 6/2012 Breier ..... A63B 60/54 473/332
8,202,175 B2 * 6/2012 Ban ..... A63B 53/0466 473/345
8,235,831 B2 8/2012 Beach et al.
8,257,198 B2 9/2012 Gilbert
8,302,658 B2 11/2012 Gilbert
8,303,431 B2 11/2012 Beach et al.
8,308,582 B2 * 11/2012 Tanimoto ..... A63B 53/04 473/335
8,337,319 B2 12/2012 Sargent et al.
8,353,785 B2 1/2013 Ines et al.
8,388,464 B2 3/2013 Gilbert
8,409,022 B2 4/2013 Oldknow
8,444,502 B2 * 5/2013 Karube ..... A63B 53/007 473/297
8,444,505 B2 * 5/2013 Beach ..... A63B 60/00 473/335
8,449,406 B1 * 5/2013 Frame ..... A63B 53/047 473/332
8,475,293 B2 * 7/2013 Morin ..... A63B 53/047 473/349
8,535,177 B1 * 9/2013 Wahl ..... A63B 53/04 D21/748
8,556,756 B2 * 10/2013 McClung ..... A63B 60/52 473/519
8,608,585 B2 * 12/2013 Stites ..... A63B 53/047 473/282
8,628,434 B2 1/2014 Chao
8,702,530 B2 * 4/2014 Slaughter ..... A63B 53/047 473/297
8,734,271 B2 * 5/2014 Beach ..... A63B 60/00 473/345
8,753,219 B2 6/2014 Gilbert
8,753,220 B2 * 6/2014 Roach ..... A63B 53/047 473/332
8,758,163 B2 * 6/2014 Stites ..... A63B 53/06 473/332
8,840,487 B2 * 9/2014 Okot ..... A63B 53/02 473/307
8,870,678 B2 * 10/2014 Beach ..... A63B 60/00 473/345
8,911,304 B1 * 12/2014 Dawson ..... A63B 60/02 473/291
8,920,258 B2 * 12/2014 Dolezel ..... A63B 53/04 228/101
8,920,261 B2 * 12/2014 Taylor ..... B23P 11/02 473/350
8,961,336 B1 2/2015 Parsons
8,974,317 B1 * 3/2015 Griffin ..... A63B 60/02 473/347
9,033,821 B2 5/2015 Beach et al.
9,044,653 B2 6/2015 Wahl et al.
9,067,107 B2 * 6/2015 Solhaug ..... A63B 60/42
9,101,805 B2 8/2015 Stites
9,138,622 B1 * 9/2015 DeMille ..... A63B 60/00
9,162,119 B2 10/2015 Park
9,211,451 B1 * 12/2015 Westrum ..... A63B 60/42
9,211,453 B1 * 12/2015 Foster ..... A63B 53/06
9,259,627 B1 * 2/2016 Myers ..... A63B 53/04
9,259,629 B2 2/2016 Gilbert
9,265,995 B2 2/2016 Wahl
9,278,262 B2 * 3/2016 Sargent ..... A63B 53/045
9,364,728 B1 * 6/2016 Myers ..... A63B 60/52
9,421,432 B2 * 8/2016 Galvan ..... A63B 60/02
9,427,635 B2 8/2016 Ines
9,492,722 B2 11/2016 Taylor
9,517,393 B2 * 12/2016 Cardani ..... A63B 53/0475
9,597,562 B2 3/2017 Dipert
9,675,852 B2 * 6/2017 Westrum ..... A63B 60/54
9,700,764 B2 * 7/2017 Carter ..... A63B 53/0466
9,731,176 B2 8/2017 Issertell
9,808,685 B1 11/2017 Westrum
9,987,524 B2 * 6/2018 Jertson ..... A63B 53/0487
10,039,965 B1 * 8/2018 Seluga ..... A63B 60/54
10,065,088 B2 * 9/2018 Hebreo ..... A63B 53/047
10,071,291 B2 * 9/2018 Daraskavich ..... A63B 53/0475
10,099,103 B2 10/2018 Golden
10,173,111 B2 * 1/2019 Busch ..... A63B 53/0487
10,188,915 B1 * 1/2019 Hoffman ..... A63B 60/52
10,293,226 B2 * 5/2019 Hebreo ..... A63B 53/08
10,343,035 B2 * 7/2019 Chen ..... A63B 53/0475
10,343,037 B2 * 7/2019 Hebreo ..... A63B 53/0466
10,369,427 B2 * 8/2019 Sanchez ..... A63B 53/0466
10,543,406 B2 * 1/2020 Carter ..... A63B 53/0466
10,543,409 B2 * 1/2020 Demkowski ..... A63B 53/0466
10,589,155 B2 3/2020 Hoffman et al.
10,596,428 B1 * 3/2020 Rumble ..... A63B 60/02
10,625,126 B2 4/2020 Demkowski et al.
10,625,127 B2 * 4/2020 Golden ..... A63B 53/06
10,843,053 B2 * 11/2020 Carter ..... A63B 53/08
11,406,882 B2 * 8/2022 Taylor ..... A63B 53/0408
11,890,516 B2 * 2/2024 Taylor ..... A63B 53/042
12,070,666 B2 * 8/2024 Nielson ..... A63B 60/02
2006/0122004 A1 * 6/2006 Chen ..... A63B 53/0466 473/335
2006/0178228 A1 * 8/2006 DiMarco ..... A63B 60/02 473/345
2006/0240908 A1 * 10/2006 Adams ..... A63B 60/02 473/335
2007/0117653 A1 * 5/2007 Yoneyama ..... A63B 53/047 473/350
2007/0178988 A1 * 8/2007 Tavares ..... A63B 60/02 473/340
2007/0265108 A1 * 11/2007 Lin ..... A63B 60/02 473/349
2008/0020861 A1 * 1/2008 Adams ..... A63B 60/00 473/336
2008/0039228 A1 * 2/2008 Breier ..... A63B 60/00 473/345
2008/0149267 A1 6/2008 Chao
2008/0194354 A1 * 8/2008 Nagai ..... A63B 53/0466 473/334
2008/0261715 A1 * 10/2008 Carter ..... A63B 53/047 473/335
2009/0029800 A1 1/2009 Jones
2009/0163289 A1 6/2009 Chao
2009/0203463 A1 * 8/2009 Dimarco ..... A63B 53/0466 473/349

(56) References Cited

U.S. PATENT DOCUMENTS

| | | | | |
|---|---|---|---|---|
| 2009/0215551 | A1* | 8/2009 | Liang | A63B 53/06 473/335 |
| 2010/0075773 | A1* | 3/2010 | Casati, Jr. | A63B 59/00 473/519 |
| 2010/0144461 | A1* | 6/2010 | Ban | A63B 53/0466 473/338 |
| 2011/0053705 | A1* | 3/2011 | Stites | A63B 60/02 473/282 |
| 2011/0152000 | A1 | 6/2011 | Sargent et al. | |
| 2011/0275451 | A1 | 11/2011 | Chao et al. | |
| 2011/0281665 | A1 | 11/2011 | Kawaguchi | |
| 2011/0312437 | A1 | 12/2011 | Sargent et al. | |
| 2012/0058838 | A1* | 3/2012 | Stites | A63B 53/047 473/334 |
| 2012/0071264 | A1 | 3/2012 | Beach et al. | |
| 2012/0122601 | A1 | 5/2012 | Beach et al. | |
| 2012/0157223 | A1 | 6/2012 | Finn | |
| 2012/0258818 | A1 | 10/2012 | Sargent et al. | |
| 2013/0165257 | A1 | 6/2013 | Dipert | |
| 2013/0252754 | A1 | 9/2013 | Bazzel | |
| 2014/0038746 | A1* | 2/2014 | Beach | A63B 53/0466 473/335 |
| 2014/0302946 | A1 | 10/2014 | Rae et al. | |
| 2015/0165281 | A1 | 6/2015 | Ines | |
| 2015/0217364 | A1 | 8/2015 | Zimmerman | |
| 2016/0129323 | A1* | 5/2016 | Myers | A63B 53/0466 473/338 |
| 2018/0185717 | A1 | 7/2018 | Demkowski et al. | |
| 2019/0151727 | A1 | 5/2019 | Greaney | |
| 2019/0201754 | A1 | 7/2019 | Hoffman et al. | |
| 2022/0401802 | A1* | 12/2022 | Taylor | A63B 53/042 |
| 2024/0014912 | A1 | 1/2024 | Yanabu | |
| 2024/0207700 | A1* | 6/2024 | Taylor | A63B 53/0408 |

FOREIGN PATENT DOCUMENTS

| | | | | | |
|---|---|---|---|---|---|
| JP | 2004351154 | A | * | 12/2004 | |
| JP | 2005296582 | A | * | 10/2005 | |
| JP | 2005323978 | A | * | 11/2005 | |
| JP | 2006198385 | A | * | 8/2006 | |
| JP | 2006223788 | A | * | 8/2006 | |
| JP | 2006239351 | A | * | 9/2006 | |
| JP | 2006288882 | A | * | 10/2006 | |
| JP | 2006320493 | A | * | 11/2006 | |
| JP | 2008194454 | A | * | 8/2008 | A63B 53/0466 |
| JP | 2009172130 | A | * | 8/2009 | |
| JP | 2018110844 | A | * | 7/2018 | A63B 3/0408 |
| JP | 2021037319 | A | * | 3/2021 | A63B 21/078 |
| WO | 1997027907 | A1 | | 8/1997 | |
| WO | WO-2007044220 | A1 | * | 4/2007 | A63B 53/047 |
| WO | 2012103340 | A2 | | 8/2012 | |
| WO | 2012103340 | A3 | | 8/2012 | |
| WO | 2012134740 | A1 | | 10/2012 | |
| WO | 2013025212 | A1 | | 2/2013 | |

OTHER PUBLICATIONS

Procedure for Measuring The Flexibility of a Golf Clubhead, USGA-TPX3004, Revision 1.0.0, May 1, 2008, pp. 1-11, https://www.usga.org/content/dam/usga/pdf/Equipment/TPX3004-procedure-for-measuring-the-flexibility-of-a-golf-clubhead.pdf, accessed May 12, 2020.

Procedure for Measuring The Club Head Size of Wood Clubs, USGA-TPX3003, Revision 1.0.0, Nov. 21, 2003, https://www.usga.org/content/dam/usga/pdf/Equipment/TPX3003-procedure-for-measuring-the-club-head-size-of-wood-clubs.pdf, accessed May 12, 2020.

The Equipment Rules, The R&A and USGA, Jan. 1, 2019, https://www.usga.org/content/dam/usga/pdf/Equipment/Equipment%20Rules%202020%20v2.pdf, access May 12, 2020.

* cited by examiner

IRON-TYPE GOLF CLUB HEAD

CROSS-REFERENCE TO RELATED APPLICATIONS

This application is a continuation of U.S. patent application Ser. No. 17/856,533, filed Jul. 1, 2022, which is a continuation of U.S. patent application Ser. No. 16/870,714, filed May 8, 2020, which claims the benefit of U.S. Provisional Patent Application No. 62/846,492, filed May 10, 2019, and U.S. Provisional Patent Application No. 62/954,211, filed Dec. 27, 2019, which are incorporated herein by reference in their entirety. This application is related to U.S. Pat. No. 10,188,915, issued Jan. 29, 2019, U.S. Pat. No. 10,589,155, issued Mar. 17, 2020, U.S. patent application Ser. No. 16/223,108, filed Dec. 17, 2018, and U.S. patent application Ser. No. 16/525,284, filed Jul. 29, 2019, which are incorporated herein by reference in their entirety.

FIELD

This disclosure relates generally to golf clubs, and more particularly to a head of an iron-type golf club with characteristic time (CT) control and tuning features.

BACKGROUND

Modern "wood-type" golf clubs (notably, "drivers," "fairway woods," and "utility or hybrid clubs"), are generally called "metalwoods" since they tend to be made of strong, lightweight metals, such as titanium. An exemplary metalwood golf club, such as a driver or fairway wood, typically includes a hollow shaft and a golf club head coupled to a lower end of the shaft. Most modern versions of club heads are made, at least in part, from a lightweight but strong metal, such as a titanium alloy. In most cases, the golf club head is includes a hollow body with a face portion. The face portion has a front surface, known as a strike plate, configured to contact the golf ball during a proper golf swing.

Under USGA regulations governing the configuration of driver-type golf club heads, the characteristic time (CT) of a driver-type golf club head at all points on the face portion within a hitting zone cannot exceed a regulated CT threshold. Conventional golf club heads may sacrifice some performance characteristics at the expense of meeting the regulated CT threshold. For example, some golf club heads have thickened the face portion at areas away from a center of the face portion in an attempt to meet the CT threshold in such areas. However, such attempts have resulted in a corresponding reduction in the CT at the center of the face portion. Additionally, to ensure the CT does not exceed the regulated CT threshold, some conventional golf club heads are designed to have a CT within a cautiously large standard deviation of a target CT lower than the regulated CT threshold. Such large standard deviations, however, can result in batches of produced golf club heads with significantly non-uniform performance characteristics. Accordingly, meeting the regulated CT threshold while reducing the negative impact on other performance characteristics of the golf club head can be difficult.

SUMMARY

Like wood-type golf clubs, "iron-type" golf clubs typically include a hollow shaft and a golf club head coupled to a lower end of the shaft. Most modern versions of club heads are made, at least in part, from a lightweight but strong metal, such as steel or a titanium alloy. Iron-type golf club heads can be one of a cavity-back golf club head, a muscle-back golf club head, or a hollow-cavity-type golf club head. Moreover, iron-type golf club heads include a body and a face portion. The face portion has a front surface, known as a strike face, configured to contact the golf ball during a proper golf swing.

The characteristic time (CT) of a golf club head is the amount of time a metal hemisphere, at the end of a pendulum, remains in contact with the face portion of a golf club head during a bounce of the metal hemisphere against the face portion. The characteristics of the pendulum and metal hemisphere, as well as the constraints of the CT testing equipment, are governed by the United States Golf Association ("USGA") under the Procedure for Measuring the Flexibility of a Golf Club Head manual, which is published at www.usga.org and incorporated herein by reference. The CT of a golf club head is directly related to the flexibility or spring-like effect of the face portion of the golf club head. In other words, the higher the flexibility of the face portion, the higher the CT of the golf club head. Under the USGA regulations governing the configuration of wood-type golf club heads, the CT of a golf club head at all points on the face portion within a hitting zone cannot exceed a regulated CT threshold.

Currently, USGA regulations do not govern the CT of iron-type golf club heads. Accordingly, as of this writing, the USGA regulations do not include a regulated CT threshold for iron-type golf club heads. However, the USGA regulations do govern the coefficient-of-restitution (COR) of iron-type golf club heads by setting a regulated COR threshold below which the COR of iron-type golf club heads are required to be. As described below, the COR of an iron-type golf club head is closely tied to the CT of the golf club such that lowering the CT of a golf club head often results in a lowering of the COR of the golf club head. Moreover, the USGA regulations may govern the CT of iron-type golf club heads in the future. Accordingly, the present disclosure provides an iron-type golf club head and corresponding method that facilitates tuning of the CT of the iron-type golf club head to predictably and accurately produce an iron-type golf club head with a desired CT (e.g., a predetermined CT or a regulated CT threshold) that may, or may not, correspond with the regulated COR threshold.

In some examples, the golf club heads of the present disclosure help to lower the CT of the face portions at locations away from the center of the face portion without negatively affecting the performance of the face portion at the center compared to conventional golf club heads. Moreover, in certain examples, the golf club heads of the present disclosure promote smaller standard deviations of CT for batches of produced golf club heads compared to conventional golf club heads.

Disclosed herein is an iron-type golf club head. The iron-type golf club head comprises a body, comprising a heel portion, a sole portion, a toe portion, a top-line portion, a front portion, and a rear portion. The iron-type golf club head also comprises a strike plate, coupled to the front portion of the body and comprising a strike face and a back surface opposite the strike face. The iron-type golf club head further comprises an internal cavity, defined between the back surface of the strike plate and the body. The iron-type golf club head additionally comprises at least one stiffener comprising a discrete mass of polymeric material within the internal cavity and directly coupled to the back surface of the strike plate. The polymeric material of the at least one discrete mass has a hardness equal to or greater than Shore 5.95D. The iron-type golf club head has coefficient of restitution (COR) change value between 0.000 and +0.008, the COR change value being defined as a difference between a measured COR value of the iron-type golf club head and a calibration plate COR value. The preceding subject matter of this paragraph characterizes example 1 of the present disclosure.

The iron-type golf club head, without the at least one stiffener, has a COR change value no less than +0.009. The preceding subject matter of this paragraph characterizes example 2 of the present disclosure, wherein example 2 also includes the subject matter according to example 1, above.

The internal cavity is enclosed. The preceding subject matter of this paragraph characterizes example 3 of the present disclosure, wherein example 3 also includes the subject matter according to any one of examples 1-2, above.

The front portion of the body comprises an aperture extending through the front portion at a location corresponding with the discrete mass of polymeric material. The preceding subject matter of this paragraph characterizes example 4 of the present disclosure, wherein example 4 also includes the subject matter according to example 3, above.

The iron-type golf club head further comprises a plug covering the aperture of the strike plate. The preceding subject matter of this paragraph characterizes example 5 of the present disclosure, wherein example 5 also includes the subject matter according to example 4, above.

The iron-type golf club head further comprises a filler material surrounding the discrete mass of polymeric material and filling at least a portion of the internal cavity. The preceding subject matter of this paragraph characterizes example 6 of the present disclosure, wherein example 6 also includes the subject matter according to any one of examples 3-5, above.

The filler material surrounds a portion of the polymeric material and occupies about 50% to about 99% of the internal cavity of the golf club head. The preceding subject matter of this paragraph characterizes example 7 of the present disclosure, wherein example 7 also includes the subject matter according to example 6, above.

The filler material reduces a coefficient of restitution (COR) of the golf club head no more than 0.025. The preceding subject matter of this paragraph characterizes example 8 of the present disclosure, wherein example 8 also includes the subject matter according to example 7, above.

The filler material reduces the COR of the golf club head no more than 0.010. The preceding subject matter of this paragraph characterizes example 9 of the present disclosure, wherein example 9 also includes the subject matter according to example 8, above.

The filler material has a density greater than 0.21 g/cc and no more than 0.71 g/cc. The preceding subject matter of this paragraph characterizes example 10 of the present disclosure, wherein example 10 also includes the subject matter according to any one of examples 6-9, above.

The filler material has an overall mass greater than 5 grams. The preceding subject matter of this paragraph characterizes example 11 of the present disclosure, wherein example 11 also includes the subject matter according to example 10, above.

The density of the filler material is no less than 0.30 g/cc and no more than 0.60 g/cc. The preceding subject matter of this paragraph characterizes example 12 of the present disclosure, wherein example 12 also includes the subject matter according to example 11, above.

The overall mass of the filler material is no less than 5.4 grams. The preceding subject matter of this paragraph characterizes example 13 of the present disclosure, wherein example 13 also includes the subject matter according to example 12, above.

The overall mass of the filler material is less than 11 grams. The preceding subject matter of this paragraph characterizes example 14 of the present disclosure, wherein example 14 also includes the subject matter according to example 13, above.

A total combined mass of the filler material and the at least one stiffener is greater than 5 grams. The preceding subject matter of this paragraph characterizes example 15 of the present disclosure, wherein example 15 also includes the subject matter according to any one of examples 6-14, above.

The total combined mass of the filler material and the at least one stiffener is greater than 5.5 grams. The preceding subject matter of this paragraph characterizes example 16 of the present disclosure, wherein example 16 also includes the subject matter according to example 15, above.

The at least one stiffener further comprises an enclosure within the internal cavity and defining a cavity isolated from the internal cavity of the golf club head. The discrete mass of polymeric material is retained within the cavity of the enclosure. The preceding subject matter of this paragraph characterizes example 17 of the present disclosure, wherein example 17 also includes the subject matter according to any one of examples 6-16, above.

The polymeric material has an overall mass less than 5 grams and more than 0.25 grams. The preceding subject matter of this paragraph characterizes example 18 of the present disclosure, wherein example 18 also includes the subject matter according to any one of examples 1-17, above.

The polymeric material has an overall mass no more than 3 grams and more than 0.25 grams. The preceding subject matter of this paragraph characterizes example 19 of the present disclosure, wherein example 19 also includes the subject matter according to any one of examples 1-18, above.

The toe portion comprises an aperture extending through the toe portion and providing access to the back surface of the strike face. The discrete mass of polymeric material is insertable, through the aperture in the toe portion, into the internal cavity against the back surface of the strike plate. The preceding subject matter of this paragraph characterizes example 20 of the present disclosure, wherein example 20 also includes the subject matter according to any one of examples 3-19, above.

The iron-type golf club head further comprises a plug covering the aperture of the toe portion. The preceding subject matter of this paragraph characterizes example 21 of the present disclosure, wherein example 21 also includes the subject matter according to example 20, above.

A total mass of the plug is between 0.2 grams and 10 grams, inclusive. The preceding subject matter of this paragraph characterizes example 22 of the present disclosure, wherein example 22 also includes the subject matter according to example 21, above.

The total mass of the plug is between 0.2 grams and 5 grams, inclusive. The preceding subject matter of this paragraph characterizes example 23 of the present disclosure, wherein example 23 also includes the subject matter according to example 22, above.

A total mass of the plug is between 0.2 grams and 3 grams, inclusive. The preceding subject matter of this paragraph characterizes example 24 of the present disclosure, wherein example 24 also includes the subject matter according to example 23, above.

The rear portion comprises an aperture extending through the rear portion and providing access to the back surface of the strike face. The discrete mass of polymeric material is insertable, through the aperture in the back portion, into the internal cavity against the back surface of the strike plate. The preceding subject matter of this paragraph characterizes example 25 of the present disclosure, wherein example 25 also includes the subject matter according to any one of examples 3-24, above.

The discrete mass of polymeric material is inserted into the internal cavity from the rear portion of the golf club head. The preceding subject matter of this paragraph characterizes example 26 of the present disclosure, wherein example 26 also includes the subject matter according to any one of examples 1-25, above.

The iron-type golf club head further comprises a rear fascia covering at least a portion of the rear portion of the golf club head. The preceding subject matter of this paragraph characterizes example 27 of the present disclosure, wherein example 27 also includes the subject matter according to example 26, above.

The rear fascia is made of a material having a density between 0.9 g/cc and 5 g/cc, inclusive. The preceding subject matter of this paragraph characterizes example 28 of the present disclosure, wherein example 28 also includes the subject matter according to example 27, above.

The iron-type golf club head further comprises lateral retaining features, within the internal cavity and spaced apart from each other. The discrete mass of polymeric material is laterally retained between the lateral retaining features. The preceding subject matter of this paragraph characterizes example 29 of the present disclosure, wherein example 29 also includes the subject matter according to any one of examples 1-28, above.

The lateral retaining features are in direct contact with the back surface of the strike face. The preceding subject matter of this paragraph characterizes example 30 of the present disclosure, wherein example 30 also includes the subject matter according to example 29, above.

The lateral retaining features form a one-piece, monolithic, construction with the body. The preceding subject matter of this paragraph characterizes example 31 of the present disclosure, wherein example 31 also includes the subject matter according to any one of examples 29-30, above.

Each of the lateral retaining features is a rib. The preceding subject matter of this paragraph characterizes example 32 of the present disclosure, wherein example 32 also includes the subject matter according to example 31, above.

Each of the lateral retaining features is a foam wall. The preceding subject matter of this paragraph characterizes example 33 of the present disclosure, wherein example 33 also includes the subject matter according to any one of examples 29-32, above.

The lateral retaining features comprises a first wall toeward of a geometric center of the strike face and a second wall heel-ward of the geometric center of the strike face. The preceding subject matter of this paragraph characterizes example 34 of the present disclosure, wherein example 34 also includes the subject matter according to any one of examples 29-33, above.

The strike plate is made from a high-strength alloy steel. A maximum thickness of the strike plate, at the strike face, is less than 2 millimeters, inclusive. The preceding subject matter of this paragraph characterizes example 35 of the present disclosure, wherein example 35 also includes the subject matter according to any one of examples 1-34, above.

The strike plate is made from C300 alloy steel. A maximum thickness of the strike plate, at the strike face, is less than 3.5 millimeters, inclusive. The preceding subject matter of this paragraph characterizes example 36 of the present disclosure, wherein example 36 also includes the subject matter according to any one of examples 1-35, above.

The discrete mass of polymeric material is directly coupled to a portion of the back surface of the strike plate that adjoins an intersection between the strike plate and the sole portion of the body. The preceding subject matter of this paragraph characterizes example 37 of the present disclosure, wherein example 37 also includes the subject matter according to any one of examples 1-36, above.

Further disclosed herein is an iron-type golf club head. The iron-type golf club head comprises a body, comprising a heel portion, a sole portion, a toe portion, a top-line portion, a front portion, and a rear portion. The rear portion comprises a rear wall enclosing the rear portion. The iron-type golf club head also comprises a strike plate, coupled to the front portion of the body and comprising a strike face and a back surface opposite the strike face. The iron-type golf club head further comprises an enclosed internal cavity, defined between the back surface of the strike plate and the rear wall of the body. The iron-type golf club head additionally comprises a rear aperture formed in the rear wall. The iron-type golf club head also comprises a discrete mass of polymeric material within the internal cavity and directly coupled to the back surface of the strike plate. The discrete mass is injected, through the rear aperture, into the internal cavity. The iron-type golf club head further comprises a plug covering the rear aperture. The iron-type golf club head has coefficient of restitution (COR) change value between −0.015 and +0.008, the COR change value being defined as a difference between a measured COR value of the iron-type golf club head and a calibration plate COR value. The preceding subject matter of this paragraph characterizes example 38 of the present disclosure.

The COR change value is greater than 0.000. The preceding subject matter of this paragraph characterizes example 39 of the present disclosure, wherein example 39 also includes the subject matter according to example 38, above.

A characteristic time (CT) at a geometric center of the strike face is at least 250 microseconds. The preceding subject matter of this paragraph characterizes example 40 of the present disclosure, wherein example 40 also includes the subject matter according to any one of examples 38-39, above.

The CT at the geometric center of the strike face is at least 270 microseconds. The preceding subject matter of this paragraph characterizes example 41 of the present disclosure, wherein example 41 also includes the subject matter according to example 40, above.

The strike plate is made from C300 alloy steel. A maximum thickness of the strike plate, at the strike face, is less than 3.5 millimeters, inclusive. The preceding subject matter of this paragraph characterizes example 42 of the present disclosure, wherein example 42 also includes the subject matter according to any one of examples 38-41, above.

The maximum thickness of the strike plate, at the strike face, is greater than 1 millimeter, inclusive. The preceding subject matter of this paragraph characterizes example 43 of the present disclosure, wherein example 43 also includes the subject matter according to example 42, above.

The strike plate is made from 4140 alloy steel. A maximum thickness of the strike plate, at the strike face, is less than 3.5 millimeters, inclusive. The preceding subject matter of this paragraph characterizes example 44 of the present disclosure, wherein example 44 also includes the subject matter according to any one of examples 38-43, above.

The maximum thickness of the strike plate, at the strike face, is greater than 1 millimeter, inclusive. The preceding subject matter of this paragraph characterizes example 45 of the present disclosure, wherein example 45 also includes the subject matter according to example 44, above.

The strike plate is made from a titanium alloy. The preceding subject matter of this paragraph characterizes example 46 of the present disclosure, wherein example 46 also includes the subject matter according to any one of examples 38-45, above.

Additionally disclosed herein is an iron-type golf club head. The iron-type golf club head comprises a body, comprising a heel portion, a sole portion, a toe portion, a top-line portion, a front portion, and a rear portion. The rear portion comprises a rear wall enclosing the rear portion. The iron-type golf club head also comprises a strike plate, coupled to the front portion of the body and comprising a strike face and a back surface opposite the strike face. The iron-type golf club head further comprises an enclosed internal cavity, defined between the back surface of the strike plate and the rear wall of the body. The iron-type golf club head additionally comprises a rear aperture formed in the rear wall. The iron-type golf club head also comprises a stiffening plug, within the internal cavity and compressed between the back surface of the strike plate and the rear wall. The stiffening plug is insertable, through the rear aperture, into the internal cavity. The iron-type golf club head further comprises a rear fascia covering the rear aperture and at least a portion of the rear wall. The iron-type golf club head has coefficient of restitution (COR) change value between −0.015 and +0.008, the COR change value being defined as a difference between a measured COR value of the iron-type golf club head and a calibration plate COR value. The preceding subject matter of this paragraph characterizes example 47 of the present disclosure.

A total area of the rear aperture is at least 200 mm^2. The preceding subject matter of this paragraph characterizes example 48 of the present disclosure, wherein example 48 also includes the subject matter according to example 47, above.

The total area of the rear aperture is at least 300 mm^2. The preceding subject matter of this paragraph characterizes example 49 of the present disclosure, wherein example 49 also includes the subject matter according to example 48, above.

The total area of the rear aperture is at least 400 mm^2. The preceding subject matter of this paragraph characterizes example 50 of the present disclosure, wherein example 50 also includes the subject matter according to any one of examples 47-49, above.

A characteristic time (CT) at a geometric center of the strike face is at least 250 microseconds. The preceding subject matter of this paragraph characterizes example 51 of the present disclosure, wherein example 51 also includes the subject matter according to any one of examples 47-49, above.

The strike plate is made from C300 alloy steel. A maximum thickness of the strike plate, at the strike face, is less than 2.9 millimeters, inclusive. The preceding subject matter of this paragraph characterizes example 52 of the present disclosure, wherein example 52 also includes the subject matter according to any one of examples 47-51, above.

The strike plate is welded to the body. The preceding subject matter of this paragraph characterizes example 53 of the present disclosure, wherein example 53 also includes the subject matter according to example 52, above.

The strike plate, excluding grooves, has a minimum thickness between 1.1 millimeters and 2.2 millimeters. The preceding subject matter of this paragraph characterizes example 54 of the present disclosure, wherein example 54 also includes the subject matter according to example 53, above.

The strike plate, excluding grooves, has a variable thickness. The preceding subject matter of this paragraph characterizes example 55 of the present disclosure, wherein example 55 also includes the subject matter according to any one of examples 52-54, above.

The strike plate, excluding grooves, has a constant thickness. The preceding subject matter of this paragraph characterizes example 56 of the present disclosure, wherein example 56 also includes the subject matter according to any one of examples 52-55, above.

The strike plate is a first steel alloy and the body is a second steel alloy, and the first steel alloy is different than the second steel alloy. The preceding subject matter of this paragraph characterizes example 57 of the present disclosure, wherein example 57 also includes the subject matter according to any one of examples 53-56, above.

The maximum thickness of the strike plate, at the strike face, is greater than 1 millimeter, inclusive. The preceding subject matter of this paragraph characterizes example 58 of the present disclosure, wherein example 58 also includes the subject matter according to any one of examples 52-57, above.

The strike plate is made from 4140 alloy steel. A maximum thickness of the strike plate, at the strike face, is less than 2.9 millimeters, inclusive. The preceding subject matter of this paragraph characterizes example 59 of the present disclosure, wherein example 59 also includes the subject matter according to any one of examples 47-58, above.

The strike plate is welded to the body. The preceding subject matter of this paragraph characterizes example 60 of the present disclosure, wherein example 60 also includes the subject matter according to example 59, above.

The strike plate, excluding grooves, has a minimum thickness between 1.1 millimeters and 2.2 millimeters. The preceding subject matter of this paragraph characterizes example 61 of the present disclosure, wherein example 61 also includes the subject matter according to example 60, above.

The strike plate, excluding grooves, has a variable thickness. The preceding subject matter of this paragraph characterizes example 62 of the present disclosure, wherein example 62 also includes the subject matter according to any one of examples 59-61, above.

The strike plate, excluding grooves, has a constant thickness. The preceding subject matter of this paragraph characterizes example 63 of the present disclosure, wherein example 63 also includes the subject matter according to any one of examples 59-62, above.

The strike plate is a first steel alloy and the body is a second steel alloy, and the first steel alloy is different than the second steel alloy. The preceding subject matter of this paragraph characterizes example 64 of the present disclosure, wherein example 64 also includes the subject matter according to any one of examples 60-63, above.

The maximum thickness of the strike plate, at the strike face, is greater than 1 millimeter, inclusive. The preceding subject matter of this paragraph characterizes example 65 of the present disclosure, wherein example 65 also includes the subject matter according to any one of examples 59-64, above.

The strike plate is made from a titanium alloy and has a maximum thickness less than 3.9 millimeters, inclusive. The preceding subject matter of this paragraph characterizes example 66 of the present disclosure, wherein example 66 also includes the subject matter according to any one of examples 47-65, above.

The strike plate is welded to the body. The preceding subject matter of this paragraph characterizes example 67 of the present disclosure, wherein example 67 also includes the subject matter according to any one of examples 56-66, above.

The strike plate, excluding grooves, has a minimum thickness between 1.5 millimeters and 2.6 millimeters. The preceding subject matter of this paragraph characterizes example 68 of the present disclosure, wherein example 68 also includes the subject matter according to example 67, above.

The strike plate, excluding grooves, has a variable thickness. The preceding subject matter of this paragraph characterizes example 69 of the present disclosure, wherein example 69 also includes the subject matter according to any one of examples 66-68, above.

The strike plate, excluding grooves, has a constant thickness. The preceding subject matter of this paragraph characterizes example 70 of the present disclosure, wherein example 70 also includes the subject matter according to any one of examples 66-69, above.

The strike plate is a first titanium alloy and the body is a second titanium alloy, and the first titanium alloy is different than the second titanium alloy. The preceding subject matter of this paragraph characterizes example 71 of the present disclosure, wherein example 71 also includes the subject matter according to any one of examples 67-70, above.

Also disclosed herein is an iron-type golf club head. The iron-type golf club head comprises a body, comprising a heel portion, a sole portion, a toe portion, a top-line portion, a front portion, and a rear portion. The iron-type golf club head also comprises a strike plate, coupled to the front portion of the body and comprising a strike face and a back surface opposite the strike face. The iron-type golf club head further comprises an internal cavity, defined between the back surface of the strike plate and the body. The internal cavity is enclosed. The iron-type golf club head additionally comprises a filler material having a density between 0.21 g/cc and 0.71 g/cc and filling at least a portion of the internal cavity. the iron-type golf club head has coefficient of restitution (COR) change value between 0.000 and +0.008, the COR change value being defined as a difference between a measured COR value of the iron-type golf club head and a calibration plate COR value. The preceding subject matter of this paragraph characterizes example 72 of the present disclosure.

The iron-type golf club head, without the filler material, has a COR change value no less than +0.009. The preceding subject matter of this paragraph characterizes example 73 of the present disclosure, wherein example 73 also includes the subject matter according to example 72, above.

The filler material reduces the COR of the golf club head by no more than 0.010. The preceding subject matter of this paragraph characterizes example 74 of the present disclosure, wherein example 74 also includes the subject matter according to any one of examples 72-73, above.

The filler material fills at least about 50% of the internal cavity of the golf club head. The preceding subject matter of this paragraph characterizes example 75 of the present disclosure, wherein example 75 also includes the subject matter according to example 74, above.

The strike plate is made from a high strength steel alloy. A maximum thickness of the strike plate, at the strike face, is less than 3.5 millimeters, inclusive. The preceding subject matter of this paragraph characterizes example 76 of the present disclosure, wherein example 76 also includes the subject matter according to example 75, above.

The filler material does not contain glass bubbles or inorganic solids. The preceding subject matter of this paragraph characterizes example 77 of the present disclosure, wherein example 77 also includes the subject matter according to any one of examples 75-76, above.

Further disclosed herein is a method of tuning the characteristic time (CT) of an iron-type golf club head. The method comprises measuring the CT of the iron-type golf club head to obtain a measured CT of the iron-type golf club head. The method also comprises comparing the measured CT of the iron-type golf club head to a target CT. The method further comprises directly coupling a stiffener to the back surface of a strike plate of the iron-type golf club head if the measured CT of the iron-type golf club head does not meet the target CT. The preceding subject matter of this paragraph characterizes example 78 of the present disclosure.

The stiffener comprises a discrete mass of polymeric material. The step of directly coupling the stiffener to the back surface of the strike plate comprises injecting the polymeric material into an internal cavity of the iron-type golf club head. The preceding subject matter of this paragraph characterizes example 79 of the present disclosure, wherein example 79 also includes the subject matter according to example 78, above.

The step of injecting the polymeric material into the internal cavity of the iron-type golf club head comprises injecting a quantity of the polymeric material corresponding with a difference between the measured CT and the target CT. The preceding subject matter of this paragraph characterizes example 80 of the present disclosure, wherein example 80 also includes the subject matter according to example 79, above.

The step of injecting the polymeric material into the internal cavity of the iron-type golf club head comprises injecting the polymeric material through an aperture in a body of the iron-type golf club head. The method further comprises covering the aperture with a cover or plug. The preceding subject matter of this paragraph characterizes example 81 of the present disclosure, wherein example 81 also includes the subject matter according to any one of examples 79-80, above.

The stiffener comprises a plug. The step of directly coupling the stiffener to the back surface of the strike plate comprises compressing the plug between the back surface of the strike plate and a rear wall of the iron-type golf club head. The preceding subject matter of this paragraph characterizes example 82 of the present disclosure, wherein example 82 also includes the subject matter according to any one of examples 78-81, above.

The plug has a hardness corresponding with a difference between the measured CT and the target CT. The preceding subject matter of this paragraph characterizes example 83 of the present disclosure, wherein example 83 also includes the subject matter according to example 82, above.

The plug is a new plug. The CT of the iron-type golf club head is measured with an existing plug compressed between the back surface of the strike plate and the rear wall of the iron-type golf club head. The method further comprises removing the existing plug from iron-type golf club head after measuring the CT of the iron-type golf club head. The step of compressing the new plug between the back surface of the strike plate and the rear wall of the iron-type golf club head comprises replacing the existing plug with the new plug. The new plug is harder than the existing plug when the measured CT is higher than the target CT. The new plug is softer than the existing plug when the measured CT is lower than the target CT. The preceding subject matter of this paragraph characterizes example 84 of the present disclosure, wherein example 84 also includes the subject matter according to example 83, above.

The method further comprises injecting a filler material into an internal cavity of the iron-type golf club head and about the stiffener, wherein the filler material comprises foam. The preceding subject matter of this paragraph characterizes example 85 of the present disclosure, wherein example 85 also includes the subject matter according to any one of examples 78-84, above.

Additionally disclosed herein is a set of at least three iron-type golf clubs, each comprising a head having a loft ranging from 17-degrees to 36-degrees and an indicium corresponding with the loft. The loft of any one of the at least three iron-type golf clubs is different than any other one of the at least three iron-type golf clubs. The indicium of any one of the at least three iron-type golf clubs is different than any other one of the at least three iron-type golf clubs. Each one of the at least three iron-type golf clubs has a coefficient of restitution (COR) change value between 0.000 and +0.008, the COR change value being defined as a difference between a measured COR value of the iron-type golf club and a calibration plate COR value. The preceding subject matter of this paragraph characterizes example 86 of the present disclosure.

Also disclosed herein is an iron-type golf club head. The iron-type golf club head comprises a body, comprising a heel portion, a sole portion, a toe portion, a top-line portion, a front portion, and a rear portion. The rear portion comprises a rear wall enclosing the rear portion. The iron-type golf club head also comprises a strike plate, coupled to the front portion of the body and comprising a strike face and a back surface opposite the strike face. The iron-type golf club head further comprises an enclosed internal cavity, defined between the back surface of the strike plate and the rear wall of the body. The iron-type golf club head additionally comprises a rear aperture formed in the rear wall. The iron-type golf club head also comprises a stiffening plug, within the internal cavity and compressed between the back surface of the strike plate and the rear wall. The stiffening plug is insertable, through the rear aperture, into the internal cavity. The iron-type golf club head further comprises a rear fascia covering the rear aperture and at least a portion of the rear wall. The iron-type golf club head has coefficient of restitution (COR) change value between −0.015 and +0.008, the COR change value being defined as a difference between a measured COR value of the iron-type golf club head and a calibration plate COR value. A characteristic time (CT) at a geometric center of the strike face is at least 250 microseconds. A maximum thickness of the strike plate, at the strike face, is less than 3.5 millimeters, inclusive. The strike plate, excluding grooves, has a minimum thickness between 1.1 millimeters and 2.2 millimeters. The preceding subject matter of this paragraph characterizes example 87 of the present disclosure.

A total area of the rear aperture is at least 200 mm^2. The preceding subject matter of this paragraph characterizes example 88 of the present disclosure, wherein example 88 also includes the subject matter according to example 87, above.

The total area of the rear aperture is at least 300 mm^2. The preceding subject matter of this paragraph characterizes example 89 of the present disclosure, wherein example 89 also includes the subject matter according to any one of examples 87-88, above.

The total area of the rear aperture is at least 400 mm^2. The preceding subject matter of this paragraph characterizes example 90 of the present disclosure, wherein example 90 also includes the subject matter according to any one of examples 87-89, above.

The strike plate is a first steel alloy and the body is a second steel alloy, and the first steel alloy is different than the second steel alloy. The preceding subject matter of this paragraph characterizes example 91 of the present disclosure, wherein example 91 also includes the subject matter according to any one of examples 87-90, above.

The strike plate is welded to the body. The preceding subject matter of this paragraph characterizes example 92 of the present disclosure, wherein example 92 also includes the subject matter according to example 91, above.

The strike plate is made from C300 alloy steel; and a maximum thickness of the strike plate, at the strike face, is less than 2.9 millimeters, inclusive. The preceding subject matter of this paragraph characterizes example 93 of the present disclosure, wherein example 93 also includes the subject matter according to example 92, above.

The strike plate, excluding grooves, has a variable thickness. The preceding subject matter of this paragraph characterizes example 94 of the present disclosure, wherein example 94 also includes the subject matter according to example 93, above.

The strike plate, excluding grooves, has a constant thickness. The preceding subject matter of this paragraph characterizes example 95 of the present disclosure, wherein example 95 also includes the subject matter according to example 93, above.

The strike plate is made from 4140 alloy steel. A maximum thickness of the strike plate, at the strike face, is less than 2.9 millimeters, inclusive. The preceding subject matter of this paragraph characterizes example 96 of the present disclosure, wherein example 96 also includes the subject matter according to any one of examples 92-95, above.

The strike plate, excluding grooves, has a variable thickness. The preceding subject matter of this paragraph characterizes example 97 of the present disclosure, wherein example 97 also includes the subject matter according to example 96, above.

The strike plate, excluding grooves, has a constant thickness. The preceding subject matter of this paragraph characterizes example 98 of the present disclosure, wherein example 98 also includes the subject matter according to example 96, above.

Further disclosed herein is an iron-type golf club head. The iron-type golf club head comprises a body, comprising a heel portion, a sole portion, a toe portion, a top-line portion, a front portion, and a rear portion. The rear portion comprises a rear wall enclosing the rear portion. The iron-type golf club head also comprises a strike plate, coupled to the front portion of the body and comprising a strike face and a back surface opposite the strike face. The iron-type golf club head further comprises an enclosed internal cavity, defined between the back surface of the strike plate and the rear wall of the body. The iron-type golf club head additionally comprises a rear aperture formed in the rear wall. The iron-type golf club head also comprises a stiffening plug, within the internal cavity and compressed between the back surface of the strike plate and the rear wall. The stiffening plug is insertable, through the rear aperture, into the internal cavity. The iron-type golf club head further comprises a rear fascia covering the rear aperture and at least a portion of the rear wall. The iron-type golf club head has coefficient of restitution (COR) change value between −0.015 and +0.008, the COR change value being defined as a difference between a measured COR value of the iron-type golf club head and a calibration plate COR value. A characteristic time (CT) at a geometric center of the strike face is at least 250 microseconds. The strike plate is made from a titanium alloy and a maximum thickness of the strike plate, at the strike face, is less than 3.9 millimeters, inclusive. The strike plate, excluding grooves, has a minimum thickness between 1.5 millimeters and 2.6 millimeters. The preceding subject matter of this paragraph characterizes example 99 of the present disclosure.

The strike plate is welded to the body. The preceding subject matter of this paragraph characterizes example 100 of the present disclosure, wherein example 100 also includes the subject matter according to example 99, above.

The strike plate is a first titanium alloy and the body is a second titanium alloy, and the first titanium alloy is different than the second titanium alloy. The preceding subject matter of this paragraph characterizes example 101 of the present disclosure, wherein example 101 also includes the subject matter according to example 100, above.

Additionally disclosed herein is an iron-type golf club head. The iron-type golf club head comprises a body, comprising a heel portion, a sole portion, a toe portion, a top-line portion, a front portion, and a rear portion. The iron-type golf club head also comprises a strike plate, coupled to the front portion of the body and comprising a strike face and a back surface opposite the strike face. The iron-type golf club head further comprises an internal cavity, defined between the back surface of the strike plate and the body. The internal cavity is enclosed. The iron-type golf club head additionally comprises a filler material having a density between 0.21 g/cc and 0.71 g/cc and filling at least a portion of the internal cavity. The iron-type golf club head has coefficient of restitution (COR) change value between 0.000 and +0.008, the COR change value being defined as a difference between a measured COR value of the iron-type golf club head and a calibration plate COR value. A characteristic time (CT) at a geometric center of the strike face is at least 250 microseconds. The strike plate is made from a metal alloy and a maximum thickness of the strike plate, at the strike face, is less than 3.9 millimeters, inclusive. The strike plate, excluding grooves, has a minimum thickness between 1.1 millimeters and 2.6 millimeters. The preceding subject matter of this paragraph characterizes example 102 of the present disclosure.

The filler material reduces the COR of the golf club head by no more than 0.010. The preceding subject matter of this paragraph characterizes example 103 of the present disclosure, wherein example 103 also includes the subject matter according to example 102, above.

The filler material fills at least about 50% of the internal cavity of the golf club head. The preceding subject matter of this paragraph characterizes example 104 of the present disclosure, wherein example 104 also includes the subject matter according to example 103, above.

The strike plate is made from a high strength steel alloy. A maximum thickness of the strike plate, at the strike face, is less than 2.9 millimeters, inclusive. The preceding subject matter of this paragraph characterizes example 105 of the present disclosure, wherein example 105 also includes the subject matter according to example 104, above.

The filler material does not contain glass bubbles or inorganic solids. The preceding subject matter of this paragraph characterizes example 106 of the present disclosure, wherein example 106 also includes the subject matter according to example 105, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only some embodiments of the subject matter and are not therefore to be considered to be limiting of its scope, the subject matter will be described and explained with additional specificity and detail through the use of the drawings, in which.

DETAILED DESCRIPTION

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

FIGS. 10, 11, 13, 14, and 16-19 are examples that show a club head in the address position i.e. the club head is positioned such that a hosel axis, of the club head, is at a 60 degree lie angle relative to a ground plane and the club face is square relative to an imaginary target line. As shown in FIGS. 13, 14, 16, and 19, positioning a golf club head 100 in the reference position lends itself to using a club head origin coordinate system 185 for making various measurements. Additionally, the USGA methodology may be used to measure the various parameters described throughout this application including head height, club head center of gravity (CG) location, and moments of inertia (MOI) about the various axes.

For further details or clarity, the reader is advised to refer to the measurement methods described in the '946 App and the USGA procedure. Notably, however, the origin and axes used in this application may not necessarily be aligned or oriented in the same manner as those described in the '946 App or the USGA procedure. Further details are provided below on locating the club head origin coordinate system 185.

Figure 1:
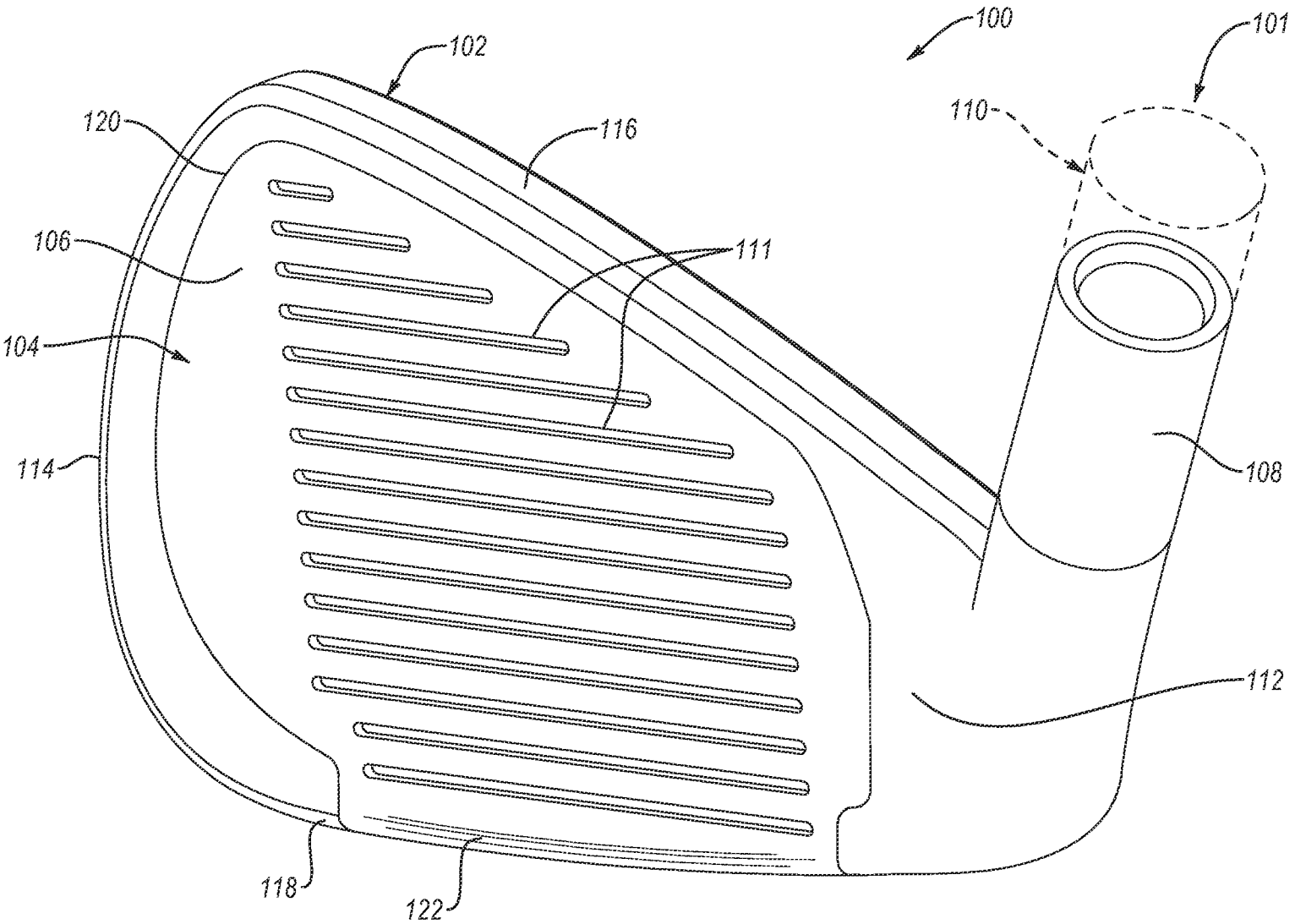
FIG. 1 is a perspective view of an iron-type golf club head, from a front of the golf club head, according to one or more examples of the present disclosure.
Figure 2:
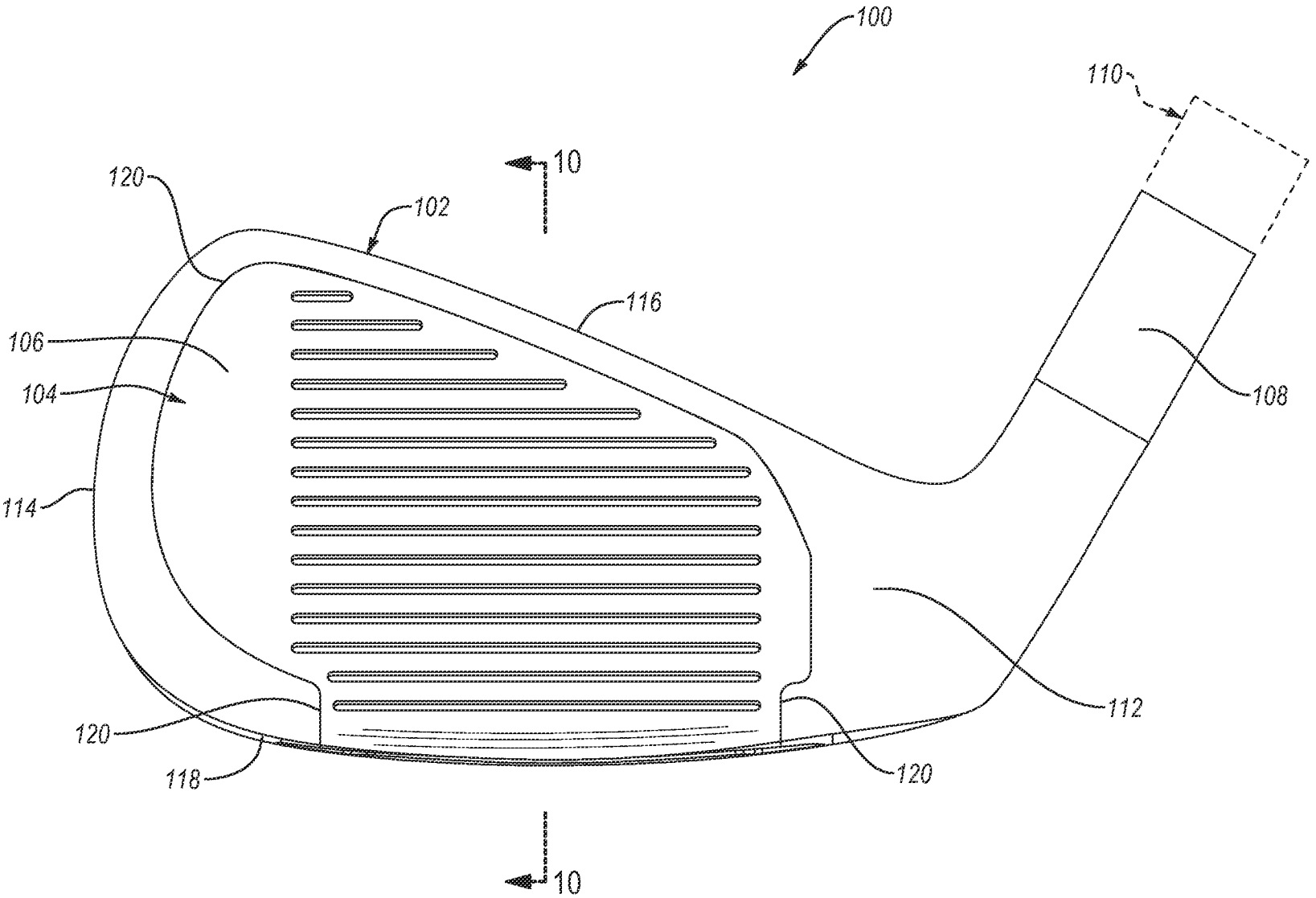
FIG. 2 is a front view of the golf club head of FIG. 1, according to one or more examples of the present disclosure.

Referring to FIGS. 1 and 2, one embodiment of an iron-type golf club head 100 includes a body 102 and a strike plate 104 welded to the body 102. Some features of the golf club head 100 are similar to the features of the iron-type golf club head shown and described in U.S. patent application Ser. No. 15/706,632, filed Sep. 15, 2017, which is incorporated herein in its entirety. The body 102 has a toe portion 114, a heel portion 112, a top portion 116 (e.g., top-line portion), and a sole portion 118 (e.g., bottom portion). The body 102 additionally includes a hosel 108 extending from the heel portion 112. The hosel 108 is configured to receive and engage with a shaft and grip combination 110 of a golf club 101. The shaft extends from the hosel 108 and the grip is secured to the shaft at a location on the shaft opposite that of the golf club head 100. The strike plate 104 includes at least a portion of a strike face 106 designed to impact a golf ball during a normal golf swing. In some implementations, the strike plate 104 includes an entirety of the strike face 106. Generally, the strike plate 104 is defined as any piece of the golf club head 100 that is welded to, or is otherwise formed as part of, a body 102 of the golf club head 100 and includes at least a portion of the strike face 106.

Generally, for many iron-type golf club heads, such as the golf club head 100, the strike face 106 has a planar surface that is angled relative to a ground plane when the golf club head 100 is in an address position to define a loft of the golf club head 100. In other words, the strike face 106 of an iron-type golf club head generally does not include a curved surface. Accordingly, the strike face 106 of the strike plate 104 of the iron-type golf club head 100 is defined as the portion of the strike face 106 with an outwardly facing planar surface. In other words, although a strike plate 104 may include a curved surface, such as an outer surface of a sole wrap portion 122 of the strike plate 104, the strike face 106 does not include or is not defined by such a curved surface. In contrast, the strike face of a metal-wood, driver, or hybrid golf club head does have a curved surface that curves around a substantially upright axis. Because the sole wrap portion 122 wraps around a substantially horizontal axis, the strike face of the strike plate of the metal-wood, driver, and hybrid golf club head is defined as the portion of the strike face 106 with an outwardly facing surface curved about an upright axis, as opposed to a horizontal axis.

The strike plate 104 further includes grooves 111 formed in the strike face 106 to promote desirable flight characteristics (e.g., backspin) of the golf ball upon being impacted by the strike face 106. The grooves 111 are vertically spaced apart from each other and can extend across all or just a portion of the width of strike face 106 at their respective vertical locations on the strike face 106.

Figure 5:
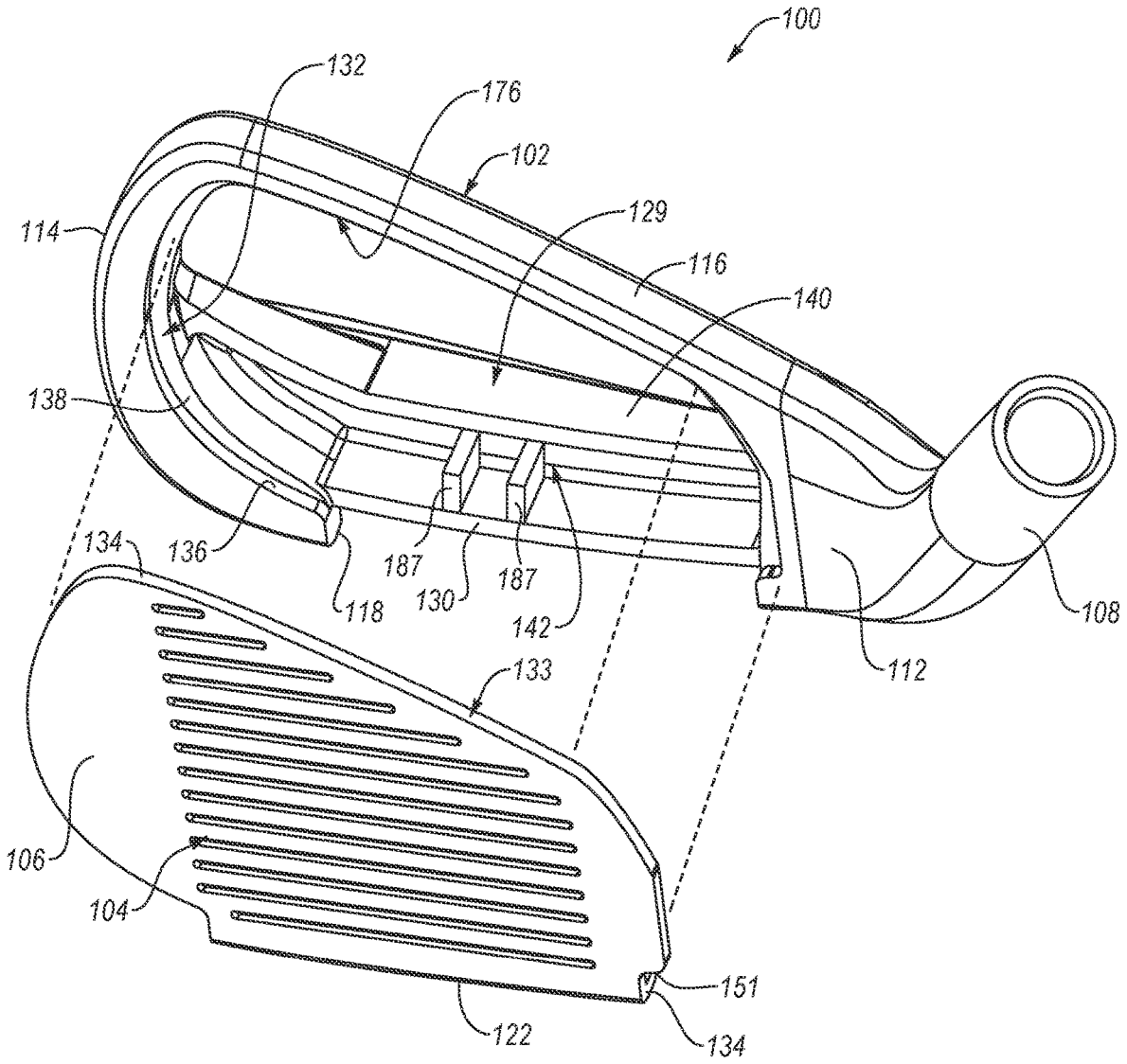
FIG. 5 is an exploded perspective view of the golf club head of FIG. 1, shown with a strike plate removed from a body of the golf club head, according to one or more examples of the present disclosure.

Referring to FIG. 5, in the illustrated embodiment, the strike plate 104 is formed separately from the body 102 and is separately attached to the body 102. The body 102 and the strike plate 104 can be formed using the same type of process or different types of processes. In the illustrated embodiment of FIG. 5, the body 102 is formed to have a one-piece monolithic construction using a first manufacturing process and the strike plate 104 is formed to have a separate one-piece monolithic construction using a second manufacturing process. However, in other embodiments, one or both of the body 102 and the strike plate 104 has a multiple-piece construction with each piece being made from the same or a different material. Additionally, the body 102 can be formed of the same material as or a different material than the strike plate 104. The body 102 is made from a first material and the strike plate 104 is made from a second material. Separately forming and attaching together the body 102 and the strike plate 104 and making the body 102 and the strike plate 104 from the same or different materials, which allows flexibility in the types of manufacturing processes and materials used, promotes the ability to make a golf club head 100 that achieves a wide range of performance, aesthetic, and economic results.

In some implementations, the first manufacturing process is the same type of process as the second manufacturing process. For example, both the first and second manufacturing processes are casting processes in one implementation. As another example, both the first and second manufacturing processes are forging processes in one implementation. According to yet another example, both the first and second manufacturing processes are machining processes in one implementation.

However, in some other implementations, the first manufacturing process is a different type of process than the second manufacturing process. The first manufacturing process is one of a casting process, a machining process, and a forging process and the second manufacturing process is another of a casting process, a machining process, and a forging process in some examples. In one particular example, the first manufacturing process is a casting process and the second manufacturing process is a forging process. The first manufacturing process and/or the second manufacturing process can be a process as described in U.S. Pat. No. 9,044,653, which is incorporated herein in its entirety, such as hot press forging using a progressive series of dies and heat-treatment.

Whether the first and second manufacturing processes are the same or different, the first material of the body 102 can be the same as or different than the second material of the strike plate 104. A first material is different than a second material when the first material has a different composition than the second material. Accordingly, materials from the same family, such as steel, but with different compositional characteristics, such as different carbon constituencies, are considered different materials. In one example, the first and second manufacturing processes are different, but the first and second materials are the same. In contrast, according to another example, the first and second manufacturing processes are the same and the first and second materials are different. According to yet another example, the first and second manufacturing processes are different and the first and second materials are different. In some implementations, the first and second materials are different, but come from the same family of similar materials, such as steel. For example, the first material can be 8620 carbon steel and the second material can be 1025 carbon steel. The first material being within the same family as the second material promotes the quality of the weld between the body 102 and the strike plate 104.

The strike plate 104 can be made from maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the strike plate 104. In other embodiments, the strike plate 104 is a precipitation hardened stainless steel such as 17-4, 15-5, or 17-7. The strike plate 104 is made of C300 steel, in some examples.

The body 102 of the golf club head 100 is made from 17-4 steel in one implementation. However another material, such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

The strike plate 104 and/or the body 102 is made of a titanium alloy in some examples, which can be titanium or any of various titanium-based alloys. In certain examples, the strike plate 104 and/or the body 102 is made of a titanium alloy, including, but not limited to, 9-1-1 titanium, 6-4 titanium, 3-2.5, 6-4, SP700, 15-3-3-3, 10-2-3, or other alpha/near alpha, alpha-beta, and beta/near beta titanium alloys) or mixtures thereof. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation. In certain examples, the titanium alloy is 8-1-1 Ti.

In some examples, the strike plate 104 and/or the body 102 is made of an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" or "ZA1300" titanium alloy). In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative embodiment, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape over time.

In still other embodiments, the body 102 and/or the strike plate 104 of the golf club head 100 are made from fiber-reinforced polymeric composite materials, and are not required to be homogeneous. Examples of composite materials and golf club components comprising composite materials are described in U.S. patent application Ser. No. 13/111,715, filed May 19, 2011, which is incorporated herein by reference in its entirety.

The strike plate 104 is welded to the body 102 via a peripheral weld 120. In the illustrated embodiments, the peripheral weld 120 is peripherally discontinuous because it extends about less than all of the outer periphery of the strike plate 104 such that at least one portion of the outer periphery of the strike plate 104 is not welded to the body 102. In other words, the peripheral weld 120 extends about only a portion of an outer peripheral edge 133 of the strike plate 104. Accordingly, less than 360-degrees of the outer peripheral edge 133 of the strike plate 104 is welded to the body 102. The peripheral weld 120 can be considered a discontinuous weld because it has an ending point that is different than its starting point. However, in some examples, the weld is a continuous weld.

Figure 3:
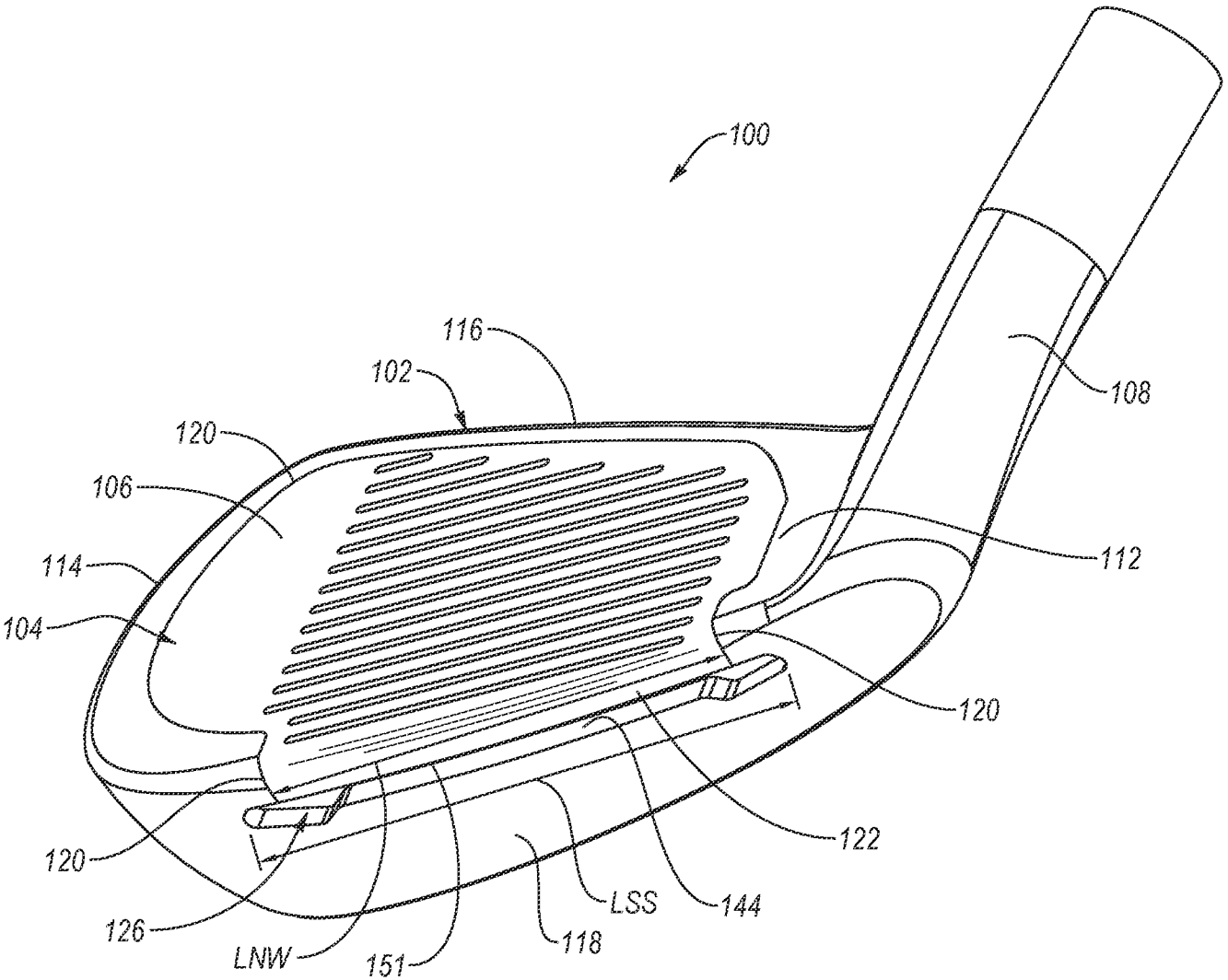
FIG. 3 is perspective view of the golf club head of FIG. 1, from a bottom of the golf club head and shown with a filler material removed from a sole slot, according to one or more examples of the present disclosure.

The portion or portions of the outer periphery of the strike plate 104 not welded to the body 102 promotes an increase in the flexibility of the strike plate 104 relative to the body 102. As shown in FIG. 3, the entirety of the portion of the outer periphery of the strike plate 104 that defines the strike face 106 is welded to the body 102 via the peripheral weld 120. Moreover, the portion of the outer periphery of the strike plate 104 not welded to the body 102 is located along the sole wrap portion 122. More specifically, an outer peripheral edge 133, or perimeter, of the strike plate 104 defined along the sole wrap portion 122 of the strike plate 104 is not welded to the body 102. In the embodiment shown in FIG. 3, not only is the outer peripheral edge 133 of the strike plate 104 not welded to the body 102, but the outer peripheral edge 133 of the strike plate 104 is spaced apart from the body 102 such that a gap is defined between the outer peripheral edge 133 of the strike plate 104 and the body 102.

The gap defines a sole slot 126 of the golf club head 100. Generally, the sole slot 126 is a groove or channel formed in a sole of the golf club head 100. The sole slot 126 is elongate in a lengthwise direction substantially parallel to the strike face 106 and has a length LSS (see, e.g., FIG. 3). As shown in FIGS. 1-10, in some implementations, the sole slot 126 is a through-slot, or a slot that is open on a sole portion side of the sole slot 126 and open on an internal cavity side or interior side of the sole slot 126. However, in other implementations, the sole slot 126 is not a through-slot, but rather is closed on an internal cavity side or interior side of the sole slot 126.

Although in the illustrated embodiments, the golf club head 100 includes a strike plate 104, separately formed from the body 102, that is welded to the body 102, in other embodiments, the entirety of the strike face 106 is co-formed with the body 102 of the golf club head 100. In other words, in certain examples, the entirety of the strike face 106 and the body 102 have a one-piece monolithic construction and are formed together using the same manufacturing process, such as forging or casting. In such examples, portion of the golf club head 100 defining the strike plate 104 is, in effect, integrated into the body 102. Accordingly, as used herein, any reference to strike plate 104 can mean a separately formed strike plate 104 that is welded to the body 102 or a front portion, defining the strike face 106, that is integrated into and forms a one-piece monolithic construction with the body 102. Accordingly, whether the golf club head 100 has a strike plate welded to the body 102 or a strike face 106 co-formed with the body 102, the golf club head 100 can still include all, or most, of the features of the golf club head 100 described herein, including the sole slot 126.

Figure 4:
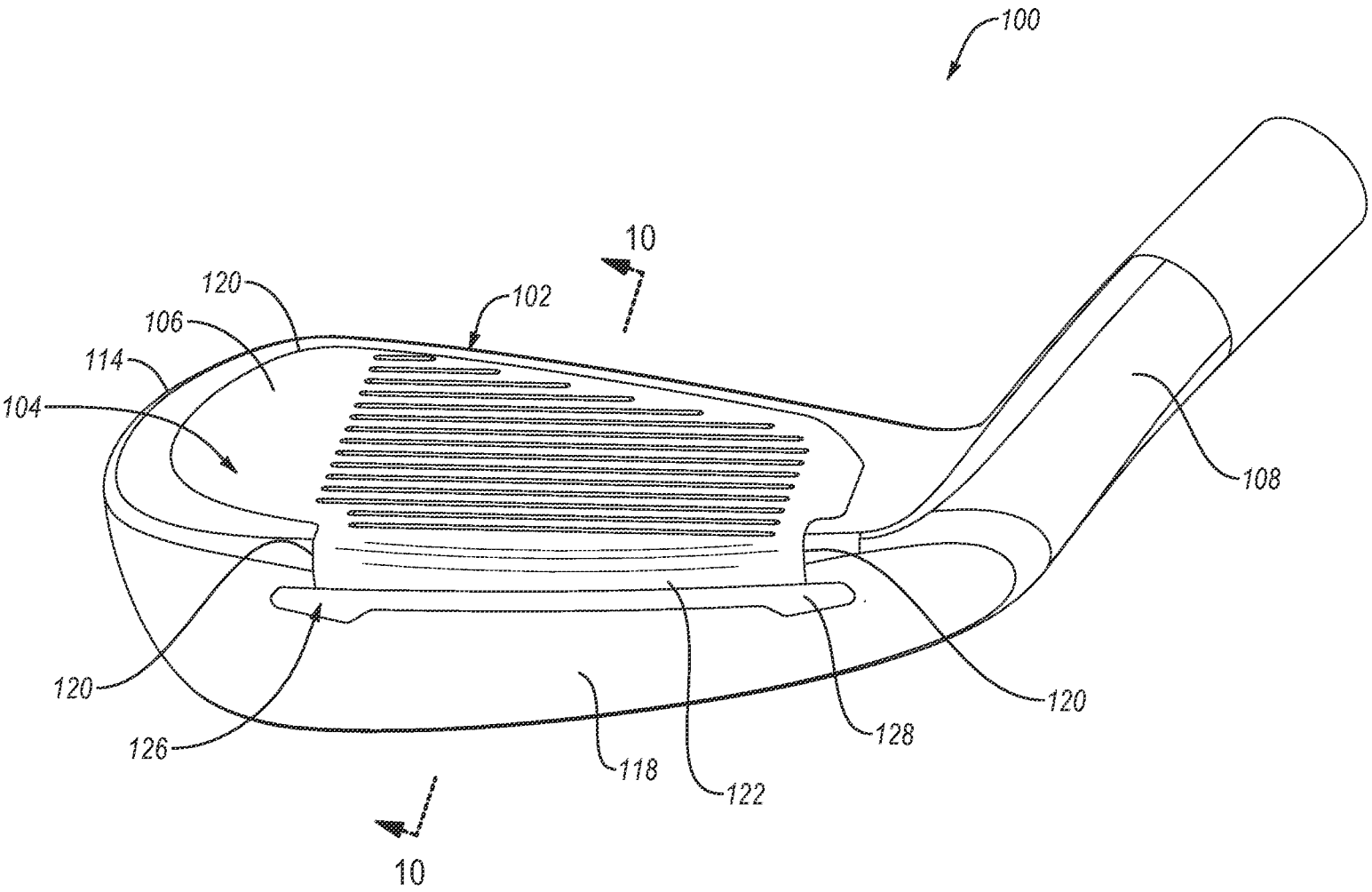
FIG. 4 is a perspective view of an iron-type golf club head, from a bottom of the golf club head and shown with filler material in a sole slot, according to one or more examples of the present disclosure.
Figure 10:
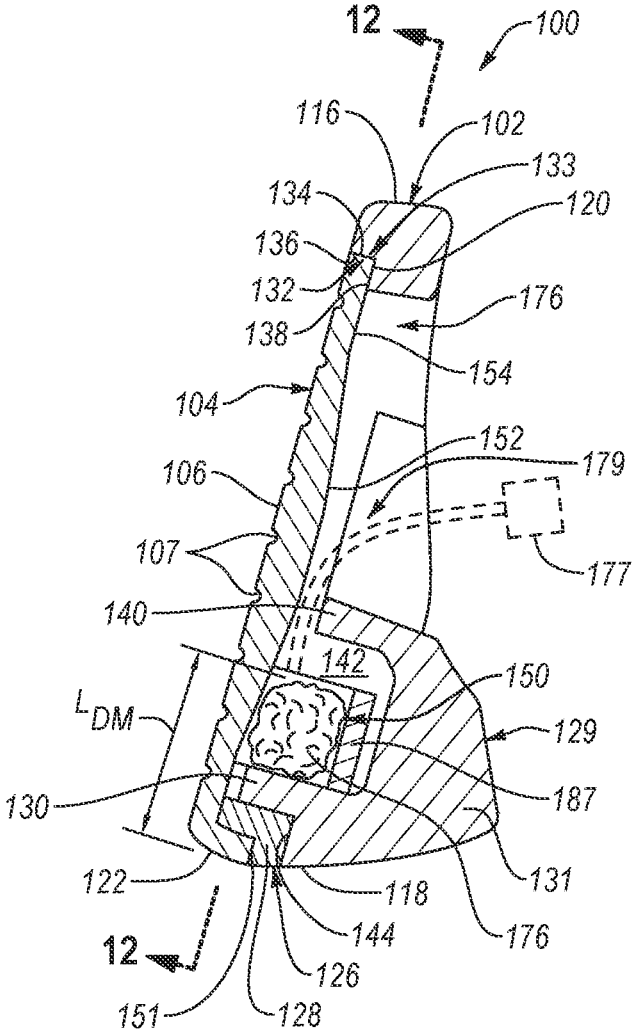
FIG. 10 is cross-sectional side elevation view from a heel side of the golf club head of FIG. 1, taken along the line 10-10 of FIG. 2, according to one or more examples of the present disclosure.

In some implementations, the sole slot 126 is filled with a filler material 128 (see, e.g., FIGS. 4 and 10). The filler material 128 is made from a non-metal, such as a thermoplastic material, thermoset material, and the like, in some implementations. In other implementations, the sole slot 126 is not filled with a filler material 128, but rather maintains an open, vacant, space within the sole slot 126.

According to some embodiments, the filler material 128 is initially a viscous material that is injected or otherwise inserted into the sole slot 126. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some embodiments, a solid filler material may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

Figure 6:
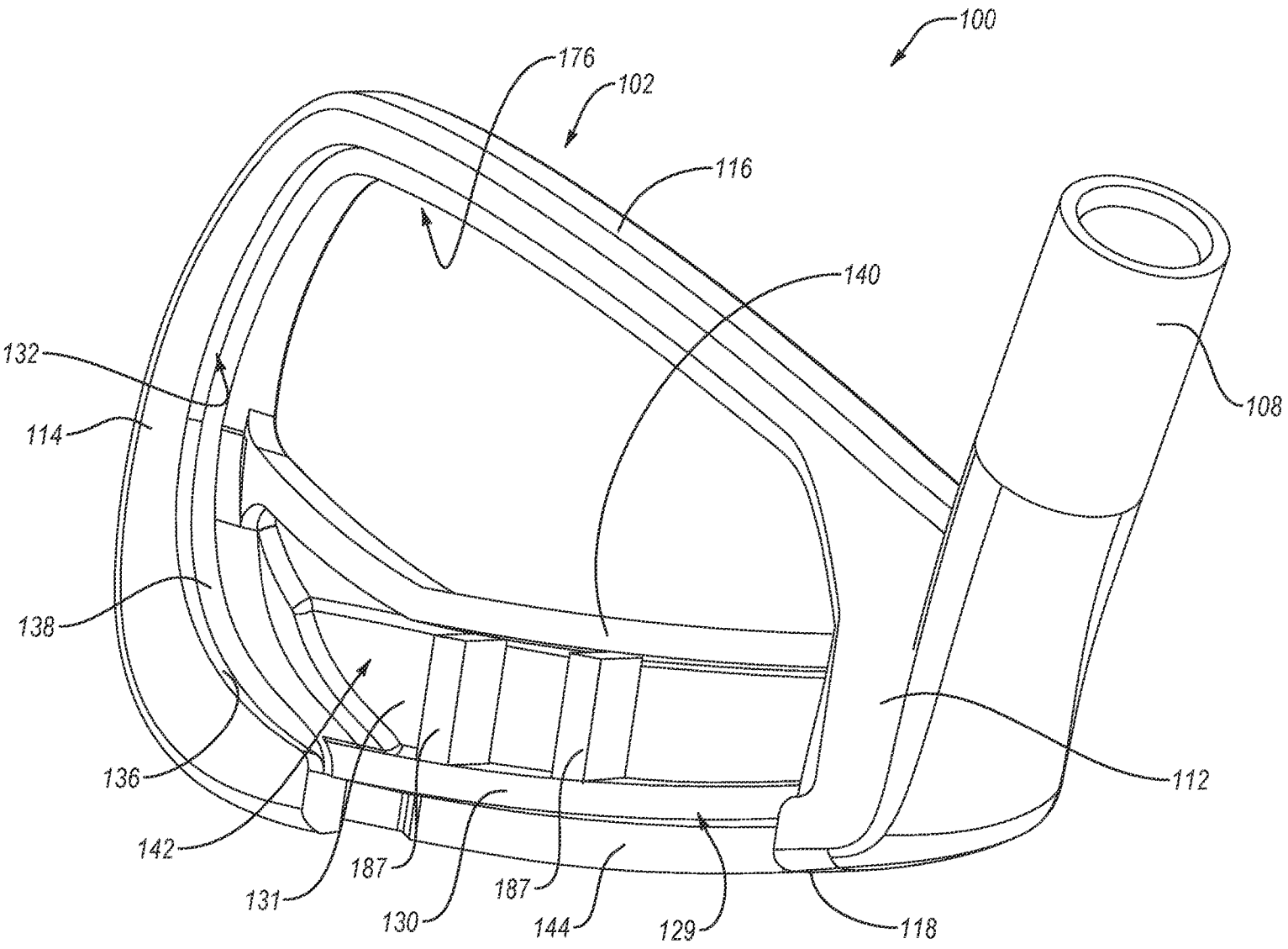
FIG. 6 is a perspective view of the golf club head of FIG. 1, shown with a strike plate of the golf club head removed, according to one or more examples of the present disclosure.

Referring to FIGS. 5 and 6, the body 102 is configured to receive the portions of an outer peripheral edge 133 of the strike plate 104, to be welded to the body 102 via the peripheral weld 120, in seated engagement. More specifically, the body 102 includes a plate opening 176 defined between the toe portion 114, the heel portion 112, the top portion 116, and the sole portion 118 of the body 102. Generally, the plate opening 176 receives the strike plate 104 and helps to secure the strike plate 104 to the body 102. The plate opening 176 extends from a front side of the body 102 to a back side of the body 102. The body 102 additionally includes a plate interface 132 formed in the body 102 along at least a portion of the periphery of the plate opening 176. Generally, the plate interface 132 promotes attachment of the strike plate 104 to the body 102 by supporting the strike plate 104 against the body 102 and promoting the formation of a peripheral weld 120 between the strike plate 104 and the body 102. Accordingly, the plate interface 132 is formed along at least the portion or portions of the periphery of the plate opening 176 that will be welded to the strike plate 104.

In the illustrated embodiment of FIGS. 5 and 6, because the strike plate 104 is not welded to the body 102 at the sole portion 118 of the body 102, the plate interface 132 does not extend along the periphery of the plate opening 176 at the sole portion 118 of the body 102. However, in the illustrated embodiment of FIGS. 5 and 6, because the peripheral weld 120 is formed between the strike plate 104 and the body 102 continuously along the heel portion 112, the toe portion 114, and the top portion 116, the plate interface 132 is formed in and extends continuously along the portions of the periphery of the plate opening 176 at the heel portion 112, the toe portion 114, and the top portion 116. According to other embodiments, such as shown in FIGS. 12, 13, and 16-18, because the peripheral weld does not extend along one or more portions of one or more of the heel portion 112, the toe portion 114, and the top portion 116, although not shown, an plate interface may not be present along corresponding portions of the periphery of the plate opening.

Referring again to FIGS. 5 and 6, the plate interface 132 includes a rim 136 and a ledge 138. The rim 136 defines a surface that faces an interior of the body 102 and the ledge 138 defines a surface that faces the front of the body 102. The rim 136 is transverse relative to the ledge 138.

The rim 136 is sized to be substantially flush against or just off of the outer peripheral edge 133 of the strike plate 104. The fit between the rim 136 of the plate interface 132 and the outer peripheral edge 133 of the strike plate 104 facilitates the butt welding together of the rim 136 of the body 102 and the outer peripheral edge 133 of the strike plate 104 with the peripheral weld 120. In other words, the peripheral weld 120 is located between and welds together the rim 136 of the plate interface 132 and the outer peripheral edge 133 of the strike plate 104. As shown in FIG. 6, the rim 136 may extend beyond the plate interface 132, such as along the sole portion 118 of the body 102, to facilitate welding of the welded portions 134 of the outer peripheral edge 133 located on the sole wrap portion 122.

The peripheral weld 120 is formed using any of various welding techniques, such as those disclosed in U.S. Pat. No. 8,353,785, which is incorporated herein by reference in its entirety. Moreover, the characteristics and type (e.g., bead, groove, fillet, surface, tack, plug, slot, friction, and resistance welds) of the peripheral weld 120 can be that same or analogous to those described in U.S. Pat. No. 8,353,785. For example, in one implementation, the peripheral weld 120 is formed using one or more of a tungsten inert gas (TIG) or metal inert gas (MIG) welding technique. In other implementations, the peripheral weld 120 is formed using one or more of a laser welding technique or a plasma welding technique.

The ledge 138 abuts a back surface of the strike plate 104 to support the strike plate 104 in place on the body 102. Additionally, the ledge 138, being abutted against the strike plate 104, facilitates the transfer of ball-striking loads from the strike plate 104 to the body 102.

Figure 11:
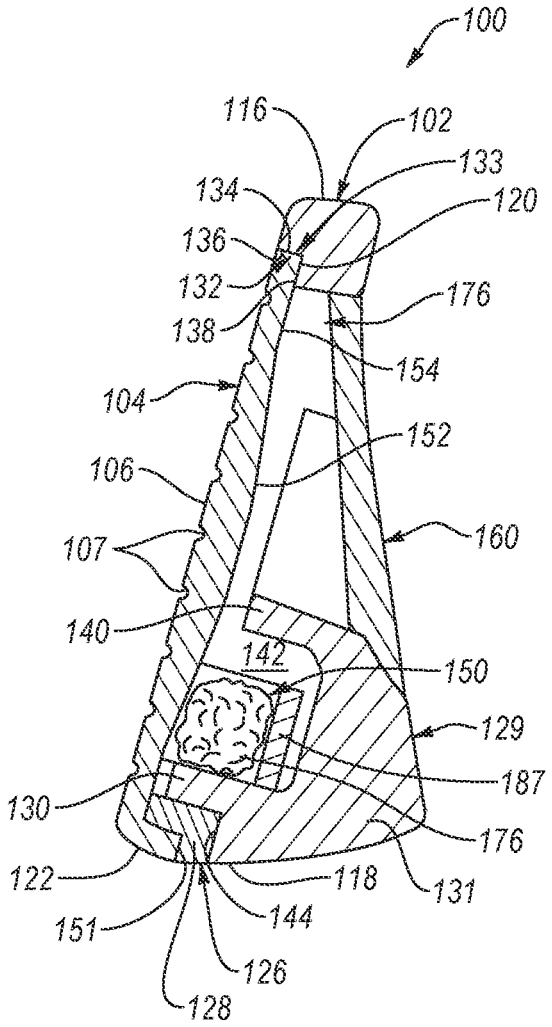
FIG. 11 is a cross-sectional side elevation view of an iron-type golf club head, taken along a line similar to line 10-10 of FIG. 2, according to one or more examples of the present disclosure.
Figure 12:
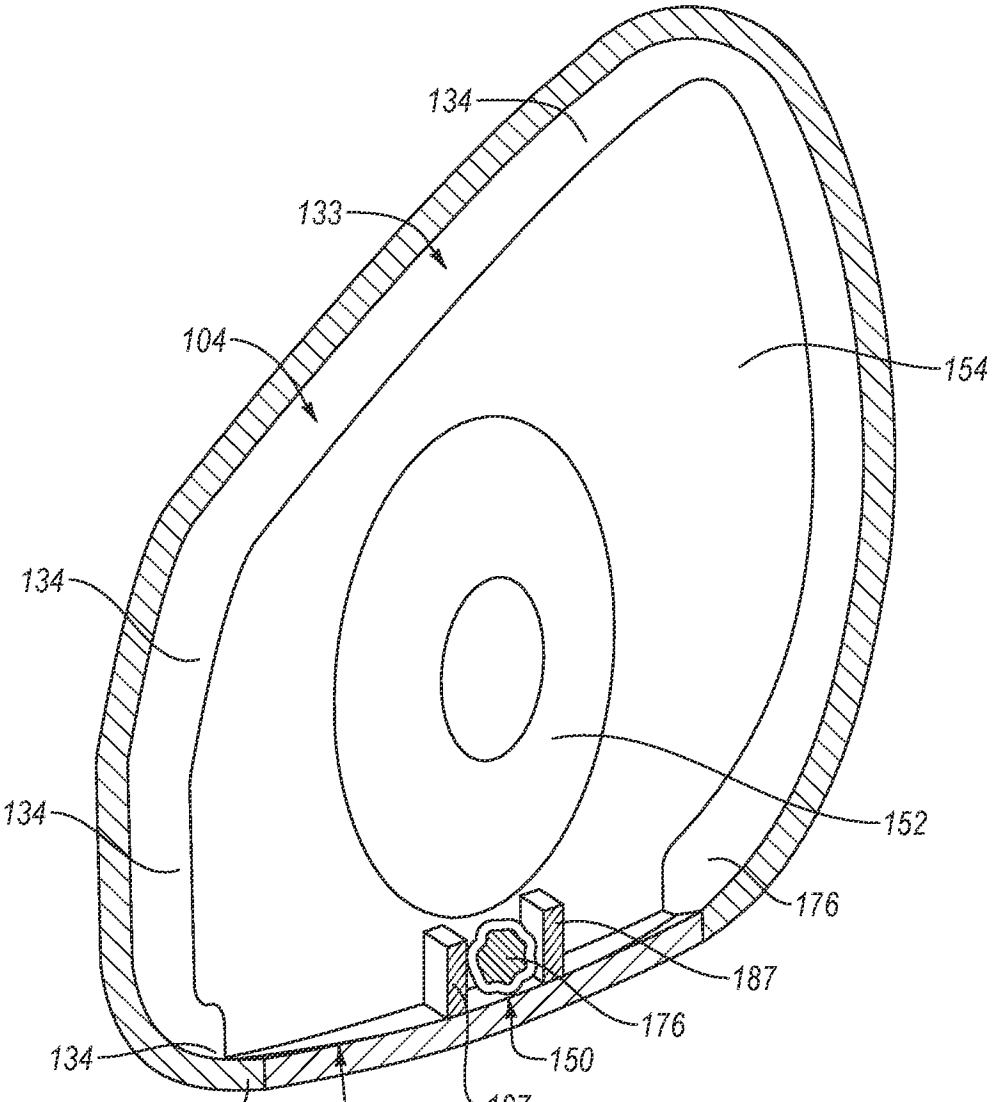
FIG. 12 is a cross-sectional perspective view of the golf club head of FIG. 1, taken along the line 12-12 of FIG. 10, according to one or more examples of the present disclosure.

Referring still to FIGS. 5 and 6, as well as FIGS. 10 and 11, the body 102 further includes a back portion 129 coupled to and extending rearwardly from the sole portion 118. The back portion 129 is also coupled to and extends rearwardly from lower parts of the heel portion 112 and the toe portion 114. The back portion 129 includes a sole bar 131, which is located in a low, rearward portion of the golf club head 100. The sole bar 131 has a relatively large thickness in relation to the strike plate and other portions of the golf club head 100, thereby accounting for a significant portion of the mass of the golf club head 100, and thereby shifting a center of gravity (CG) of the golf club head 100 relatively lower and rearward. The back portion 129 also includes a lower shelf 130 and an upper shelf 140 protruding forwardly of the sole bar 131. The lower shelf 130 and the upper shelf 140 are spaced rearwardly of the strike plate 104 such that a gap is defined between each of the lower shelf 130 and the upper shelf 140 of the back portion 129. Defined between the lower shelf 130 and the upper shelf 140 is a portion of an internal cavity 142, which may extend upwards to the top portion 116. In the illustrated implementation, the internal cavity 142 is open to the sole slot 126. The plate opening 176 is partially open to the back of the body 102. In some examples, the body 102 does not include the upper shelf 140.

Figure 7:
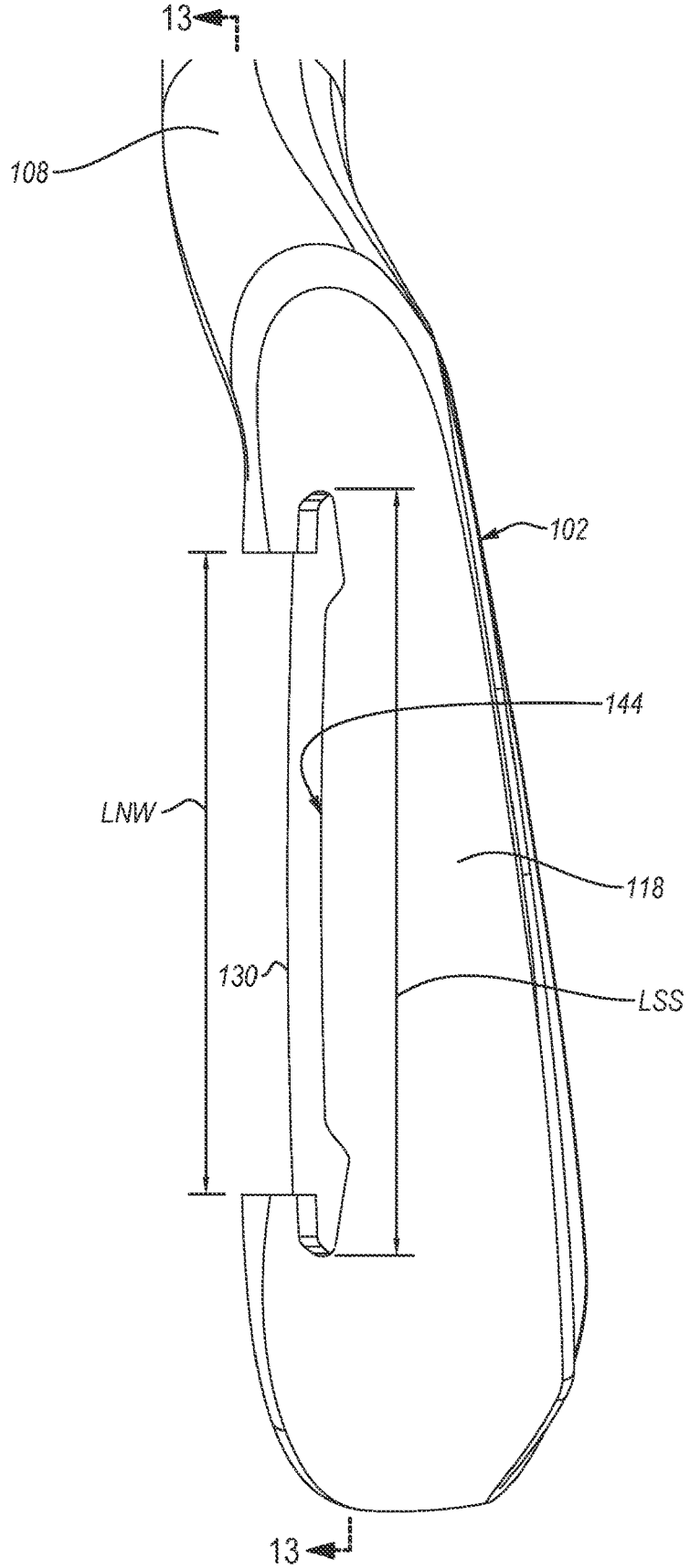
FIG. 7 is a bottom view of the golf club head of FIG. 1, shown with the strike plate removed, according to one or more examples of the present disclosure.

Referring to FIG. 7, a slot edge 144 is formed in the sole portion 118 of the body 102. The slot edge 144 is elongate and extends lengthwise along the sole portion 118 in a direction substantially parallel to the strike face 106. The slot edge 144 is open to or faces the plate opening 176. However, as shown, in some implementations, opposing ends of the slot edge 144 may have a substantially button-hook shape such that opposing end portions of the slot edge 144 face away from the plate opening 176.

Figure 8:
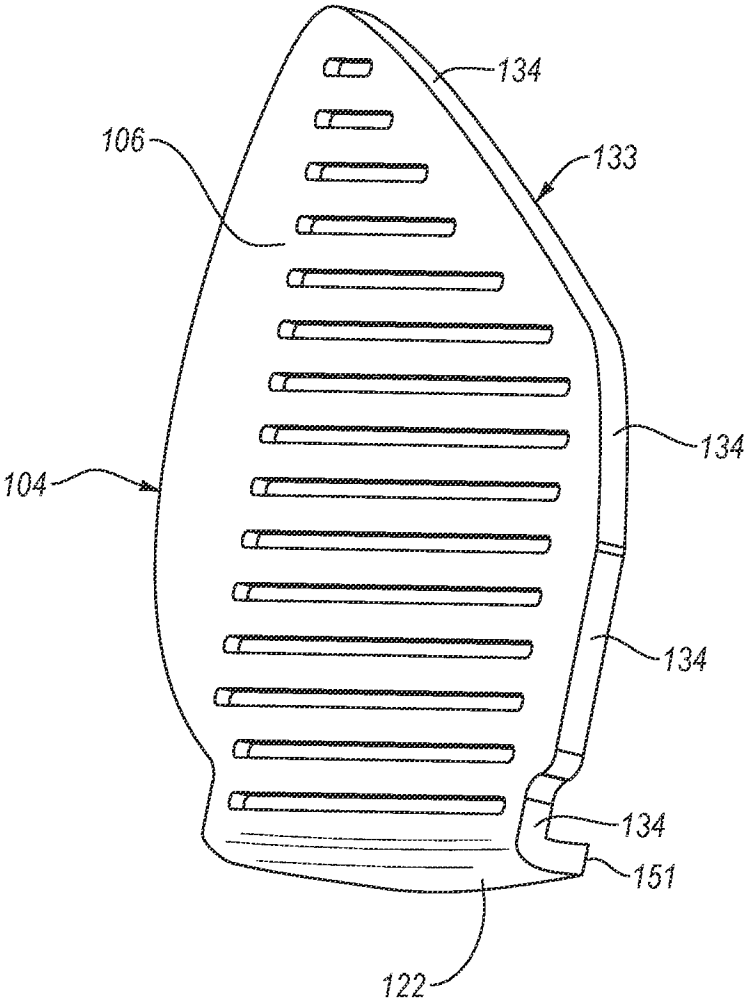
FIG. 8 is a perspective view of a strike plate of the golf club head of FIG. 1, from a front of the strike plate, according to one or more examples of the present disclosure.
Figure 9:
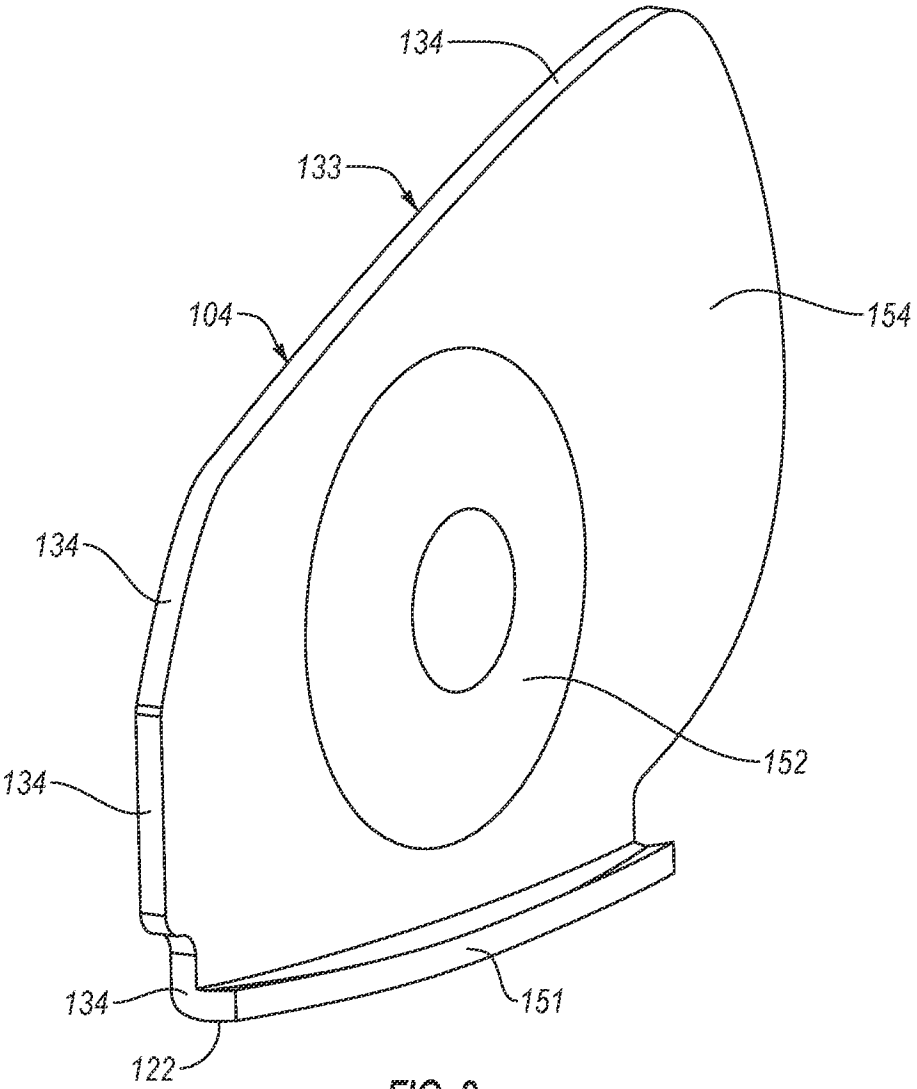
FIG. 9 is a perspective view of the strike plate of the golf club head of FIG. 1, from a back of the strike plate, according to one or more examples of the present disclosure.

Referring to FIGS. 8 and 9, the strike plate 104 has a back surface 154 that opposes the strike face 106. The strike plate 104 includes an inverted cone 152 protruding from the back surface 154. Generally, the inverted cone 152 is aligned with an ideal striking location on the strike face 106. The inverted cone 152 promotes a larger sweet spot for the golf club head 100, which facilitates a reduction in loss of distance on mishits. The outer peripheral edge 133 extends along and defines that outermost periphery of the strike plate 104. The outer peripheral edge 133 of the strike plate 104 includes at least one welded portion 134 and at least one non-welded portion 151. In the illustrated embodiment of FIGS. 8 and 9, the welded portion 134 of the strike plate 104 is a continuous edge that extends from one end of the non-welded portion 151, along the sole wrap portion 122, around the strike face 106, and along an opposite end of the non-welded portion. The non-welded portion 151 extends along an entire length of the sole wrap portion 122 and faces a direction that is substantially perpendicular to that of the welded portion 134.

In other examples, the strike plate 104 of the golf club head 100 includes variable thickness face portion features, in addition to or other than the inverted cone 152. In one example, the variable thickness face portion features of the strike plate 104 further include a plurality of thickness zones that are circumferentially spaced about the inverted cone or the center face of the strike face 106. Each one of the thickness zones extends radially outwardly away from the inverted cone or center face toward an outer periphery of the strike face 106. In some implementations, one or more of the thickness zones terminate before the outer periphery of the strike plate 104 and/or one or more of the thickness zones extends all the way to the outer periphery of the strike plate 104. Moreover, each one of the thickness zones defines a portion of the strike plate 104 with a constant thickness. In other words, the thickness of the strike plate 104 within a given one of the thickness zones is the same or does not vary. However, the thickness of the strike plate 104 within one thickness zone is different than that of an adjacent thickness zone. In this manner, the thickness of the strike plate 104 varies from one thickness zone to the next in a circumferential direction around the inverted cone or center face.

According to one example, the plurality of thickness zones includes a plurality of elevated thickness zones and a plurality of reduced thickness zones. Each one of the elevated thickness zones has a thickness that is greater than each one of the elevated thickness zones. In some implementations, the thickness of each one of the reduced thickness zones is greater than a minimum thickness of the strike plate 104. The plurality of elevated thickness zones and the plurality of reduced thickness zones alternate between elevated thickness zone and reduced thickness zone about the inverted cone 152 or center face.

Figure 21:
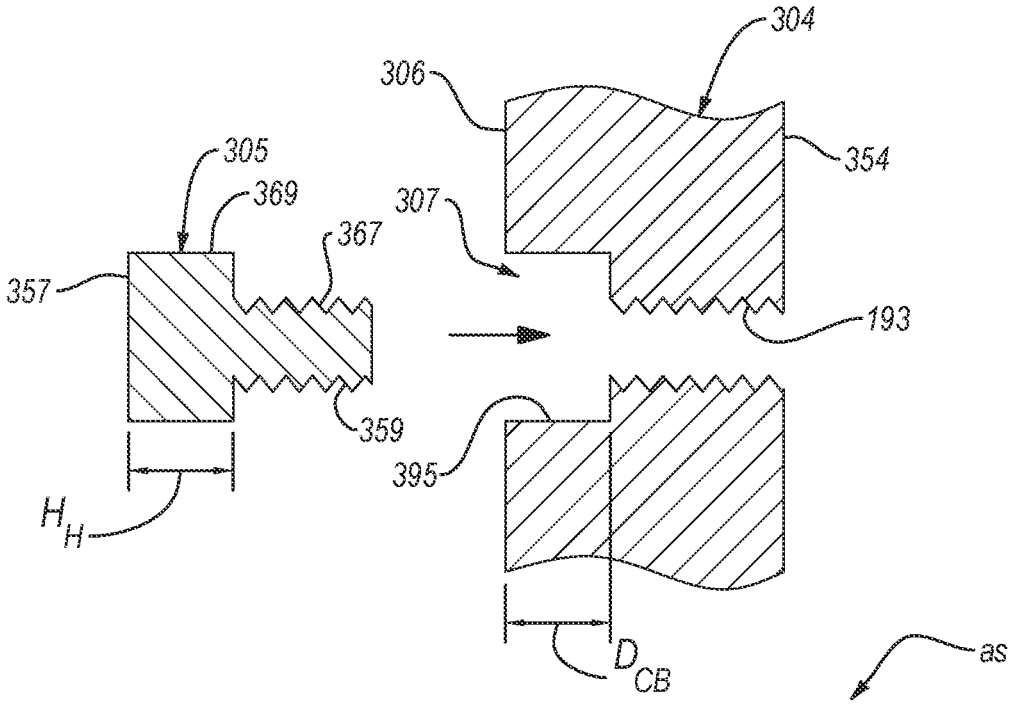
FIG. 21 is an exploded cross-sectional side view of a strike plate of an iron-type golf club head, according to one or more examples of the present disclosure.

The thickness of the general portions of the golf club head 100 can correspond with the thicknesses of the corresponding portions of the golf club head 200 in FIG. 21 of U.S. patent application Ser. No. 16/525,284. For example, the strike plate 104 has a maximum thickness (e.g., Tfacemax) and a minimum thickness (e.g., Tfacemin), excluding grooves. The maximum thickness of the strike plate 104 is less than 3.5 mm, inclusive (e.g., or equal to), in some examples, and the minimum thickness of the strike plate 104 is between 1.1 mm and 2.2 mm, inclusive, in some examples. In some examples, the maximum thickness of the strike plate 104 is less than 2.9 mm, inclusive. According to one example, the maximum thickness of the strike plate 104 is less than 3.9 mm, inclusive, and the minimum thickness of the strike plate 104 is between 1.5 mm and 2.6 mm, inclusive. According to certain examples, the maximum thickness of the strike plate 104 is less than 3.9 mm, inclusive, and the minimum thickness of the strike plate 104 is between 1.1 mm and 2.6 mm, inclusive Referring now to FIG. 10, the sole wrap portion 122 effectively wraps around the sole portion 118 of the body 102 to define a portion of the bottom of the golf club head 100. Accordingly, the sole wrap portion 122 is angled relative to the strike face 106. In the illustrated embodiment of FIG. 10, the sole wrap portion 122 also effectively wraps around the lower shelf 130 of the back portion 129. The non-welded portion 151 of the outer peripheral edge 133 of the strike plate 104 faces the slot edge 144 of the body 102. In one implementation, the non-welded portion 151 is parallel to the slot edge 144 and has a length LNW (see, e.g., FIG. 3). The gap defined between the non-welded portion 151 of the outer peripheral edge 133 and the slot edge 144 defines the sole slot 126 of the golf club head 100. Accordingly, the non-welded portion 151 defines a forward slot wall of the sole slot 126 and the slot edge 144 defines a rearward slot wall of the sole slot 126. There is no weld between the non-welded portion 151 of the outer peripheral edge 133 of the strike plate 104 and the slot edge 144. In contrast, there is a weld between the welded portion 134 of the outer peripheral edge 133 of the strike plate 104 and the rim 136 of the body 102.

To effectively plug the sole slot 126, and prevent debris (e.g., water, grass, dirt, etc.) from entering the internal cavity 142, the filler material 128 is located within the slot 126. The filler material 128 may also help to achieve other desired performance objectives, including desired changes to the sound and feel of the club head by damping vibrations that occur when the club head strikes a golf ball. Because the filler material 128 does not fuse with either the body 102 or the strike plate 104, the filler material 128 is not considered a weld. Moreover, because the filler material 128 is considerably weaker than either the body 102 or the strike plate 104, the filler material 128 is not considered a weld. Additionally, because the filler material 128 is a non-metal, it is not considered a weld.

According to some embodiments, a total peripheral length of the outer peripheral edge 133 of the strike plate 104 of the golf club head 100 is between about 185 mm and about 220 mm or between about 209 mm and about 214 mm. In some embodiments, a height of the heel portion 112 of the body 102 is between about 25 mm and about 27 mm. In certain embodiments, a height of the toe portion 114 of the body 102 is between about 50 mm and about 52 mm. In yet some embodiments, a length of the sole portion 118 of the body 102 is between about 58 mm and about 64 mm. According to some embodiments, a total length of the body 102 is between about 53 mm and about 65 mm. In certain embodiments, a width of the sole portion 118 at the heel of the golf club head 100 is between about 10 mm and about 12 mm.

The strike plate 104, and variable thickness face portion features, disclosed herein can be formed as a result of a casting process and optional post-casting modifications to the face portions. Accordingly, the strike plate 104 can have a great variety of novel thickness profiles. By casting the strike plate 104 into a desired geometry, rather than forming the face plate from a flat rolled sheet of metal in a traditional process, the face can be created with greater variety of geometries and can have different material properties, such as different grain direction and chemical impurity content, which can provide advantages for a golf performance and manufacturing.

In a traditional process, the strike plate 104 is formed from a flat sheet of metal having a uniform thickness. Such a sheet of metal is typically rolled along one axis to reduce the thickness to a certain uniform thickness across the sheet. This rolling process can impart a grain direction in the sheet that creates a different material properties in the rolling axis direction compared to the direction perpendicular to the rolling direction. This variation in material properties can be undesirable and can be avoided by using the disclosed casting methods instead to create face portion.

Furthermore, because a conventional strike plate starts off as a flat sheet of uniform thickness, the thickness of the whole sheet has to be at least as great as the maximum thickness of the desired end product face plate, meaning much of the starting sheet material has to be removed and wasted, increasing material cost. By contrast, in the disclosed casting methods, the strike plate is initially formed much closer to the final shape and mass, and much less material has to be removed and wasted. This saves time and cost. Conventional processes, such as starting from a sheet of metal having a uniform thickness, include mounting the sheet in a lathe or similar machine and turning the sheet to produce a variable thickness profile across the rear of the face plate. In such a turning process, the imparted thickness profile must be symmetrical about the central turning axis, which limits the thickness profile to a composition of concentric circular ring shapes each having a uniform thickness at any given radius from the center point. In contrast, no such limitations are imposed using the disclosed casting methods, and more complex strike plate geometries can be created.

Variable thickness face portion features, as described above, can help provide a desirable CT profile across the face. For example, thickening the heel side of the strike plate 104 can help avoid having CT spikes at the heel side of the face. Similarly, in some examples, thickening the toe side of the strike plate 104 can help avoid CT spikes at the toe side of the face. In other examples, thickening the upper side of the face and/or the bottom side of the face can help avoid CT spikes at corresponding locations on the face.

According to some examples of the golf club head 100, as shown in FIG. 11, the body 102 of the golf club head 100 has a cavity-back configuration and the golf club head 100 further includes a rear fascia 160, or rear plate or badge, coupled to the back portion 129 of the body 102. The rear fascia 160 encloses the internal cavity 142 by covering, at the back portion 129 of the body 102, the plate opening 176. Accordingly, the rear fascia 160, in effect, converts the cavity-back configuration of the golf club head 100 into more of a hollow-body configuration. As will be explained in more detail, enclosing the internal cavity 142 with the rear fascia 160 allows a filler material 201 to retainably occupy at least a portion of the internal cavity 142 (see, e.g., FIG. 19). In some examples, the filler material 201 does not contain glass bubbles or inorganic solids.

The rear fascia 160 is made from one or more of the polymeric materials described herein, in some examples, and adhered or bonded to the body 102. In other examples, the rear fascia 160 is made from one or more of the metallic materials described herein and adhered, bonded, or welded to the body 102. The rear fascia 160 can have a density ranging from about 0.9 g/cc to about 5 g/cc. Moreover, the rear fascia 160 may be a plastic, a carbon fiber composite material, a titanium alloy, or an aluminum alloy. In certain embodiments, where the rear fascia 160 is made of aluminum, the rear fascia 160 may be anodized to have various colors such as red, blue, yellow, or purple.

The golf club head 100 disclosed herein may have an external head volume equal to the volumetric displacement of the golf club head 100. For example, the golf club head 100 of the present application can be configured to have a head volume between about 15 $cm^3$ and about 150 $cm^3$. In more particular embodiments, the head volume may be between about 30 $cm^3$ and about 90 $cm^3$. In yet more specific embodiments, the head volume may be between about 30 $cm^3$ and about 70 $cm^3$, between about 30 $cm^3$ and about 55 $cm^3$, between about 45 $cm^3$ and about 100 $cm^3$, between about 55 $cm^3$ and about 95 $cm^3$, or between about 70 $cm^3$ and about 95 $cm^3$. The golf club head 100 may have a total mass between about 230 g and about 300 g.

In some embodiments, the volume of the internal cavity is between about 1 $cm^3$ and about 50 $cm^3$, between about 5 $cm^3$ and about 30 $cm^3$, or between about 8 cc and about 20 cc. For the purposes of measuring the internal cavity volume herein, the aperture is assumed to be removed and an imaginary continuous wall or substantially back wall is utilized to calculate the internal cavity volume.

In some embodiments, the mass of the filler material 201 divided by the external head volume is between about 0.08 $g/cm^3$ and about 0.23 $g/cm^3$, between about 0.11 $g/cm^3$ and about 0.19 $g/cm^3$, or between about 0.12 $g/cm^3$ and about 0.16 $g/cm^3$ For example, in some embodiments, the mass of the filler material 201 may be about 5.5 grams and the external head volume may be about 50 $cm^3$ resulting in a ratio of about 0.11 $g/cm^3$.

Figure 15:
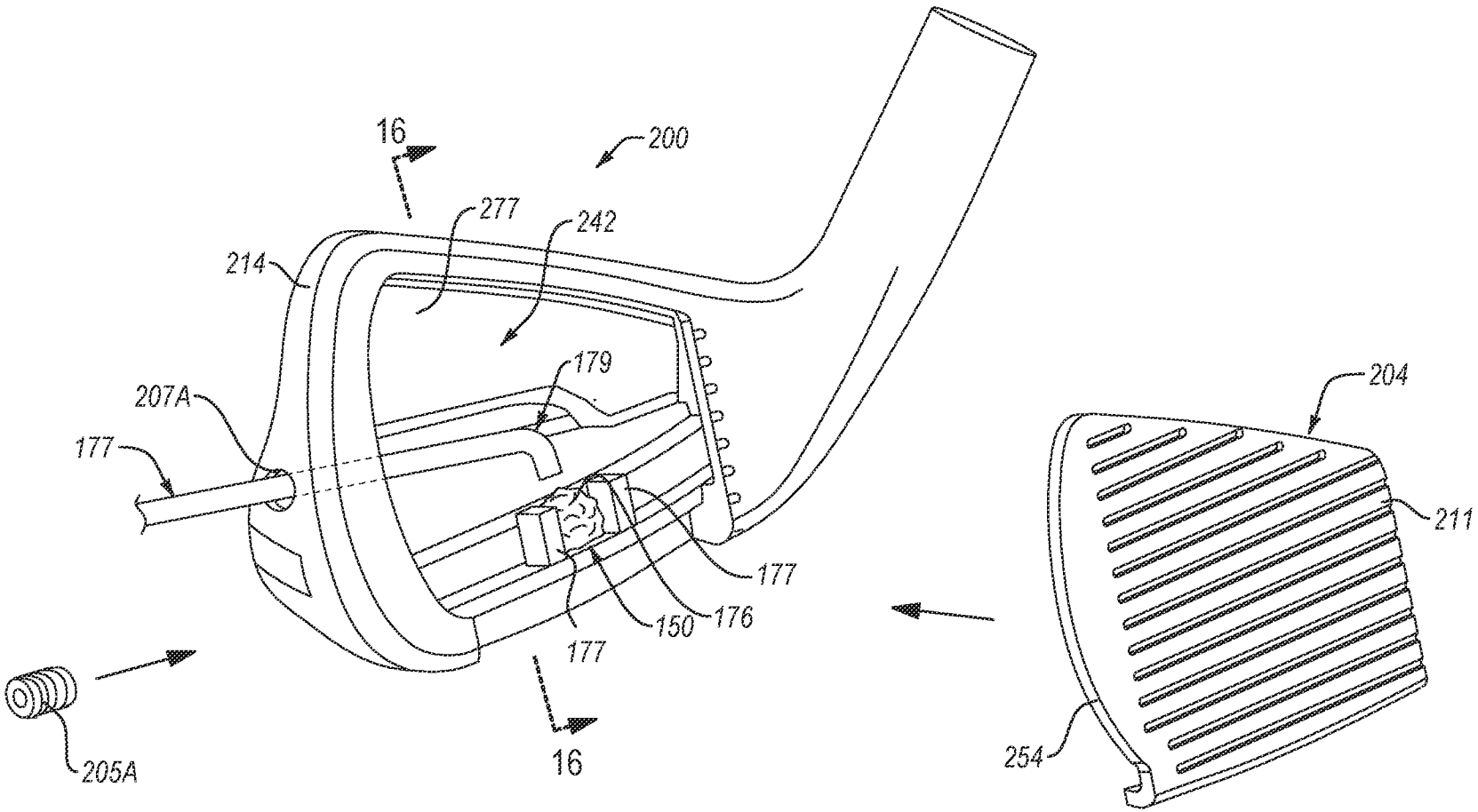
FIG. 15 is an exploded perspective view of an iron-type golf club head, according to one or more examples of the present disclosure.
Figure 16:
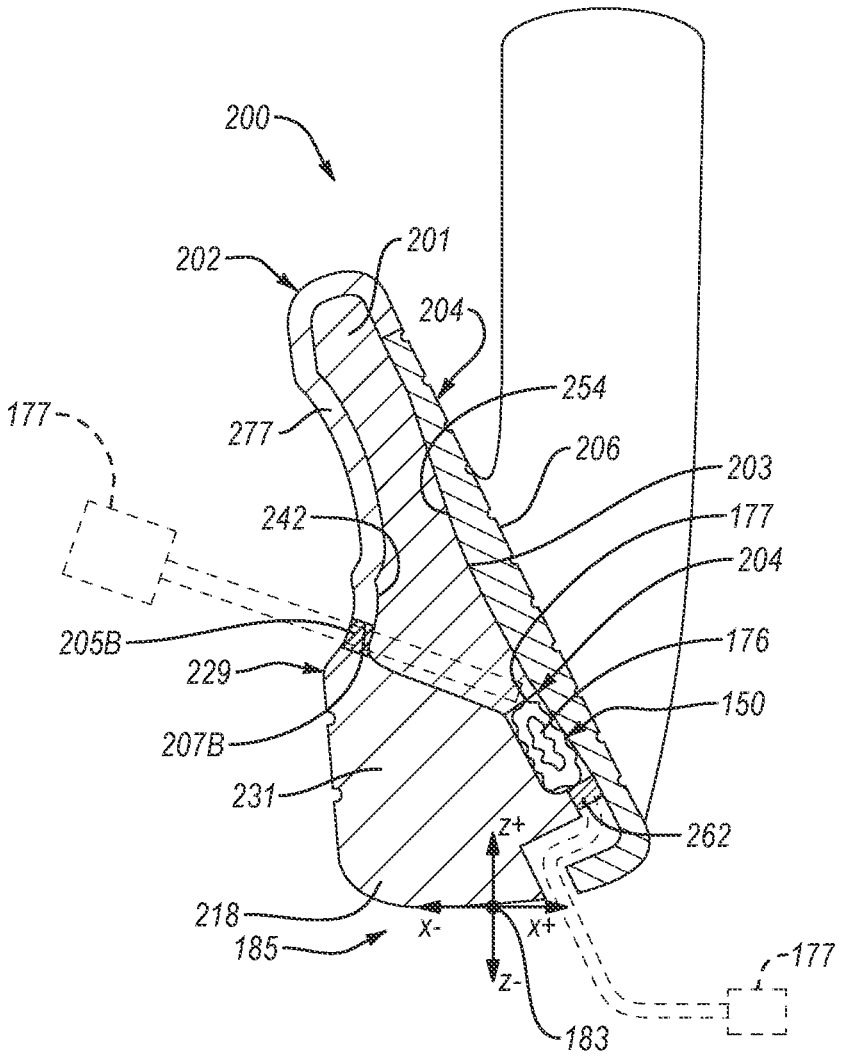
FIG. 16 is a cross-sectional side view of an iron-type golf club head, taken along a line similar to the line 16-16 of FIG. 15, according to one or more examples of the present disclosure
Figure 18:
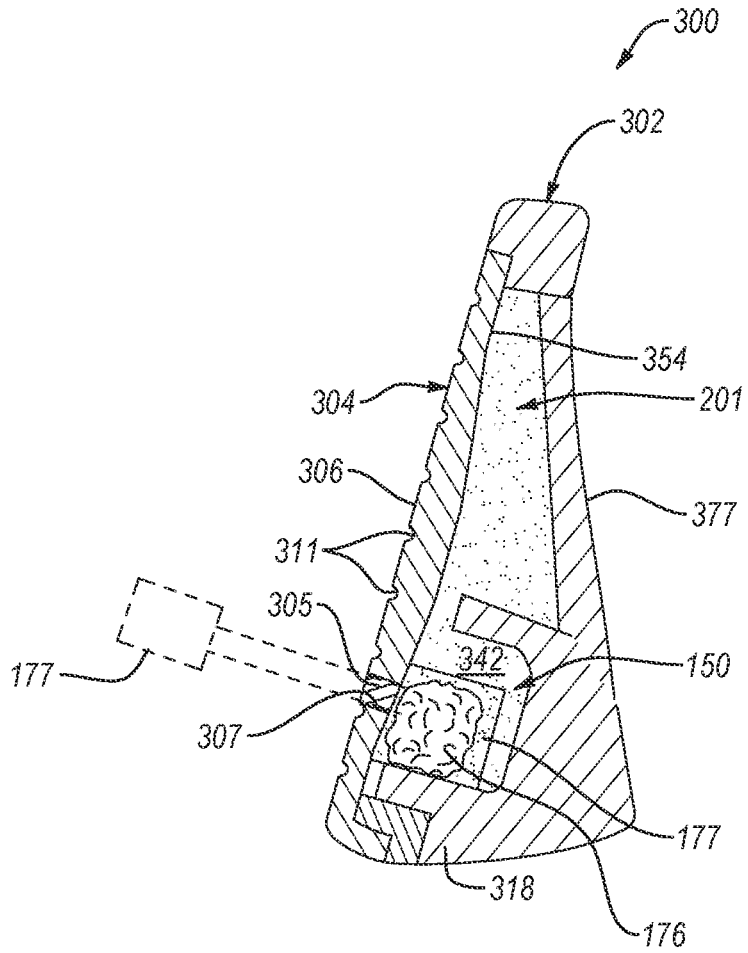
FIG. 18 is a cross-sectional side elevation view of an iron-type golf club head, taken along a line similar to line 10-10 of FIG. 2, according to one or more examples of the present disclosure.

As opposed to the golf club head 100 of FIGS. 1-10, which illustrates a cavity-back or muscle-back type golf club head, the golf club head 200 of FIGS. 15, 16, and 18 is a hollow-cavity-type golf club head. More specifically, while the internal cavity 142 and the back surface 154 of the strike plate 104 of the golf club head 100 are not enclosed, but rather are open to a rear of the golf club head 100 (or enclosed by a separately attachable rear fascia), the internal cavity 242 and the back surface 254 of the strike plate 204 of the golf club head 200 of FIGS. 15, 16, and 18 are enclosed or closed to a rear of the golf club head 200 by an integrated rear wall 277. In other words, the back portion 229 of the golf club head 200 further includes a rear wall 277 that encloses a rearward side of the internal cavity 242. The golf club head 200 having a hollow internal cavity 242 provides several advantages, such as an increased forgiveness for off-center hits on the strike face 206 of the strike plate 204.

The golf club head 200 also includes a sole slot 226 and filler material 128 in the sole slot 226. Additionally, the strike plate 204 includes grooves 211 in the strike face 206.

In some embodiments, the volume of the golf club head 200 is between about 10 $cm^3$ and about 120 $cm^3$. For example, in some embodiments, the golf club head 200 has a volume between about 20 $cm^3$ and about 110 $cm^3$, such as between about 30 $cm^3$ and about 100 $cm^3$, such as between about 40 $cm^3$ and about 90 $cm^3$, such as between about 50 $cm^3$ and about 80 $cm^3$, and such as between about 60 $cm^3$ and about 80 $cm^3$. In addition, in some embodiments, the golf club head 800 has an overall depth that is between about 15 mm and about 100 mm. For example, in some embodiments, the golf club head 200 has an overall depth between about 20 mm and about 90 mm, such as between about 30 mm and about 80 mm and such as between about 40 mm and about 70 mm.

In some implementations, the golf club head 200 includes a weight or weighted elements, such as a tungsten plug, located at least partially within the internal cavity 242 in some implementations. Additionally, the body of the golf club heads of the present disclosure can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

Figure 17:
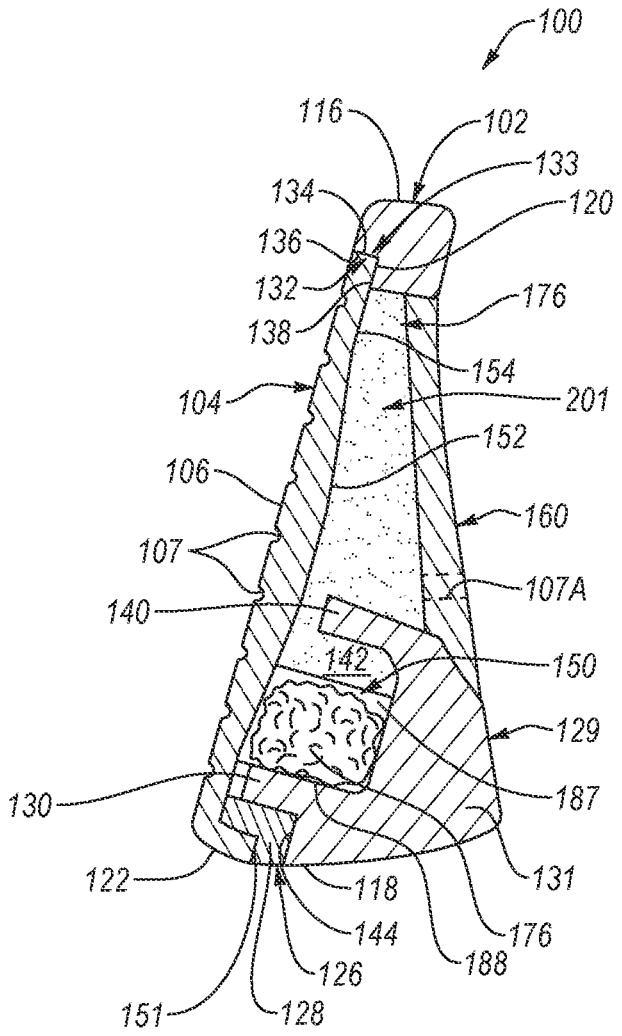
FIG. 17 is a cross-sectional side elevation view of an iron-type golf club head, taken along a line similar to line 10-10 of FIG. 2, according to one or more examples of the present disclosure.

In some embodiments, the golf club head 100 of FIG. 17 has an internal cavity 142 and the golf club head 200 of FIGS. 15, 16, and 18 has an internal cavity 242 that is partially or entirely filled with a filler material 201. According to one example, the filler material 201 surrounds a portion of the polymeric material and occupies about 50% to about 99% of the internal cavity of the golf club head. In some implementations, the filler material 201 is made from a non-metal, such as a thermoplastic material, thermoset material, and the like, in some implementations. In other implementations, the internal cavity 142 or the internal cavity 242 is not filled with a filler material 201, but rather maintains an open, vacant, cavity within the club head.

Figure 13:
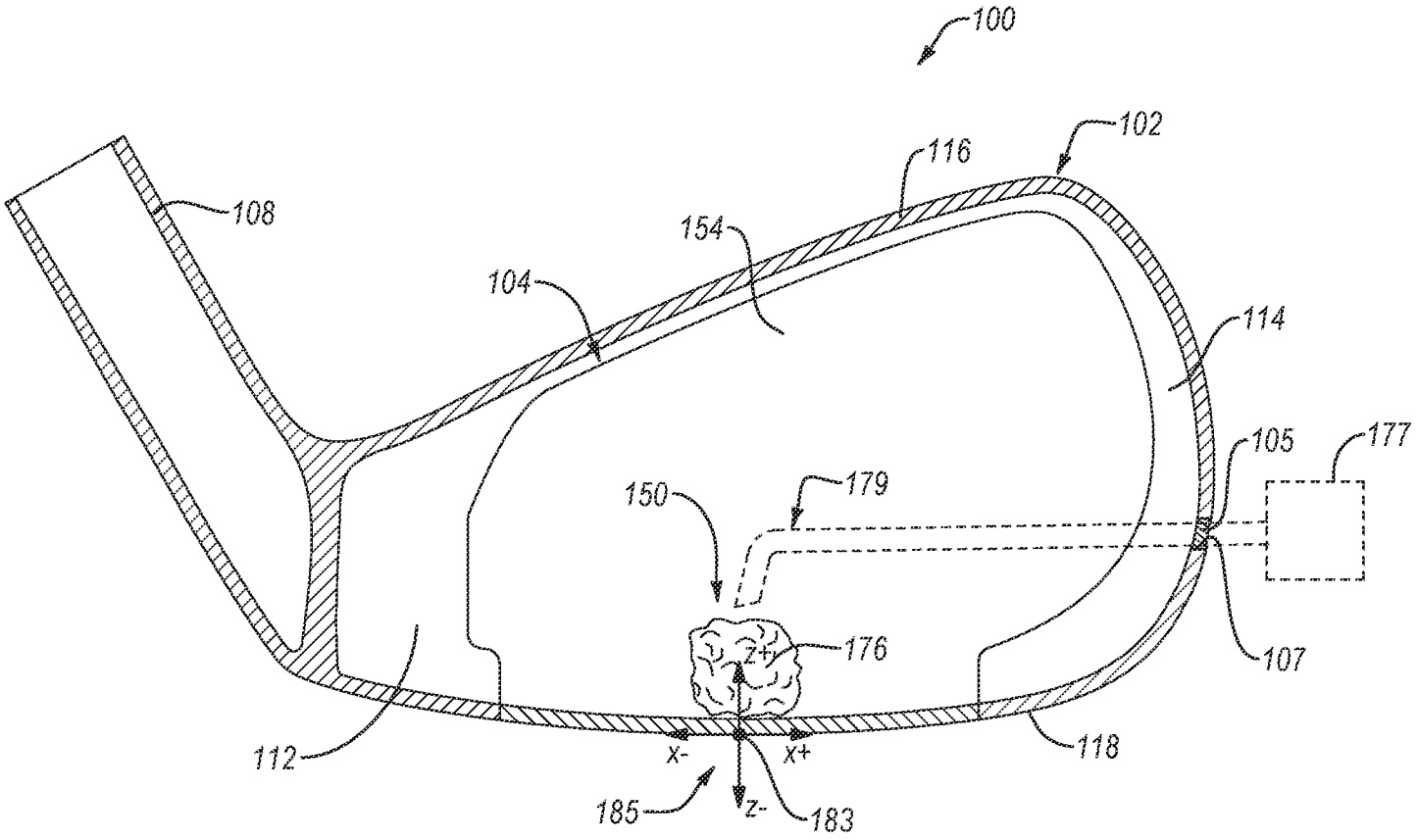
FIG. 13 is a cross-sectional rear view of the golf club head of FIG. 1, taken along the line 13-13 of FIG. 7, according to one or more examples of the present disclosure.
Figure 14:
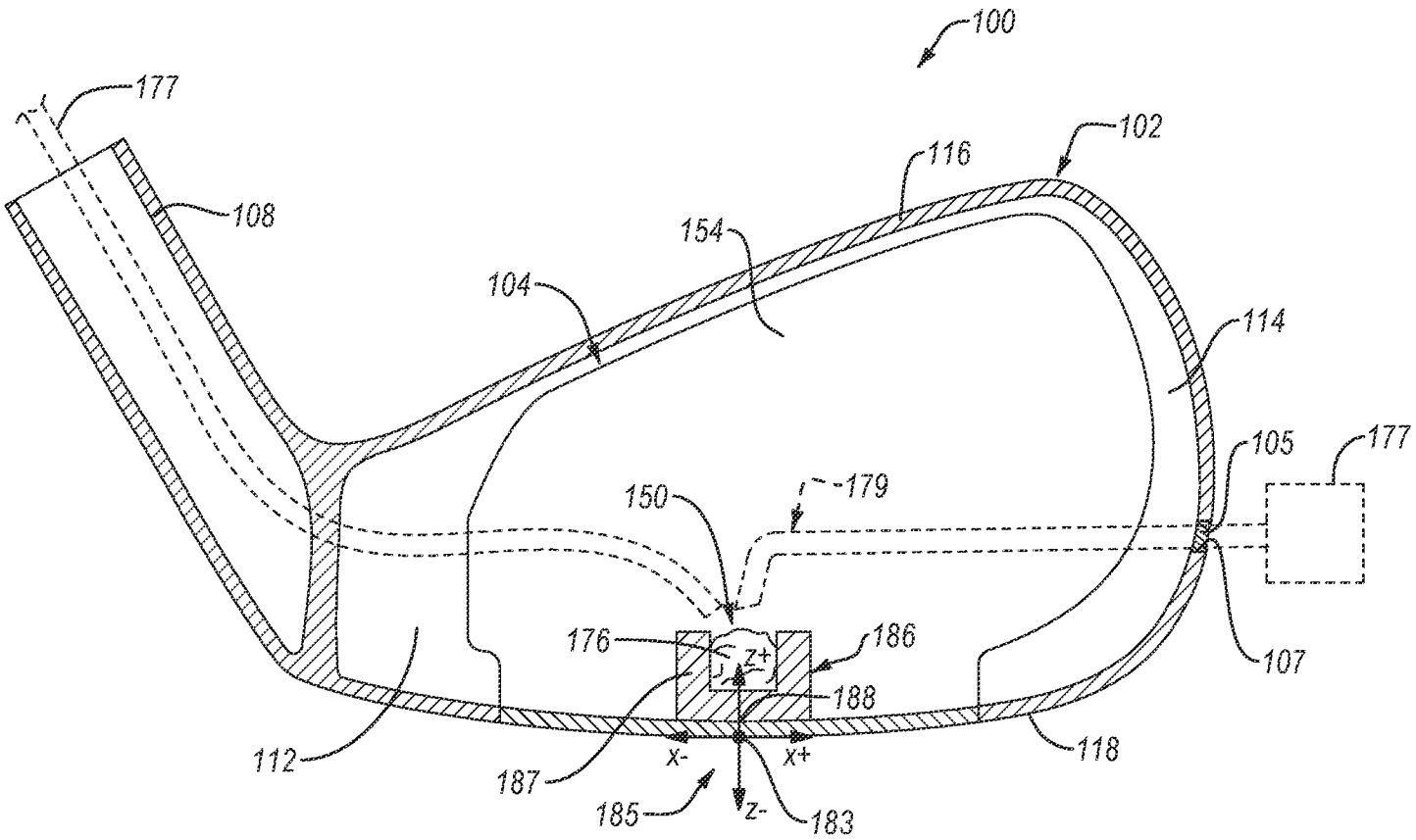
FIG. 14 is a cross-sectional rear view of an iron-type golf club head, taken along a line similar to line 13-13 of FIG. 7, according to one or more examples of the present disclosure.

According to one embodiment, the filler material 201 is initially a viscous material that is injected or otherwise inserted into the club head through an injection port 207 located on the toe portion of the club head (see, e.g., FIGS. 13-15). However, in other embodiments, the injection port 207 can be located in the rear wall 277 (see, e.g., FIG. 16), or in other portions of the club head 200, including the topline, sole or heel. Examples of materials that may be suitable for use as a filler material 201 to be placed into a club head include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. According to one example, the filler material 201 is Flex Foam-iT! 14™, made by Smooth-On, which can have a density of about 0.224 g/cc before being fully constrained by the internal cavity 242.

In still other embodiments, the filler material 201 material may be placed into the club head 200 (or the club head 100 of FIG. 17) and sealed in place with a plug 205, or resilient cap, cover, or other structure formed of a metal, metal alloy, metallic, composite, hard plastic, resilient elastomeric, or other suitable material. In one embodiment, the plug 205 is a metallic plug that can be made from steel, aluminum, titanium, or a metallic alloy. In one embodiment, the plug 205 is an anodized aluminum plug that is colored a red, green, blue, gray, white, orange, purple, black, clear, yellow, or metallic color. In one embodiment, the plug 205 is a different or contrasting color from the majority color located on the club head body 202.

In one embodiment, the back portion 229 golf club head 200 includes a recess 209 that allows a weight to be located. Once the weight is positioned within the recess 209 and the strike plate 204 has been attached, the filler material 201 is injected through the port 207 and sealed with the plug 205.

In one embodiment, the density of the filler material 201, after it is fully formed within the internal cavity 242, is at least 0.21 g/cc, such as between about 0.21 g/cc and about 0.71 g/cc or between about 0.22 g/cc and about 0.49 g/cc. In certain embodiments, the density of the filler material 201 is in the range of about 0.22 g/cc to about 0.71 g/cc, or between about 0.35 g/cc and 0.60 g/cc. The density of the filler material 201 impacts the COR, durability, strength, and filling capacity of the club head. In general, a lower density material will have less of an impact on the COR of a club head. The density of the filler material 201 is the density after the filler material 201 is fully formed within and enclosed by the internal cavity 242.

During development of the golf club head 200, use of a lower density filler material having a density less than 0.21 g/cc was investigated, but the lower density did not meet certain sound performance criteria. This resulted in using a filler material 201 having a density of at least 0.21 g/cc to meet sound performance criteria.

In one embodiment, the filler material 201 has a minor impact on the coefficient of restitution (herein "COR") as measured according to the United States Golf Association (USGA) rules set forth in the Procedure for Measuring the Velocity Ratio of a Club Head for Conformance to Rule 4-1e, Appendix II Revision 2 Feb. 8, 1999, herein incorporated by reference in its entirety.

Table 1 below provides examples of the COR change relative to a calibration plate of multiple club heads of the construction shown in FIG. 15 in both a filled and unfilled state. The calibration plate dimensions and weight are described in section 4.0 of the Procedure for Measuring the Velocity Ratio of a Club Head for Conformance to Rule 4-1e.

Due to the slight variability between different calibration plates, the values described below are described in terms of a change in COR relative to a calibration plate base value. For example, if a calibration plate has a 0.831 COR value, Example 1 for an un-filled head has a COR value of −0.019 less than 0.831 which would give Example 1 (Unfilled) a COR value of 0.812. The change in COR for a given head relative to a calibration plate is accurate and highly repeatable.

TABLE 1

COR Values Relative to a Calibration Plate

| Example No. | Unfilled COR Relative to Calibration Plate | Filled COR Relative to Calibration Plate | COR Change Between Filled and Unfilled |
|---|---|---|---|
| 1 | −0.019 | −0.022 | −0.003 |
| 2 | −0.003 | −0.005 | −0.002 |
| 3 | −0.006 | −0.010 | −0.004 |
| 4 | −0.006 | −0.017 | −0.011 |
| 5 | −0.026 | −0.028 | −0.002 |
| 6 | −0.007 | −0.017 | −0.01 |
| 7 | −0.013 | −0.019 | −0.006 |
| 8 | −0.007 | −0.007 | 0 |
| 9 | −0.012 | −0.014 | −0.002 |
| 10 | −0.020 | −0.022 | −0.002 |
| Average | −0.0119 | −0.022 | −0.002 |

Table 1 illustrates that before the filler material 201 is introduced into the cavity 242 of the golf club head 200, an Unfilled COR drop off relative to the calibration plate (or first COR drop off value) is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005. In one embodiment, the average COR drop off or loss relative to the calibration plate for a plurality of Unfilled COR golf club heads 200, within a set of irons, is between 0 and −0.05, between 0 and −0.03, between −0.00001 and −0.03, between −0.00001 and −0.025, between −0.00001 and −0.02, between −0.00001 and −0.015, or between −0.00001 and −0.01.

Table 1 further illustrates that after the filler material 201 is introduced into the cavity 242 of golf club head 200, a Filled COR drop off relative to the calibration plate (or second COR drop off value) is more than the Unfilled COR drop off relative to the calibration plate. In other words, the addition of the filler material 201 in the Filled COR golf club heads slows the ball speed (Vout—Velocity Out) after rebounding from the face by a small amount relative to the rebounding ball velocity of the Unfilled COR heads. In some embodiments shown in Table 1, the COR drop off or loss relative to the calibration plate for a Filled COR golf club head is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005. In one embodiment, the average COR drop off or loss relative to the calibration plate for a plurality of Filled COR golf club head within a set of irons is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

However, the amount of COR loss or drop off for a Filled COR head is minimized when compared to other constructions and filler materials. The last column of Table 1 illustrates a COR change between the Unfilled and Filled golf club heads which are calculated by subtracting the Unfilled COR from the Filled COR table columns. The change in COR (COR change value) between the Filled and Unfilled club heads is between 0 and −0.1, between 0 and −0.05, between 0 and −0.04, between 0 and −0.03, between 0 and −0.025, between 0 and −0.02, between 0 and −0.015, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002. Remarkably, one club head was able to achieve a change in COR of zero between a filled and unfilled golf club head. In other words, no change in COR between the Filled and Unfilled club head state. In some embodiments, the COR change value is greater than −0.1, greater than −0.05, greater than −0.04, greater than −0.03, greater than −0.02, greater than −0.01, greater than −0.009, greater than −0.008, greater than −0.007, greater than −0.006, greater than −0.005, greater than −0.004, or greater than −0.003. In certain examples, the filler material in the internal cavity reduces the COR by no more than 0.025 or 0.010.

In some embodiments, at least one, two, three, or four golf clubs out of an iron golf club set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In yet other embodiments, at least one pair or two pair of iron golf clubs in the set have a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In other embodiments, an average of a plurality of iron golf clubs in the set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

As shown in FIG. 16, the filler material 201 fills the cavity 242 located above the sole slot 226. A recess or depression 203 in the filler material 201 engages with the thickened portion of the strike plate 204. In some embodiments, the filler material 201 is a two-part polyurethane foam that is a thermoset and is flexible after it is cured. In one embodiment, the two-part polyurethane foam is any methylene diphenyl diisocyanate (a class of polyurethane prepolymer) or silicone based flexible or rigid polyurethane foam.

Other examples of cavity-back, muscle-back, and hollow-cavity iron-type golf club heads are described in U.S. patent application Ser. No. 14/981,330, filed Dec. 28, 2015, which is incorporated herein by reference.

Each of the golf club head 100, the golf club head 200, the golf club head 300, and the golf club head 400 includes at least one stiffener 150, shown in FIGS. 10-14, 15-19, 26, 28, and 29, positioned at least partially within the internal cavity of the golf club head (e.g., the internal cavity 142 and the internal cavity 242). The stiffener 150 or stiffeners 150 of the iron-type golf club head 100 and the iron-type golf club head 200 can be configured similarly to the stiffeners of the wood-type golf club heads described in U.S. patent application Ser. No. 16/223,108, filed Dec. 17, 2018, which is incorporated herein in its entirety.

As used herein, the stiffener 150 is directly coupleable to (e.g., contactable with or in abutting engagement with) the back surface 154 of the strike plate 104. The back surface 154 is opposite the strike face 106, which defines an exterior surface of the strike plate 104. In implementations where the strike plate 104 is welded to the body 102, the stiffener 150 can be directly coupleable to the weld. The stiffener 150 may be non-adjustably directly coupled to the back surface 154 of the strike plate 104 or adjustably directly coupled to the back surface 154 of the strike plate 104. As defined herein, the stiffener 150 is non-adjustably directly coupled to the back surface 154 when permanent deformation of the back surface 154 or the stiffener 150 is required to decouple the stiffener 150 from the back surface 154 (see, e.g., the discrete mass 176 of FIGS. 10-14 and 15-19). In contrast, as defined herein, the stiffener 150 is adjustably directly coupled to the back surface 154 when the stiffener 150 can be decoupled from the back surface 154 without permanent deformation of the back surface 154 or the stiffener 150 (see, e.g., the plug 320 of FIGS. 26, 28, and 29).

The stiffener 150 is configured to locally stiffen the strike plate 104, when the stiffener 150 is directly coupled to the back surface 154 of the strike plate 104, such that a characteristic time (CT) of the golf club head 100 within an area of the strike plate 104 proximate the stiffener 150 is lower than without the stiffener 150. In the illustrated examples, the stiffener 150 is aligned with the origin 183 of the club head origin coordinate system 185 along the y-axis. In other words, the stiffener 150 has an x-axis coordinate, of the club head origin coordinate system 185, of zero. In this manner, the CT of the golf club head 100 at locations that are aligned with a center of the strike face 106 can be locally reduced. Additionally, using the stiffener 150 to discretely reduce the CT of the golf club head 100 at locations with an x-axis coordinate that is zero helps to achieve a desirable COR of the strike plate 143 by promoting a lower thickness of the strike plate 104, particularly at a central portion of the strike plate 104.

Figure 19:
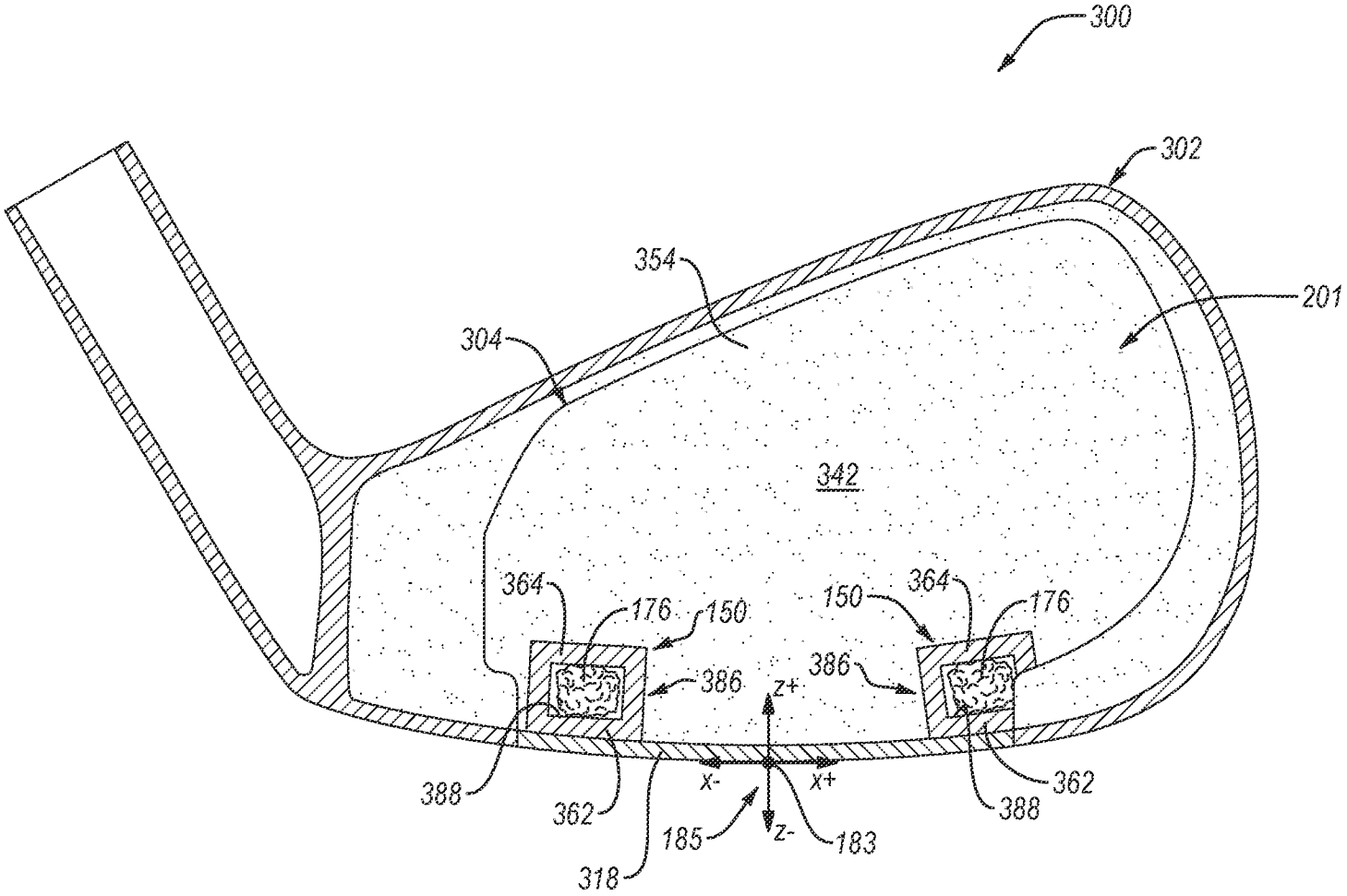
FIG. 19 is a cross-sectional rear view of an iron-type golf club head, taken along a line similar to line 13-13 of FIG. 7, according to one or more examples of the present disclosure.

However, in some examples, the stiffener 150 is offset from the origin 183 of the club head origin coordinate system 185 along the x-axis of the club head origin coordinate system 185 to stiffen the strike plate 104 and lower the CT within an area of the strike plate 104 at a location away from the origin 183 along the x-axis of the club head origin coordinate system 185 (see, e.g., FIG. 19). In this manner, the CT of the golf club head 100 at locations with an x-axis coordinate that is toeward (e.g., towards the toe portion 114) and/or heelward (e.g., towards the heel port 116) away from the origin 183 can be locally reduced without significantly affecting the CT of the golf club head 100 at locations with an x-axis coordinate proximate that of the origin 183. Additionally, using the stiffener 150 to discretely reduce the CT of the golf club head 100 just at locations with an x-axis coordinate that is toeward and/or heelward away from the origin 183 helps to achieve a desirable COR of the strike plate 143 by promoting a lower thickness of the strike plate 104, particularly at toeward and/or heelward locations of the strike plate 104.

In some examples, the stiffeners 150 may be located at approximately center face. In one embodiment, one or more of the stiffeners 150 of the golf club head 100 has an x-axis coordinate of the club head origin coordinate system 185 that is between 15 mm and −15 mm, and one or more of the stiffeners 150 of the golf club head 100 has a z-axis coordinate of the club head origin coordinate system 185 that is between 18 mm and −18 mm. In other examples, one or more of the stiffeners 150 of the golf club head 100 has an x-axis coordinate of the club head origin coordinate system 185 that is between 10 mm and −10 mm, and one or more of the stiffeners 150 of the golf club head 100 has a z-axis coordinate of the club head origin coordinate system 185 that is between 15 mm and −15 mm.

In some examples, the stiffeners 150 are significantly offset from the origin along the x-axis of the club head origin coordinate system 185 to correspondingly reduce the CT at locations offset from the origin along the x-axis. In one embodiment, one or more of the stiffeners 150 of the golf club head 100 has an x-axis coordinate of the club head origin coordinate system 185 that is either greater than 10 mm and less than 50 mm or greater than −50 mm and less than −10 mm. According to another embodiment, one or more of the stiffeners 150 of the golf club head 100 has an x-axis coordinate of the club head origin coordinate system 185 that is either greater than 20 mm and less than 50 mm or greater than −50 mm and less than −20 mm. In another embodiment, one or more of the stiffeners 150 of the golf club head 100 has an x-axis coordinate of the club head origin coordinate system 185 that is either greater than 30 mm and less than 40 mm or greater than −40 mm and less than −30 mm. In another embodiment, one or more of the stiffeners 150 of the golf club head 100 has an x-axis coordinate of the club head origin coordinate system 185 that is either greater than 40 mm and less than 50 mm or greater than −50 mm and less than −40 mm. The location of a stiffener 150 is defined as the location of either a midpoint (e.g., geometric center) or center of mass of the portion of the stiffener 150 contactable with the face portion or a center.

The golf club head 100 may have any number of stiffeners 150 at any of various locations having an x-axis coordinate greater than or less than zero, or in some instances, equal to zero. A stiffener 150 with an x-axis coordinate greater than zero is located closer to the toe portion 114 than the heel portion 116 and thus can be considered a toe stiffener. In contrast, a stiffener 150 with an x-axis coordinate less than zero is located closer to the heel portion 116 than the toe portion 114 and thus can be considered a heel stiffener. The golf club head 100 can have only one stiffener 150 with an x-axis coordinate greater than zero and only one stiffener 150 with an x-axis coordinate less than zero (see, e.g., FIG. 19). In other embodiments, the golf club head 100 has more than one stiffener 150 with an x-axis coordinate greater than zero and more than one stiffener 150 with an x-axis coordinate less than zero. However, in yet other embodiments, the golf club head 100 has fewer than one stiffener 150 (e.g., zero stiffeners) with an x-axis coordinate greater than zero or fewer than one stiffener 150 (e.g., zero stiffeners) with an x-axis coordinate less than zero.

In the illustrated examples, each stiffener 150 of the golf club head 100 is coupleable (e.g., directly coupleable) to the back surface 154 of the strike plate 104 at a bottom region of the golf club head 100, approximate the sole portion 118. However, in other examples, the golf club head 100 includes at least one stiffener 150 directly coupleable to the back surface 154 of the strike plate 104 at a top region of the golf club head 100, approximate the top portion 116. It is recognized that in some implementations, one or more stiffeners 150 may be directly coupleable the back surface 154 of the strike plate 104 at both the top region and the bottom region or extend from the top region to the bottom region.

Referring to FIGS. 10-14 and 16-19, in one example, the stiffener 150 is a discrete mass 176 that is non-adjustably directly coupled to the face portion 142. The discrete mass 176 is directly coupled to the face portion 142 at the bottom region of the golf club head 100. Such a discrete mass 176 can be considered a lower discrete mass. The discrete mass 176 is directly coupled to the back surface 154 of the strike plate 104. In addition to the strike plate 104, the discrete mass 176, at the bottom region, can be non-adjustably directly coupled to the interior surface of the sole portion 118.

The discrete mass 176 is made of a polymeric material. According to one example, the polymeric material of the discrete mass 176 is any of various polymeric materials having a hardness equal to or greater than about Shore 20D. In another example, the polymeric material of the discrete mass 176 is any of various polymeric materials having a hardness equal to or greater than about Shore 45D. In yet another example, the polymeric material of the discrete mass 176 is any of various polymeric materials having a hardness equal to or greater than about Shore 85D. The polymeric material is acrylic in one implementation. In some examples, the discrete mass 176 has a hardness between Shore 40D and Shore 80D or between Shore 75D and Shore 85D. In yet some examples, the discrete mass 176 has a hardness of at least Shore 50D, at least Shore 60D, or at least Shore 70D. In yet some examples, the discrete mass 176 is any of various polymeric materials having a hardness equal to or greater than about Shore 5.95D.

In other implementations, some examples of the polymeric material include, without limitation, viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc. In one embodiment the polymeric material may be a material having a modulus of elasticity ranging from about 0.001 GPa to about 25 GPa, and a durometer ranging from about 10 to about 30 on a Shore D scale. In a preferred embodiment, the polymeric material may be a material having a modulus of elasticity ranging from about 0.001 GPa to about 10 GPa, and a durometer ranging from about 15 to about 25 on a Shore D scale. In another embodiment, the polymeric material is a material having a modulus of elasticity ranging from about 0.001 GPa to about 5 GPa, and a durometer ranging from about 18 to about 22 on a Shore D scale. In some examples, a material providing vibration damping is preferred.

The polymeric material is a thermoset material, such as epoxies, resins, and the like, in some implementations. A thermoset material is any of various polymer materials that undergo a chemical transformation, which hardens and strengthens the material, when heated above a cure temperature of the material. The chemical transformation of thermoset materials is non-reversible. The polymeric material is a thermoplastic material, such as polyester, polyethylene, and the like, in other implementations. In contrast to thermoset materials, a thermoplastic material is any of various polymer materials that undergo a physical transformation when heated, which softens the material, and cooled, which hardens the material. The physical transformation of thermoplastic materials is reversible.

The discrete mass 176 is considered discrete, in some example, because it occupies only a small portion of the back surface 154 along the x-axis, such as greater than 0% and less than 25%, less than 20%, less than 15%, or less than 10%. For examples with multiple discrete masses 176, the discrete masses 176 are considered discrete because they are spaced apart from any other discrete mass 176 in a direction parallel to the x-axis of the golf club head origin coordinate system 185. The discrete mass 176 can have any of various shapes and sizes. Although shown as substantially ball-shaped in FIGS. 10-14 and 16-19, the discrete mass 176 can be flatter or more polygonal.

Referring to FIG. 10, the discrete mass 176 of polymeric material is directly coupled to the strike plate 106 at a location LDM away from an outer peripheral edge of the strike plate 106. The discrete mass 176 is not directly coupled to the face portion at just the location LDM. Rather, the discrete mass 176 can be directly coupled to the strike plate 106 all the way, or only part of the way, from the outer peripheral edge of the strike plate 106 up to the location LDM. In some implementations, the location LDM is at least 5 mm, 10 mm, 15 mm, 20 mm, or 30 mm depending on the lateral location of the discrete mass 176 on the face portion and the desired decrease of the CT of the golf club head 100. For example, the greater the location LDM away from outer peripheral edge of the strike plate 106, the greater the impact on the CT of the golf club head 100. The outer peripheral edge is defined as the outermost boundary of the strike plate radially away from the geometric center of the face portion 142 or otherwise defined as the imaginary line where the strike face 106 transitions into the sole portion 117. Accordingly, the outer peripheral edge can be, but is not necessarily, the same as the outer peripheral edge of the strike plate 106.

The discrete mass 176 of polymeric material is directly coupled to the back surface 154 of the strike plate 104 such that the discrete mass 176 contacts a particular amount of surface area of the back surface 154 of the strike plate 104. Generally, the more surface area contacted by the discrete mass 176, the greater the impact on the CT of the strike plate 104. In one implementation, the discrete mass 176 contacts a surface area of the back surface 154 of at least 50 $mm^2$, 150 $mm^2$, or 225 $mm^2$. In embodiments having a plurality of discrete masses 176, the surface area of the back surface 154 contacted by one of the discrete masses 176 can be different than another one of the discrete masses 176. Additionally, in certain implementations having a plurality of discrete masses 176, the combined surface area of the back surface 154 contacted by the discrete masses 176 can be at least 100 $mm^2$ or 800 $mm^2$, or 1,600 $mm^2$, for example. According to certain implementations, a ratio of the surface area of the back surface 154 contacted by one or more of the discrete masses 176 and a total internal surface area (e.g., total surface area of the interior surface 145) of the back surface 154 is at least 0.01, 0.05, or 0.1, for example. In some implementations, the total surface area of the back surface 154 is between 2,500 $mm^2$ and 6,000 $mm^2$.

In some implementations, the total surface area of the back surface 154 is between 1,200 $mm^2$ and 6,000 $mm^2$. The back surface 154 of the strike plate 104 can have a total surface area between 1,600 $mm^2$ and 3,300 $mm^2$ in some implementations. In some embodiments, the total surface area of the back surface 154 divided by the total surface area of the strike plate is between about 0.61 and about 0.79, between about 0.63 and about 0.77, or between about 0.64 and about 0.75. For example, in some embodiments the total surface area of the back surface may be about 1,800 $mm^2$ and the total surface area of the strike plate may be about 2,800 $mm^2$ resulting in a ratio of about 0.642.

In embodiments having a plurality of discrete masses 176, such as shown in FIG. 19, the material of one discrete mass 176 can be different than another one of the discrete masses 176. For example, one discrete mass 176 can have a modulus of elasticity or a hardness different than another one of the discrete mases 176, with such differences being dependent on the corresponding locations of the discrete masses 176 relative to the face portion 142. In one implementation, a discrete mass 176 offset toewardly from the center of the strike face 106 may have a higher modulus of elasticity or a higher hardness than a discrete mass 176 heelward from the center of the strike face 106.

Each one of the discrete masses 176 can be applied onto the back surface 154 of the strike plate 104 using any of various techniques. For example, referring to FIGS. 10, 13-16, and 18, the discrete masses 176 are formed by injecting the polymeric material, in a flowable state, through an aperture in the golf club head, using an injection tool (see, e.g., the injection tool 177) and allowing the polymeric material to cool or, alternatively, curing the polymeric material. Because the polymeric material is injected in a flowable state, the polymeric material is not under compression.

For a cavity-back type golf club head, such as the golf club head 100 of FIG. 10, which includes an internal cavity 142 that is open (e.g., not fully enclosed) after manufacturing of the golf club head is completed (e.g., after the golf club head has been tested to determine the CT of the golf club head), the polymeric material can be injected into the internal cavity 142 through the plate opening 176 of the golf club head 100. For example, an injection end of a tool 177 can be passed through the plate opening 176 of the golf club head 100 of FIG. 10 to access and inject polymeric material into the internal cavity 142 against the back surface 154 of the strike plate 104. In certain examples, the injection tool 177 has an angled delivery tube 179 that helps to navigate features of the golf club head 100 to position an outlet of the tube in a proper location for delivering the polymeric material.

According to some examples, the injection tool 177 delivers the polymeric material to the back surface 152 of the strike plate 104 through the plate opening 176 of the cavity-back type golf club head 100 before the rear fascia 160 covers the plate opening 176 at the back portion of the golf club head 100 (see, e.g., FIG. 11). In other words, after the CT of the golf club head 100 is tested and the discrete mass 176 is formed to lower the CT, the rear fascia 160 is applied to the rear portion of the body 102 to cover the plate opening 176.

However, in some examples, the discrete mass 176 is formed after the rear fascia 160 covers the plate opening 176 from the back portion of the golf club head 100. Accordingly, access to the back surface 152 of the strike plate 104 from the rear of the golf club head 100 through the plate opening 176 is prevented by the rear fascia 160. Similarly, for a hollow-body iron-type golf club head 100 enclosed by a rear wall 277 (see, e.g., FIGS. 15 and 16), the rear wall 277 obstructs access to the internal cavity 142, to inject the polymeric material, from a back portion of the golf club head 100. Accordingly, in some embodiments, the golf club head 100 includes one or more apertures formed in the body 102 (see, e.g., FIGS. 13-16) and/or the strike plate 104 (see, e.g., FIG. 18). As shown in FIGS. 13-16 and 18, after the CT golf club head is tested, an injection tool 177 can access the internal cavity 142 via the one or more apertures to inject polymeric material into the internal cavity 142 against the back surface 154 of the strike plate 104. After injecting the polymeric material into the internal cavity 142 through the apertures, the apertures can be covered or plugged by a corresponding plug, which can be a fastener as will be described below.

In the illustrated examples of FIGS. 13 and 14, the golf club head 100 includes a toe aperture 107 formed in the toe portion 114. As presented previously, the golf club head 100 is a cavity-back type golf club head with a rear fascia 160 enclosing the rear side of the internal cavity 142 and the strike plate 104 welded to or co-cast with the body of the golf club head 100. Therefore, the toe aperture 107 is used to deposit the polymeric material of the discrete mass 176 in those examples where the discrete mass 176 is deposited after the rear fascia 160 encloses the internal cavity 142. Additionally, the toe aperture 107 can be used to inject a filler material 201 into the internal cavity 142 after the rear fascia 160 is fixed to the golf club head 100 (see, e.g., FIG. 17). In some examples, the toe aperture 107 is angled to facilitate proper positioning of a delivery tube of the injection tool 177 for delivery of the polymeric material. However, in other examples, it may be difficult to angle the injection tool 177 in view of the location and angle of the toe aperture 107. In these examples, the injection tool 177 includes the angled delivery tube 179 that allows the injection tool 177 to deliver the polymeric material through the toe aperture 107 against the back surface 154 at the sole portion 118 of the golf club head 100. After injecting the polymeric material into the internal cavity 142 through the toe aperture 107, the toe aperture 107 can be covered or plugged by a plug 105.

In alternative examples, as shown in FIG. 14, instead of, or in addition to, a toe aperture 107, the polymeric material of the discrete mass 176 can be injected through the hosel 108 using an injection tool 177.

Alternatively, in certain examples (see, e.g., FIG. 17), instead of a toe aperture 107, the golf club head 100 includes a rear aperture 107A formed in the rear fascia 160. In such examples, the polymeric material of the discrete mass 176 can be injected through the rear aperture 107A of the rear fascia 160 instead of, or in addition to, a toe aperture 107. The rear aperture 107A can also be used to inject the filler material 201 in some examples.

In the illustrated examples of FIG. 15, like the golf club head 100 of FIGS. 13 and 14, the golf club head 200 includes a toe aperture 207A formed in the toe portion 214 of the golf club head 200. As shown, the toe aperture 207A can be used to inject polymeric material against the interior surface 254 of the strike plate 204 using an injection tool 177, which can have an angled delivery tube 179.

Referring to FIG. 16, according to other examples, the golf club head 200 includes a rear aperture 207B formed in the rear wall 277. The rear aperture 207B is used to deposit the polymeric material of the discrete mass 176 after the strike plate 204 is attached to the body 102 of the golf club head 200. Additionally, the rear aperture 207B can be used to inject a filler material 201 into the internal cavity 142. In some examples, as shown, the rear aperture 207B is angled to facilitate proper positioning of a delivery tube of the injection tool 177 for delivery of the polymeric material. However, in other examples, it may be difficult to angle the injection tool 177 in view of the location and angle of the rear aperture 207B. In these examples, the injection tool 177 includes the angled delivery tube 179 that allows the injection tool 177 to deliver the polymeric material through the rear aperture 207B against the back surface 154 at the sole portion 118 of the golf club head 100. After injecting the polymeric material into the internal cavity 242 through the rear aperture 207B, the rear aperture 207B can be covered or plugged by a plug 205B.

According to alternative examples, also shown in FIG. 16, delivery of the polymeric material can be performed through an aperture in the sole portion 218 of the golf club head 200, such as the sole slot 226. As shown, the injection tool 177 can be inserted, from outside the golf club head 200, through the sole slot 226 and into the interior cavity 277. After depositing the polymeric material, the sole slot 226 can be filled with a filler material, such as the filler material 128.

In yet another example, illustrated in FIG. 18, the golf club head 300 includes at least one face aperture 307 formed in the strike plate 304. The golf club head 300 is a hollow-cavity-type golf club head, similar to the golf club head 200 of FIGS. 15 and 16. Accordingly, unless otherwise noted, like numbers between FIG. 18 and FIGS. 15 and 16 correspond to like features. The face aperture 307 is located on the strike plate 304 at a location corresponding with a desired location of the discrete mass 176. Accordingly, the face aperture 307 can be located toeward of, heelward of, or vertically aligned with the center of the strike face 306 defined by the strike plate 304. In some examples, the face aperture 307 is formed in the strike plate 304 at locations that maintain the performance of the grooves 311 of the strike plate 304. Accordingly, in certain examples, the face aperture 307 is located between grooves 311 of the strike plate 304. After injecting the polymeric material into the internal cavity 342 through the face aperture 307, the face aperture 307 can be covered or plugged by a plug 305.

Figure 22:
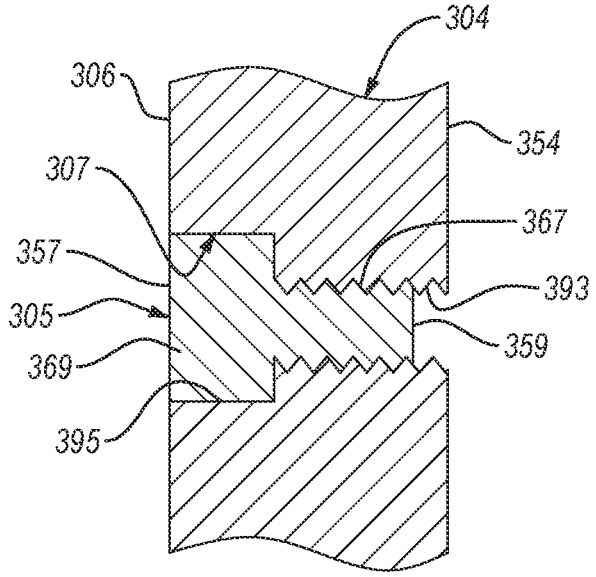
FIG. 22 is a cross-sectional side view of the strike plate of the golf club head of FIG. 21, according to one or more examples of the present disclosure.

Referring to FIG. 21, according to some examples of the golf club head 300, the face aperture 307 extends through the strike plate 304 from the strike face 306 to the back surface 354. The face aperture 307 includes internal threads 393 and a counterbore 395 in certain examples. The counterbore 395 is interposed between the internal threads 393 and the strike face 306. The counterbore 395 has a radial dimension greater than a maximum radial dimension of the internal threads 393. Additionally, the counterbore 395 has a depth $D_{CB}$ relative to the strike face 306. The plug 305 includes a shank 359 and a head 369. The shank 359 includes external threads 367 that are configured to threadably engage the internal threads 393 of the face aperture 307. The head 369 has a radial dimension that is greater than a maximum radial dimension of the external threads 367. Moreover, the radial dimension of the head 369 is equal to or just smaller than the radial dimension of the counterbore 395 such that the head 369 can be nestably seated within the counterbore 395 when the external threads 367 are threadably engaged with the internal threads 393, as shown in FIG. 22. Additionally, the head 369 has a height $H_H$.

Figure 23:
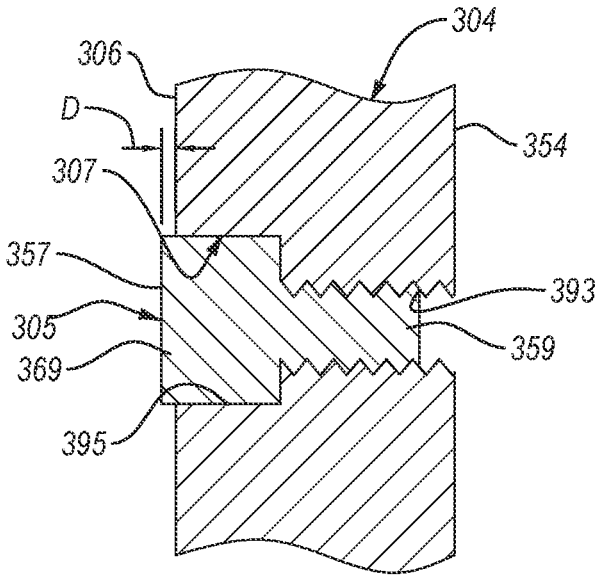
FIG. 23 is a cross-sectional side view of a strike plate of a golf club head, according to one or more examples of the present disclosure.
Figure 24:
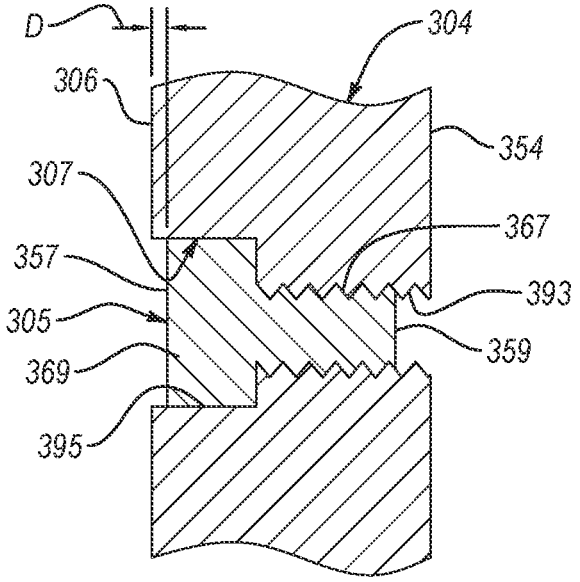
FIG. 24 is a cross-sectional side view of a strike plate of a golf club head, according to one or more examples of the present disclosure.

Referring to FIGS. 22-24, the plug 305 is non-movably fixedly retained within the face aperture 307 in the strike plate 304 (or the body 302 in some examples). Generally, the plug 305 of FIGS. 22-24 is non-movably fixedly retained within the face aperture 307 when the external threads 367 are threadably engaged with the internal threads 393 and the head 369 is fully seated against the counterbore 395. In some examples, an adhesive is applied between the external threads 367 and the internal threads 393 to promote a secure fit between the plug 305 and the face aperture 307.

When non-movably fixedly retained within the face aperture 307, an outermost surface 357 of the plug 305, which is the outermost surface of the head 369 in the examples corresponding with FIGS. 21-24, establishes a flushness with the strike face 306. The flushness can be quantified as the distance D the outermost surface 357 protrudes from the strike face 306 (see, e.g., FIG. 23) or the distance D the outermost surface 357 is recessed or sunken below the strike face 306 (see, e.g., FIG. 24). In FIG. 22, the distance D is zero such that the outermost surface 357 is perfectly flush with the strike face 306. However, in some examples, the distance D is greater than zero such that the outermost surface 357 is not perfectly flush with the strike face 306. For example, in one implementation, the outermost surface 357 of the plug 305 protrudes a distance D no more than 0.15 millimeters from the strike face 306 or is sunken below the surface of the strike face 306 a distance D no more than 0.1 millimeters. Enabling a flushness within this range promotes improved performance of the golf club head by reducing potentially negative interactions with a golf ball on impact.

According to one method, the desired flushness is achieved by determining the depth $D_{CB}$ of the counterbore 395 after the strike plate 304 is formed. In response to the determined depth $D_{CB}$, a plug 305 with a desired head height $H_H$, corresponding with the determined depth $D_{CB}$, is selected from a plurality of plugs 305 each with a different head height $H_H$. After the plug 305 with the desired head height $H_H$ is selected, it is non-movably fixedly retained within the face aperture 307.

Figure 25:
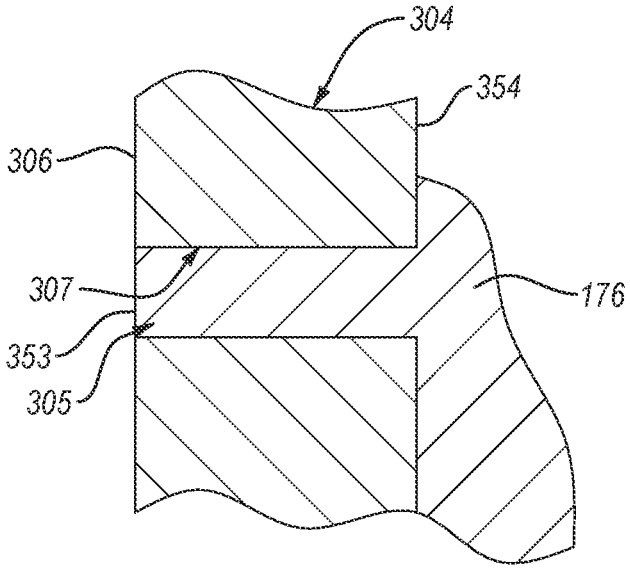
FIG. 25 is a cross-sectional side view of a strike plate of a golf club head, according to one or more examples of the present disclosure.
Figure 26:
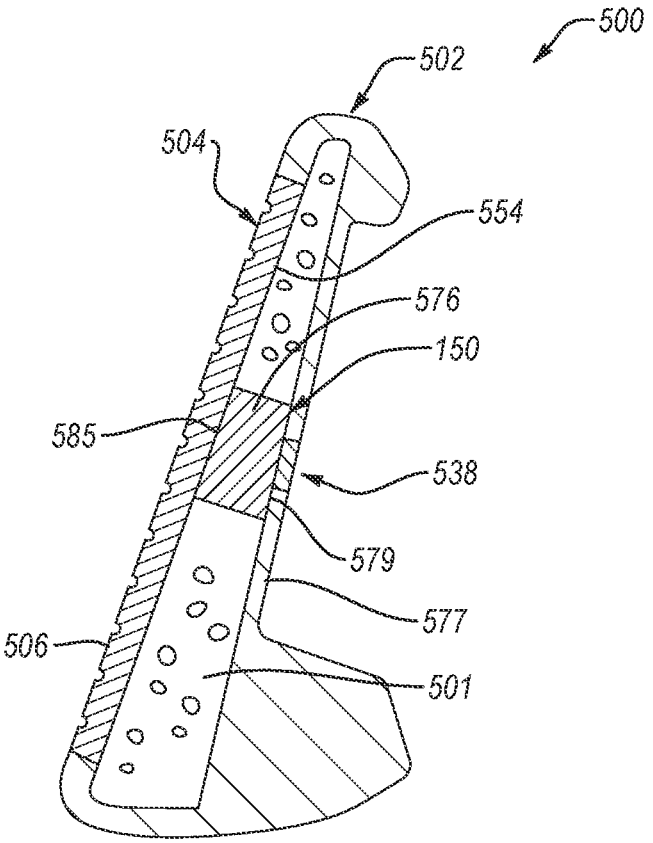
FIG. 26 is a cross-sectional side view of an iron-type golf club head, taken along a line similar to line 10-10 of FIG. 2, according to one or more examples of the present disclosure.
Figure 27:
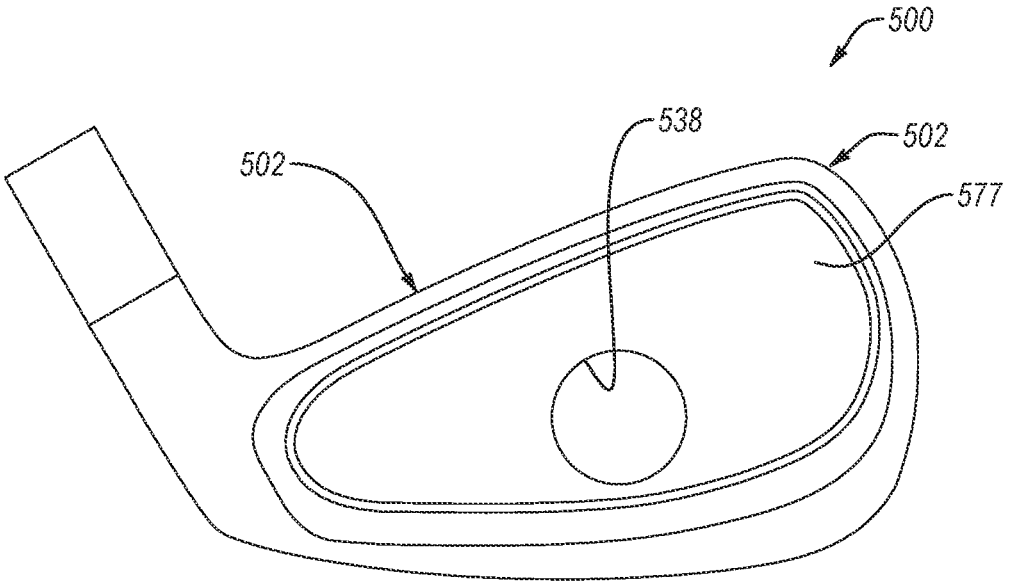
FIG. 27 is a rear view of the iron-type golf club head of FIG. 26, according to one or more examples of the present disclosure.
Figure 28:
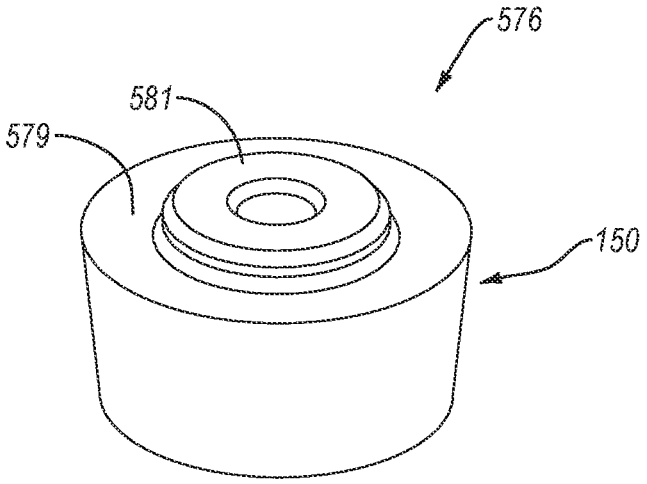
FIG. 28 is a perspective view of a plug of the iron-type golf club head of FIG. 26, according to one or more examples of the present disclosure.

Referring to FIG. 25, in some examples, the plug 305 includes a portion of the stiffener. In one example, the stiffener is a discrete mass 176 of polymeric material and the plug 305 is made of a portion of the polymeric material. The polymeric material is injected through the face aperture 307 to form the discrete mass 176 within the golf club head 300 and allowed to fill the face aperture 307 after forming the discrete mass 176. To obtain a desired flushness with the strike face 306, in one example, the polymeric material of the plug 305 can originally protrude from the strike face 306 and be surface finished (e.g., sanded, grinded, polished, chemically etched, etc.) until the plug 305 reaches the desired flushness.

In some examples, the iron-type golf club heads of the present disclosure include lateral retaining features, which laterally retain the discrete masses 176. Generally, the golf club heads include at least one pair of lateral retaining features that laterally retain a discrete mass 176 therebetween. Each of the lateral retaining features is a barrier, stop, wall, or other structure that has a vertical height sufficient to prevent the flow of polymeric material therethrough. The lateral retaining features are co-formed with the body of the golf club heads in some examples. In other examples, the lateral retaining features are formed separately from the body of the golf club heads and attached to the body of the golf club heads. In other words, the lateral retaining features form a one-piece, monolithic, construction with the body of a golf club head, in some examples, and form a multi-piece construction with the body of a golf club head in other examples.

Referring to FIGS. 15, 16, and 18, the golf club head 200 and the golf club head 300 include lateral retaining features in the form of a pair of ribs 177 co-formed with the body 202 and the body 302, respectively. Accordingly, the ribs 177 are made of the metal corresponding with the metal of the body 202 and the body 302. Co-formed ribs 177 are particularly useful at laterally retaining the polymeric material of a discrete mass 176 where the golf club head has a hollow-body construction with an integrated rear wall, such as the rear wall 277 or the rear wall 377. Because of the rear wall 277 or the rear wall 377, locating lateral retaining features into the internal cavity through an open back of the hollow-body golf club head is not possible. Moreover, the welding process for welding a strike plate to the body, which is associated with a hollow-body golf club head having an integrated rear wall, generates temperatures that may melt lateral retaining features made of foam. For this reason, co-formed metallic ribs are used in some examples because they do not need access through a rear opening to be formed and are made of materials that can withstand the heat generated when the strike plate is welded to the body.

Alternatively, referring to FIGS. 5, 6, 10, 11, 12, 14, and 17, the golf club head 100 includes lateral retaining features in the form of a pair of walls 187 or inserts separately formed and attached to the body 102 of the golf club head 100. The walls 187 are made from a material different than that of the body 102. In one example, the walls 187 are made of a foam, such as a foam described herein. The walls 187 can be bonded or adhered to the body 102 of the golf club head 100. Because the interval cavity 142 of the golf club head 100 is open after formation of the body 102, the walls 187 can be attached to the interior surface of the body 102 after the strike plate 104 welded to the body 102. In this manner, the heat from the welding process will not melt the walls 187.

In contrast to the above, in some examples, the ribs 177 are replaced with the walls 187 or the walls 187 are replaced with the ribs 177.

In some implementations, some features of the body of the golf club heads disclosed herein, such as golf club head 100, help to vertically support the discrete masses 176 in place against the back surface of the strike face. For example, referring to FIG. 11, the lower shelf 130 of the back portion 129 of the golf club head 100 can be used as a support surface that vertically supports the discrete masses 176.

According to some embodiments, such as shown in FIG. 16, the stiffener 150 includes both a discrete mass 176 and lower foam 262. In the case of the stiffener 150 being located at the bottom region, the lower foam 262 is positioned between the discrete mass 176 and the sole portion 218. The lower foam 262 helps to vertically support and vertically downwardly constrain the discrete mass 176. The stiffener 150 of the golf club head 300 shown in FIG. 19 also includes a lower foam 363. The stiffener 150 may also include upper foam, such as upper foam 364 (see, e.g., FIG. 19), to vertically upwardly constrain the discrete mass 176. The lower foam and the upper foam, when used, can be fixedly attached to the strike plate, such as by an adhesive, of the golf club head before the strike plate is welded to the body of the golf club head. As shown in FIG. 17, if the golf club head 100 includes a sole bar 131, the sole bar 131 can help rearwardly constrain the discrete mass 176 along the y-axis of the club head origin coordinate system 185.

The lower foam (e.g., the lower foam 262 and the lower foam 362) provides a platform (e.g., acts as a spacer) to position the discrete mass 176, at the bottom region, higher up on the back surface of the strike plate. In some examples, the lower foam is lighter than the polymeric material of the discrete mass 176. Therefore, effectively replacing a portion of the discrete mass 176 with the lower foam reduces the overall weight of the stiffener 150 without compromising the CT reduction performance of the stiffener 150. In some implementations, the foam of each stiffener 150 is a discrete piece of foam, such that the foam of one stiffener 150 is separate from the foam of another stiffener 150. The foam can be any of various types of foam, such as polyurethane, polyethylene, and the like, with a lightweight cellular form resulting from the introduction of gas bubbles during manufacture.

Referring to FIG. 19, the foam of the stiffener 150 can be formed into an enclosure 386 made of foam. The enclosure 386 can be configured (e.g., shaped) to be in seated engagement or complementary engagement with the interior surface of the internal cavity 342 of the golf club head 300. The foam of the enclosure 386 can be the same type of foam as described above in association with the lower foam and the upper foam. The enclosure 386 defines a cavity 388 with a side open to the back surface 354 of the strike plate 304. More specifically, in one example, the enclosure 386 includes a base secured directly to the interior surface of the body 302 near the sole portion 318. One or more walls protrude from the base and together with the base define the cavity 388. The base and walls of the enclosure 386 abut the back surface 354 of the strike plate 304 such that the back surface 354 effectively closes the open side of the cavity 388, while the open end of the cavity 388 remains open. Accordingly, the cavity 388 has a closed end defined by the base, an open end, opposite the closed end, at least one closed side defined by the walls of the enclosure 386, and one open side that is open to the back surface 354 of the strike plate 304. In the illustrated implementation, the base is four-sided and the enclosure 386 includes three walls that protrude orthogonally from the base. Therefore, in the illustrated implementation, the cavity 388 is substantially square shaped. However, in other implementations, the enclosure 386 and the cavity 388 can have any of various shapes as long as the cavity 388 has a side open to the back surface 354 of the strike plate 304.

The discrete mass 176 of the stiffener 150 is located within and retained by the cavity 388 of the enclosure 386. The base of the enclosure 386 provides a platform to position the discrete mass 176 higher up on the back surface 354 of the strike plate 304. The walls of the enclosure 386 help to retain and localize the discrete mass 176 at a location on the back surface 354 of the strike plate 304 where adjustability of the CT is desired.

As shown in FIG. 19, in some implementations, the golf club head 300 includes multiple enclosures 386, and multiple corresponding discrete masses 176, spaced apart from each other in a direction parallel to the x-axis of the golf club head origin coordinate system 185. Multiple enclosures 386 can be located at the bottom region of the golf club head 300.

The discrete mass 176 can be applied into the cavity 388 of the enclosure 386 using the same or similar techniques as those described above in relation to FIG. 18. For example, the discrete mass 176 can be injected into the cavity 388 through a face aperture formed in the strike plate 304. After the polymeric material is injected, and cured, the face aperture can be plugged with polymeric material, or another material, such as a plug made of aluminum or titanium.

The enclosure 386 helps to prevent the filler material 201 from entering the cavity 388 of the enclosure. In other words, the enclosure 386 has a closed top and bottom and closed sides, such that the filler material 201 does not penetrate into the cavity 388 of the enclosure 386. In this manner, the enclosure 386 seals off the cavity 388 from the rest of the internal cavity 342. Accordingly, the filler material 201 can be filled into the internal cavity 342 around the enclosure 386 at a first manufacturing step, such that the cavity 388 of the enclosure 386 is unoccupied. Then, at a second manufacturing step, such as after the CT of the golf club head 300 is determined, the polymeric material can be injected into the cavity 388 of the enclosure 386, such as through a face aperture, to tune the CT of the golf club head 300.

Although not shown, in some embodiments, the foam enclosures of multiple stiffeners 150 are effectively combined to form a one-piece, continuous, monolithic construction. In other words, while the discrete masses 176 and cavities 388 of each of multiple stiffeners 150 can be spaced apart from each other in a direction parallel to the x-axis of the golf club head origin coordinate system 185, the enclosures can be combined to form an enclosure ladder. The enclosure ladder includes a single piece of foam with multiple spaced-apart cavities 388 formed in the foam. The cavities 388 are formed in the enclosure ladder at the desired locations of the discrete masses 176 on the back surface 354 of the strike plate 304. The golf club head 300 can include multiple enclosure ladders each enclosure ladder can include any number of cavities 388. The enclosure ladder is coupled to the back surface 354 of the strike plate 304 before the strike plate 304 is welded to the body 302 in some examples, or after the strike plate 304 is welded to the body 302.

According to some examples, the discrete mass 176 is rearwardly retained by a portion of the body 102 of the golf club head 100. The portion of the body 102 rearwardly retaining the discrete mass 176 can be the sole bar 131 or a wall and can be made of a first material having a first modulus of elasticity. In some examples, the first modulus of elasticity is between 15 and 350 GPa. According to other examples, the first modulus of elasticity is between 90 and 210 GPa. In one example, the first modulus of elasticity is the same as the modulus of elasticity of the body 102. For example, the first material can be one of titanium or steel. However, in other examples, the discrete mass 176 is rearwardly retained by a feature not formed with the body 102, such as a stand-alone wall, where the first material is different than that of the body 102 and the first modulus of elasticity is different than that of the body 102. As an example, the first material can be a non-metal, such as a plastic or polymer. Generally, however, the rearward retaining feature, whether part of the body 102 or attached to the body 102, is stiffer than the lateral retaining features. For example, the discrete mass 176 is made of a second material having a second modulus of elasticity that is less than the first modulus of elasticity. The rearward retaining feature has a relatively higher modulus of elasticity to support the discrete mass 176 under the application of front-to-back loads placed on the discrete mass 176 caused by impact of a golf ball against the strike face 106 during a swing.

In some examples, the lateral retaining features, which laterally retain the discrete mass 176 are made of a third material having a third modulus of elasticity. The lateral retaining features are the side walls of the enclosure in some examples, or stand-alone walls in other examples. The third modulus of elasticity is less than the first modulus of elasticity and the second modulus of elasticity. In some examples, the third modulus of elasticity is between 0.01 GPa and 8.0 GPa. According to other examples, the third modulus of elasticity is between 0.05 GPa and 2.0 GPa. The third material is foam in one example. In other examples, the third material is a relatively soft polymer or low-strength metal. Generally, the lateral retaining features are less stiff than the rearward retaining feature because the lateral retaining features are configured to laterally retain the discrete mass 176 in place and the lateral loads (e.g., heel-to-toe loads) placed on the discrete mass 176 during a golf swing are less than the front-to-back loads placed on the discrete mass 176. The third modulus of elasticity is higher than a modulus of elasticity of the filler material 201 in one example.

As presented above, the discrete mass 176 is made of a second material having a second modulus of elasticity. The second modulus of elasticity is less than the first modulus of elasticity of the first material of the rearward retaining feature and greater than the third modulus of elasticity of the third material of the lateral retaining features. In some examples, the second modulus of elasticity is between 0.5 GPa and 30 GPa. According to other examples, the second modulus of elasticity is between 1 GPa and 5.0 GPa. The second material is acrylic in one example.

In some examples, although not shown, the stiffener 150 of the golf club head 100 includes a fastener. The fastener of each stiffener 150 is at least partially within the internal cavity 142 of the body 102. For example, a part of the fastener is accessible from outside of the internal cavity 142 and another part of the fastener is located inside the internal cavity 142. Such a fastener is engageable by an adjustment tool at a location outside of the internal cavity 142. The fastener can be any of various types of fasteners, such as screws, bolts, nails, pins, nuts, washers, pegs, and the like. In one implementation, the fastener 198 is a threaded fastener (i.e., a fastener with threads) with a head portion, engageable by an adjustment tool, and a threaded shank extending from the head portion. The fastener is adjustably coupled to the body 102 and adjustable to contact the back surface 154 of the strike plate 104 at a location where adjustability of the CT is desired. In some implementations, the fastener is adjustable to position the fastener into contact with the back surface 154 and out of contact with the back surface 154. However, in other implementations, the fastener stays in contact with back surface 154, with the amount of area of the fastener in contact with back surface 154 being adjustable. The fastener of each stiffener 150 can be adjustably coupled to the body 102 in any of various ways.

In some implementations, the fastener has a rounded end surface. The fastener is adjustable to adjust the amount of area of the rounded end surface of the fastener in contact with the back surface 154 of the strike plate 104. In other words, the fastener is translatable toward the strike plate 104 to increase the area of the rounded end surface in contact with the back surface 154 and away from the strike plate 104 to decrease the area of the rounded end surface in contact with the back surface 154. Due to Hertzian contact stress variations caused by adjustment in the amount of area of the rounded end surface in contact with the back surface 154, the stiffness of the strike plate 104 can correspondingly vary (e.g., be incrementally adjustable).

Referring to FIGS. 26-29, and according to some examples, an iron-type golf club head 500 includes a stiffener 150. The golf club head 500 is similar to the golf club head 200 and the golf club head 300 in that the golf club head 500 has a hollow-body construction. For example, the golf club head 500 includes a body 502 and a strike plate 504 attached to a front portion of the body 502. The strike plate 504 defines a strike face 506 on one side of the strike plate 504 and a back surface 554 on the opposite side of the strike plate 504. The golf club head 500 also includes a rear wall 577 that is co-formed with the body 502. The back surface 554 and the rear wall 577 cooperatively define an internal cavity 542 of the golf club head 500. The golf club head 500 also includes a filler material 501 that fills the internal cavity 542 after the stiffener 150 is located within the internal cavity 542 as will be described. The filler material 501 can be the same as or similar to the filler material 201 described herein.

The rear wall 577 includes an aperture 538 (e.g., rear aperture) sized and shaped to allow a stiffening plug 576, of the stiffener 150, to be inserted and retained within the internal cavity 542. For example, the aperture 538 can have a large diameter portion and a coextensive smaller diameter portion. The large diameter portion allows the stiffening plug 576 to pass into the internal cavity 542 and the smaller diameter portion allows the plug 576 to be slid along the aperture 538 while a keying portion 581 moves within and is retained by the smaller diameter portion. Upon insertion of the stiffening plug 576 through the aperture 538, the stiffening plug 576 is compressed slightly so that frictional engagement occurs between a forward engagement surface 585 of the stiffening plug 576 and the back surface 554 of the strike plate 504 and frictional engagement occurs between a rearward engagement surface 579 of the stiffening plug 576 and the interior surface of the rear wall 577. The contact and frictional engagement with the back surface 554 of the strike plate 504 and the interior surface of the rear wall 577 has the effect of lowering the CT proximate the location of contact with the strike plate 504. Accordingly, the stiffening plug 576 can be used to lower the CT of the golf club head 500.

Figure 29:
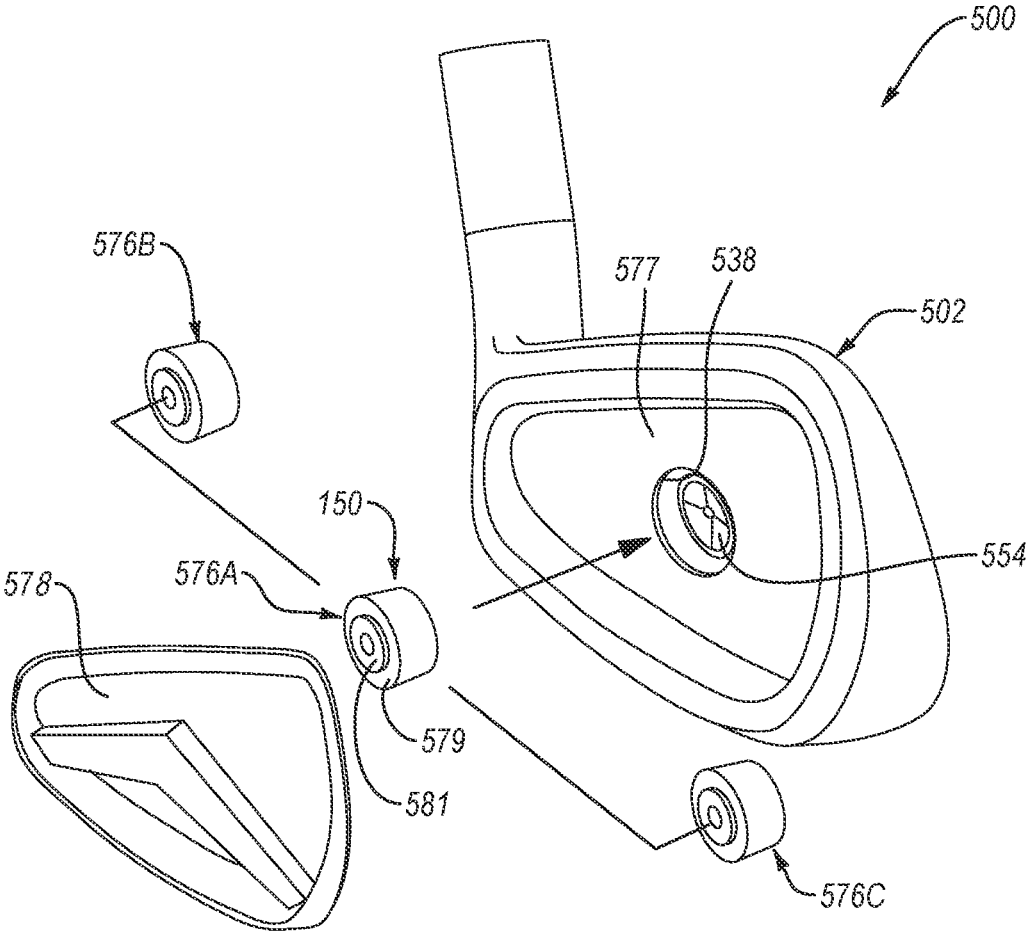
FIG. 29 is an exploded perspective view of the iron-type golf club head of FIG. 26, shown with a rear fascia, according to one or more examples of the present disclosure.

After the stiffening plug 576 is in place within the internal cavity 542, the filler material 501 can be added to fill the internal cavity 542 around the stiffening plug 576 to help retain the stiffening plug 576 in place within the internal cavity 542. In one example, the total mass of the filler material 401 and the stiffening plug 576 is greater than 5 grams, such as greater than 5.5 grams. Moreover, in some examples, after the stiffening plug 576 is in place within the internal cavity 542, as shown in FIG. 29, a rear fascia 578 is attached to at least a portion of the rear wall 577 to cover the rear aperture 538 and at least the portion of the rear wall 577. The rear aperture 538 has a total area of at least 200 mm—2 in one example, at least 300 mm^2 in another example, or at least 400 mm^2 in yet another example.

The higher the surface area of the forward engagement surface 585 in contact with the back surface 554 the higher the CT drop. In some examples, the surface area of the forward engagement surface 585 in contact with the back surface 554 is the same as, or similar to, the surface area of the polymeric material of the discrete mass 176 in contact with the back surface of the strike plate as described above.

In some examples, the stiffening plug 576 is made of the polymeric material described herein. According to certain examples, the stiffening plug 576 is made a urethane or silicone material having a density of about 0.95 g/cc to about 1.75 g/cc, or about 1 g/cc. The stiffening plug 576 has a hardness of about 10 to about 70 shore A hardness in some examples. In certain examples, a shore A hardness of about 40 or less is preferred. In certain examples, a shore D hardness of up to about 40 or less is preferred. In yet other examples, the aperture 538, the stiffening plug 576, and the filler material 501 are configured in a manner as described in U.S. Pat. No. 8,088,025, issued Jan. 3, 2012.

The CT of the golf club head 500 can be tuned by inserting one of a plurality of stiffening plugs, having different properties from each other, that results in a desired change in the CT of the golf club head 500. For example, referring to FIG. 29, the first stiffening plug 576A, the second stiffening plug 576B, and the third stiffening plug 576C have different properties and each are insertable through the aperture 538 into contact with the back surface 554 of the strike plate 504. The first stiffening plug 576A, the second stiffening plug 576B, and the third stiffening plug 576C can form a set of interchangeable stiffening plugs. The first stiffening plug 576A has first properties, the second stiffening plug 576B has second properties, different than the first properties, and the third stiffening plug 576C has third properties, different than the first properties and the second properties. The properties of the stiffening plugs are any properties that affect the CT of the golf club head 500, such as hardness. Accordingly, the first stiffening plug 576A can have a first hardness, the second stiffening plug 576B can have a second hardness, higher than the first hardness, and the third stiffening plug 576C can have a third hardness, higher than the second hardness.

According to one method of tuning the CT of the golf club head 500, after the strike plate 504 is welded to the body 502, the CT of the golf club head 500 is determined. Based on the determined CT of the golf club head 500 (e.g., the difference between the determined CT and a desired CT), the one of the first stiffening plug 576A, the second stiffening plug 576B, or the third stiffening plug 576C with properties corresponding to drop in the CT that corresponds with the difference between the determined CT and the desired CT, is inserted into the internal cavity 542 against the back surface 554. For example, where the difference between the determined CT and the desired CT is relatively large, the third stiffening plug 576C, with the third hardness, can be inserted into the internal cavity 542 against the back surface 554. Alternatively, if the difference between the determined CT and the desired CT is relatively low, the first stiffening plug 576A, with the first hardness, can be inserted into the internal cavity 542 against the back surface 554. In this manner, the CT of the golf club head 500 can be selectively tuned.

In some examples, after a stiffening plug 576 is inserted into the internal cavity 542 against the back surface 554, the CT of the golf club head 500 is retested to determine whether the CT meets the desired CT. If the retested CT is different enough from the desired CT, the stiffening plug 576 in the internal cavity 542 can be removed and replaced with a different stiffening plug having a different effect on the CT of the golf club head 500 so that the desired CT is met.

The stiffeners 150 of the golf club heads disclosed herein, including the discrete masses 176 and the stiffening plugs 576, advantageously promote a reduction of the CT of the golf club head at discrete locations on the strike face of the golf club head. In some embodiments, to further promote a reduction in the standard deviation of the CT, away from a target CT, at the center face of the strike plate, as well as at locations +20 mm and −20 mm horizontally away from the center face (e.g., along the x-axis), for a produced batch of golf club heads, the stiffeners 150 of the golf club head can be added, replaced, or adjusted, to tune the CT, after the batch of golf club heads is produced. Lowering the standard deviation allows the produced golf club heads of a given batch to have a CT closer to a target CT, which allows selection of a target CT that is closer to a regulated CT threshold for the golf club heads. For example, even if a CT of a golf club head of a given batch does not meet the regulated CT threshold after production, one or more stiffeners 150 of the golf club head 100 can be added, replaced, or adjusted to tune down the CT such that the regulated CT threshold is met. Similarly, if a CT of a golf club head of a given batch does not meet the target CT after production, one or more stiffeners 150 of the golf club head 100 can be added or adjusted to tune the CT such that the target CT is achieved.

Accordingly, the standard deviation of the batch of golf club heads can be based on the tunability range of the CT of the golf club heads of the batch. In one embodiment, the standard deviation is about two microseconds. According to other embodiments, the standard deviation is between about one microsecond and about four microseconds. According to some embodiments, the target CT is between one microsecond and 20 microseconds lower than a regulated CT threshold. In one example, the target CT is about 10 microseconds lower than the regulated CT threshold. In yet another embodiment, the target CT is between 0.4% and 7.8% lower than the regulated CT threshold. In one example, the target CT is about 4% lower than the regulated CT threshold.

According to some embodiments, the stiffener 150 of a golf club head, disclosed herein, is adjusted and the CT of the golf club head is tuned by adding material to the stiffener 150. Referring to the golf club heads described herein, in some examples, adding polymeric material into the golf club head to form or add to one or more discrete masses 176, such as by using an injection tool 177, locally decreases the CT. The location of a discrete mass 176, for forming or adding to the discrete mass 176, can be accessed through an aperture formed in the exterior wall of the body or the strike plate of the golf club head, or through the rear opening of a cavity-back golf club head. Accordingly, the entirety of the golf club head, including attachment of foam, foam enclosures, foam enclosure ladders, aperture, and aperture plugs can be produced and assembled. Then, the CT of the produced golf club head can be tested. If the tested CT of the produced golf club head is higher than a target CT, polymeric material can be added to form or enlarge one or more discrete masses 176 until the CT of the produced golf club head is decreased to or below the target CT. After adding polymeric material to the golf club head through one or more of the apertures, the corresponding apertures can be permanently or non-permanently plugged in preparation for actual use of the golf club head by an end user.

According to some implementations, more precise tuning of the CT can be accomplished by varying the quantity or types of polymeric material added to the golf club head to form the discrete masses 176. In some implementations, the polymeric material of all the discrete masses 176 of the golf club head is the same while the quantity of the polymeric material of at least one of the discrete masses 176 is different than another of the discrete masses 176. For example, testing of the produced golf club head may reveal the need for greater reduction of the CT at one location on the strike face than at another location. Accordingly, more polymeric material can be added to (i.e., a larger discrete mass 176 can be formed at) the one location compared to the other location. In other implementations, the quantity of the polymeric material of the discrete masses 176 is the same, but the type of polymeric material of at least one discrete mass 176 is different than that of another discrete mass 176. For example, testing of the produced golf club head may reveal the need for greater reduction of the CT at one location on the strike face than at another location. Accordingly, a polymeric material with a higher hardness can be added to the one location compared to the polymeric material at the other location. In one particular example, the type of polymeric material added to the cavities of the enclosures or enclosure ladder is different for each of the cavities, the hardness of the polymeric material being progressively higher the further toeward from the origin 183 and the further heelward from the origin 183.

According to some embodiments, the stiffener 150 of the golf club head is adjusted and the CT of the golf club head is tuned by adjusting a fastener of the stiffener 150. The entirety of the golf club head, including the fasteners, can be produced. Then, the CT of the produced golf club head can be tested. If the tested CT of the produced golf club head is higher than a target CT, the fastener can be adjusted, such as by using an adjustment tool, to either bring the fastener into contact with the back surface and/or increase the area of the fastener in contact with the back surface until the CT of the produced golf club head is decreased to or below the target CT. In some implementations, more precise tuning of the CT can be accomplished by independently and dissimilarly adjusting the fasteners of the stiffeners 150 of a given golf club head. For example, one of the fasteners of a golf club head can be adjusted into contact with the back surface while another of the fasteners of the golf club head remains out of contact with the back surface. As another example, the fasteners of a given golf club head can be adjusted differently such that the area of one fastener in contact with the back surface can be different than the area of another fastener in contact with the back surface.

Figure 20:
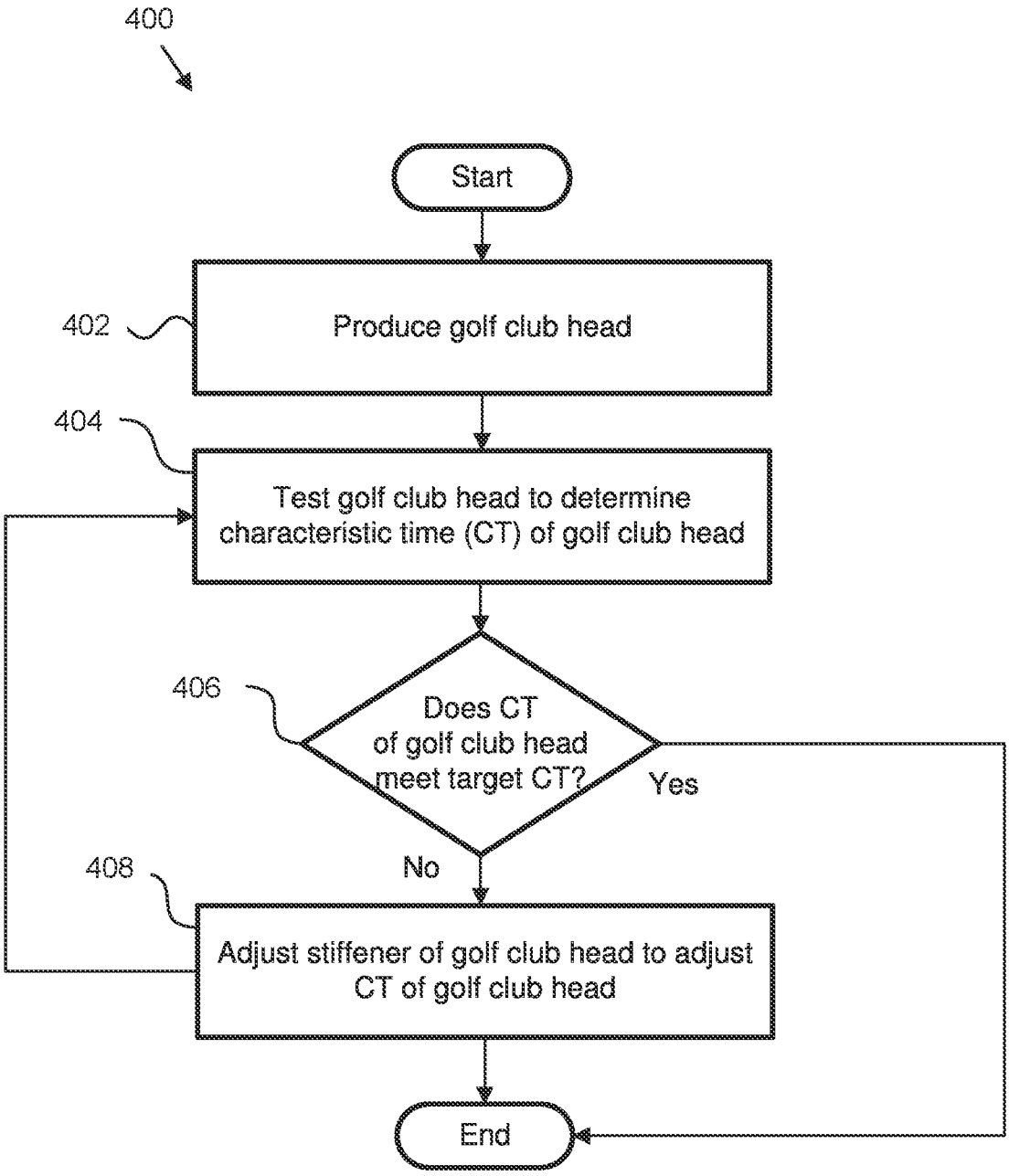
FIG. 20 is a schematic flow diagram of a method of tuning a characteristic time (CT) of a golf club head, after the golf club head is fully manufactured, according to one or more examples of the present disclosure.

Referring to FIG. 20, according to one embodiment, a method 400 of tuning the CT of a golf club head, such as the golf club head 100, the golf club head 300, or the golf club head 500 after production of the golf club head is disclosed. As defined herein, a golf club head, after production, or a post-production golf club head is a fully functional golf club head with a fully formed body. With the exception of possible ports for securing weights or plugs, the body of a post-production golf club head is fully enclosed. According to another definition, with the possible exception of not meeting a regulated CT threshold, a post-production golf club head meets all other regulated thresholds, such as those thresholds regulated by the USGA.

The method 400 may initially include producing the golf club head at 402. The produced golf club head includes at least one stiffener 150, such one or more discrete masses 176 or stiffening plugs 576, for adjusting the CT of the golf club head. The stiffener is at least partially within an internal cavity of the golf club head and directly coupleable to a face portion of the golf club head. The method 400 additionally includes testing the golf club head to determine the CT of the golf club head at 404. The CT test utilize at 404 of the method 400 may be a pendulum-based CT test standardized by the USGA. The method 400 further includes determining whether the CT of the golf club head, determined by testing at 404, meets a desired or target CT at 406. If the CT of the golf club head meets the target CT at 406, then the method 400 ends. However, if the CT of the golf club head does not meet the target CT, then the method 400 proceeds to adjust the stiffener of the golf club head to adjust the CT of the golf club head at 408. In some implementations, after adjusting the stiffener at 408, the method 400 again tests the golf club head to determine the CT of the golf club head at 404 and the method 400 continues from there. In one example, the target CT is greater than 250 microseconds.

Adjusting the at least one stiffener of the golf club head at 408 can be accomplished in several different ways depending on the configuration of the stiffener. For example, where the stiffener 150 includes a discrete mass 176 directly coupled to the back surface of the strike plate of the golf club head, adjusting the stiffener at 408 includes adding a polymeric material, such as one having a hardness equal to or greater than about Shore 10D, to at least one stiffener through a port or aperture formed in the body of the golf club head. As mentioned above, where the stiffener is a stiffening plug, adjusting the stiffener can include replacing the stiffening plug with another stiffening plug. According to yet another example, where the stiffener includes a fastener at least partially within the internal cavity of the golf club head and adjustably coupled to the body of the golf club head, adjusting the stiffener at 308 includes adjusting (e.g., rotating) the fastener into contact with the face portion of the golf club head or adjusting the fastener while in contact with the face portion of the golf club head.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

The features of the golf club head described herein, including the ability to tune the CT after complete manufacturing of the golf club head, promote higher CT values across larger surface areas of the strike face, particularly within a central region, than conventional golf club heads.

In some examples, the golf club heads disclosed herein can have one or more of the features disclosed in U.S. Patent Application Publication No. 2018/0185717, published Jul. 5, 2018.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the examples below are to be embraced within their scope.

What is claimed is:

1. An iron-type golf club head, comprising:

a body, comprising a heel portion, a sole portion, a toe portion, a top-line portion, a front portion, and a rear portion, wherein the rear portion comprises a rear opening, the rear opening having a total area of at least 400 square millimeters ($mm^2$), and wherein the front portion comprises a strike face and a back surface opposite the strike face;

a rear fascia, coupled to the rear portion of the body and covering the rear opening and at least partially enclosing an internal cavity; and a stiffening material positioned within the internal cavity and in contact with the back surface of the front portion and a forward-facing surface of the rear portion, wherein the stiffening material is insertable, through the rear opening, into the internal cavity before the rear fascia is coupled to the rear portion of the body;

wherein a characteristic time (CT) at a geometric center of the strike face is at least 250 microseconds;

wherein a maximum thickness of the front portion, at the strike face, is less than or equal to 3.5 mm;

wherein the front portion, at the strike face, excluding grooves, has a minimum thickness between, and inclusive of, 1.1 mm and 2.2 mm;

wherein the rear fascia is made of a material having a density between, and inclusive of, 0.9 grams/cubic-centimeter (g/cc) and 5 g/cc;

wherein the iron-type golf club head has an external head volume between, and inclusive of, 15 cc and 70 cc, and the internal cavity has a cavity volume between, and inclusive of, 5 cc and 30 cc;

wherein the stiffening material occupies less than 25% of the back surface of the front portion along an x-axis, and the stiffening material has a surface area of at least 50 $mm^2$; and wherein the stiffening material comprises a polymeric material having a density of no more than 1.75 g/cc.

2. The iron-type golf club head according to claim 1, wherein at least a portion of the rear opening extends from a first region of the rear portion, proximate the sole portion, to a second region of the rear portion, proximate the top-line portion.

3. The iron-type golf club head according to claim 2, wherein the second region is proximate to an underside surface of the top-line portion.

4. The iron-type golf club head according to claim 2, wherein a face thickness of the front portion, at a location corresponding with the first region, is greater than a face thickness of the front portion, at a location corresponding with the second region.

5. The iron-type golf club head according to claim 1, wherein the stiffening material has a hardness of at least 10 Shore A and no more than 40 Shore D.

6. The iron-type golf club head according to claim 5, further comprising at least one weight element, comprising tungsten, at least partially located within the internal cavity.

7. The iron-type golf club head according to claim 6, wherein the stiffening material has a mass of less than 5 g.

8. The iron-type golf club head according to claim 7, wherein the hardness of the stiffening material is at least 5.95 Shore D and the density of the stiffening material is at least 0.95 g/cc.

9. The iron-type golf club head according to claim 8, wherein the stiffening material has a face contact surface in contact with the back surface of the front portion, and wherein the face contact surface is circular.

10. The iron-type golf club head according to claim 9, wherein the stiffening material has a rear portion contact surface in contact with the rear portion, and wherein the rear portion contact surface is circular.

11. The iron-type golf club head according to claim 8, wherein the stiffening material comprises a tapered polymeric plug comprising a tapering sidewall.

12. The iron-type golf club head according to claim 5, wherein the stiffening material contacts the back surface of the front portion at spaced-apart locations on the back surface of the front portion.

13. The iron-type golf club head according to claim 12, wherein a combined surface area of the back surface of the front portion contacted by the stiffening material is at least 100 $mm^2$.

14. The iron-type golf club head according to claim 13, wherein the stiffening material contacts at least 5% (0.05) of a total surface area of the back surface of the front portion.

15. The iron-type golf club head according to claim 5, wherein the front portion further comprises a front opening, wherein the strike face comprises a strike plate joined to the front portion to cover the front opening, and wherein the strike plate comprises a sole wrap portion that defines a portion of the sole portion.

16. The iron-type golf club head according to claim 15, wherein a portion of the strike plate is welded to the sole portion.

17. The iron-type golf club head according to claim 16, wherein the strike plate comprises a forged steel and at least a portion of the sole portion comprises stainless steel.

18. The iron-type golf club head according to claim 16, wherein the strike plate has a varying thickness with a maximum thickness of less than 2 mm.

19. The iron-type golf club head according to claim 16, wherein the strike plate is formed of a strike plate material different than a material forming the rear portion of the body.

20. The iron-type golf club head according to claim 16, wherein the stiffening material has a face contact surface in contact with the back surface of the strike plate, wherein the face contact surface has a geometric center that is offset from an origin of a club head origin coordinate system having an x-axis and a z-axis, and wherein the geometric center of the face contact surface is at least 10 mm away from the z-axis when measured along the x-axis.

21. The iron-type golf club head according to claim 16, wherein the stiffening material has a face contact surface in contact with the back surface of the strike plate, wherein the face contact surface has a geometric center that is offset from an origin of a club head origin coordinate system having a x-axis and a z-axis, and wherein the geometric center of the face contact surface is located toward the toe portion.

22. The iron-type golf club head according to claim 16, wherein the stiffening material has a face contact surface in contact with the back surface of the strike plate, wherein the face contact surface has a geometric center that is offset from an origin of a club head origin coordinate system having a x-axis and a z-axis, and wherein the geometric center of the face contact surface has a positive x-axis coordinate.

23. An iron-type golf club head, comprising:

a body, comprising a heel portion, a sole portion, a toe portion, a top-line portion, a front portion, and a rear portion, wherein the rear portion comprises a rear opening, the rear opening having a total area of at least 400 square millimeters ($mm^2$), and wherein the front portion comprises a strike face and a back surface opposite the strike face;

a rear fascia, coupled to the rear portion of the body and covering the rear opening and at least partially enclosing an internal cavity; and a stiffening material positioned within the internal cavity and in contact with the back surface of the front portion and a forward-facing surface of the rear portion, wherein the stiffening material is insertable, through the rear opening, into the internal cavity before the rear fascia is coupled to the rear portion of the body;

wherein a characteristic time (CT) at a geometric center of the strike face is at least 250 microseconds;

wherein a maximum thickness of the front portion, at the strike face, is less than or equal to 3.5 mm;

wherein the front portion, at the strike face, excluding grooves, has a minimum thickness between, and inclusive of, 1.1 mm and 2.2 mm;

wherein the rear fascia is made of a material having a density between, and inclusive of, 0.9 grams/cubic-centimeter (g/cc) and 5 g/cc;

wherein the iron-type golf club head has an external head volume between, and inclusive of, 15 cc and 70 cc, and the internal cavity has a cavity volume between, and inclusive of, 5 cc and 30 cc;

wherein the stiffening material occupies less than 25% of the back surface of the front portion along the x-axis;

wherein the front portion further comprises a front opening;

wherein the strike face comprises a strike plate joined to the front portion to cover the front opening;

wherein the strike plate comprises a sole wrap portion that defines a portion of the sole portion;

wherein a portion of the strike plate is welded to the sole portion; and wherein at least a portion of the rear opening extends from a first region of the rear portion, proximate the sole, to a second region of the rear portion, proximate the top-line portion.

24. The iron-type golf club head according to claim 23, wherein the stiffening material comprises a polymeric material having a hardness of at least 10 Shore A, and a density of no more than 1.75 g/cc.

25. The iron-type golf club head according to claim 24, further comprising at least one weight element, comprising tungsten, at least partially located within the internal cavity, wherein the hardness of the stiffening material is no more than 40 Shore D and a mass of the stiffening material is less than 5 grams.

26. The iron-type golf club head according to claim 25, wherein the strike plate is formed of a strike plate material different than a material forming the rear portion of the body.

27. The iron-type golf club head according to claim 26, wherein the stiffening material has a face contact surface in contact with the back surface of the strike plate, wherein the face contact surface has a geometric center that is offset from an origin of a club head origin coordinate system having an x-axis and a z-axis, and wherein the geometric center of the face contact surface is at least 10 mm away from the z-axis when measured along the x-axis.

28. The iron-type golf club head according to claim 26, wherein the stiffening material has a face contact surface in contact with the back surface of the strike plate, wherein the face contact surface has a geometric center that is offset from an origin of a club head origin coordinate system having a x-axis and a z-axis, and wherein the geometric center of the face contact surface is located toward the toe portion.

29. The iron-type golf club head according to claim 26, wherein the stiffening material has a face contact surface in contact with the back surface of the strike plate, wherein the face contact surface has a geometric center that is offset from an origin of a club head origin coordinate system having a x-axis and a z-axis, and wherein the geometric center of the face contact surface has a positive x-axis coordinate.

30. The iron-type golf club head according to claim 26, further comprising at least one weight element, comprising tungsten, at least partially located within the internal cavity.

31. An iron-type golf club head, comprising:

a body, comprising a heel portion, a sole portion, a toe portion, a top-line portion, a front portion, and a rear portion, wherein the rear portion comprises a rear opening, the rear opening having a total area of at least 400 square millimeters ($mm^2$), and wherein the front portion comprises a strike face and a back surface opposite the strike face;

a rear fascia, coupled to the rear portion of the body and covering the rear opening and at least partially enclosing an internal cavity; and a stiffening material positioned within the internal cavity and in contact with the back surface of the front portion and a forward-facing surface of the rear portion, wherein the stiffening material is insertable, through the rear opening, into the internal cavity before the rear fascia is coupled to the rear portion of the body;

wherein a characteristic time (CT) at a geometric center of the strike face is at least 250 microseconds;

wherein a maximum thickness of the front portion, at the strike face, is less than or equal to 3.5 mm;

wherein the front portion, at the strike face, excluding grooves, has a minimum thickness between, and inclusive of, 1.1 mm and 2.2 mm;

wherein the rear fascia is made of a material having a density between, and inclusive of, 0.9 grams/cubic-centimeter (g/cc) and 5 g/cc;

wherein the iron-type golf club head has an external head volume between, and inclusive of, 15 cc and 70 cc, and the internal cavity has a cavity volume between, and inclusive of, 5 cc and 30 cc;

wherein the front portion further comprises a front opening;

wherein the strike face comprises a strike plate joined to the front portion to cover the front opening;

wherein the strike plate comprises a sole wrap portion that defines a portion of the sole portion, and a portion of the strike plate is welded to the sole portion;

wherein the stiffening material contacts less than 25% of a total surface area of a back surface of the strike plate, and the stiffening material has a surface area of at least 50 $mm^2$; and wherein the stiffening material comprises a polymeric material having a hardness of at least 10 Shore A and no more than 40 Shore D, and a density of no more than 1.75 g/cc.

32. The iron-type golf club head according to claim 31, wherein the stiffening material contacts at least 5% (0.05) of a total surface area of the back surface of the strike plate.

33. The iron-type golf club head according to claim 32, further comprising at least one weight element, comprising tungsten, at least partially located within the internal cavity.

34. The iron-type golf club head according to claim 33, wherein the stiffening material has a mass of less than 5 g and a density of the stiffening material is at least 0.95 g/cc.

35. The iron-type golf club head according to claim 33, wherein at least a portion of the rear opening extends from a first region of the rear portion, proximate the sole portion, to a second region of the rear portion, proximate the top-line portion.

36. The iron-type golf club head according to claim 35, wherein a face thickness of the front portion, at a location corresponding with the first region, is greater than a face thickness of the front portion, at a location corresponding with the second region.

37. The iron-type golf club head according to claim 32, wherein the stiffening material contacts the back surface of the strike plate at spaced-apart locations on the back surface of the strike plate.

* * * * *